US007448168B2

(12) United States Patent
Waalkes et al.

(10) Patent No.: US 7,448,168 B2
(45) Date of Patent: Nov. 11, 2008

(54) KNOCK-DOWN PORTABLE PARTITION SYSTEM

(75) Inventors: Michael L. Waalkes, East Grand Rapids, MI (US); Marcus K. Pressnell, Athens, AL (US); Mark T. Slager, Caledonia, MI (US); Michael R. Shields, Greensboro, NC (US); Brian J. Kane, San Francisco, CA (US); Robin Christopher, Athens, AL (US); Dennis J. Boyle, Palo Alto, CA (US); Charles A. Seiber, Belmont, CA (US); Peter N. Skillman, San Carlos, CA (US); Joseph Chang, Grand Rapids, MI (US); Richard S. Hand, Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 11/761,693

(22) Filed: Jun. 12, 2007

(65) Prior Publication Data

US 2007/0227079 A1 Oct. 4, 2007

Related U.S. Application Data

(60) Continuation of application No. 11/044,843, filed on Jan. 27, 2005, which is a continuation of application No. 10/179,607, filed on Jun. 25, 2002, now Pat. No. 6,910,306, which is a continuation-in-part of application No. 09/829,028, filed on Apr. 9, 2001, now Pat. No. 6,442,909, which is a continuation of application No. 09/407,520, filed on Sep. 28, 1999, now Pat. No. 6,301,846, which is a continuation-in-part of application No. 08/914,664, filed on Aug. 19, 1997, now Pat. No. 6,009,675, application No. 09/407,520, which is a continuation-in-part of application No. 09/243,915, filed on Feb. 3, 1999, now Pat. No. 6,079,173, which is a continuation of application No. 08/856,995, filed on May 15, 1997, now Pat. No. 5,899,035, application No. 10/179,607, which is a continuation-in-part of application No. 09/827,153, filed on Apr. 5, 2001, now Pat. No. 6,546,684, which is a continuation of application No. 09/558,753, filed on Apr. 21, 2000, now Pat. No. 6,276,103, which is a division of application No. 09/060,913, filed on Apr. 15, 1998, now Pat. No. 6,098,358.

(60) Provisional application No. 60/033,884, filed on Dec. 24, 1996.

(51) Int. Cl.

| | |
|---|---|
| ***E04C 2/52*** | (2006.01) |
| ***E04F 19/00*** | (2006.01) |
| ***E04B 2/74*** | (2006.01) |
| ***E04H 1/00*** | (2006.01) |

(52) U.S. Cl. ..... 52/27; 52/239; 52/220.7; 52/36.4; 52/36.5; 52/36.6; 52/220.2

(58) Field of Classification Search ..... 52/27, 52/239, 220.7, 36.4, 36.5, 36.6, 220.2, 220.3, 52/220.5, 29, 33, 36.2

See application file for complete search history.

(56) References Cited

U.S. PATENT DOCUMENTS

| | | | |
|---|---|---|---|
| 2,218,426 | A | 10/1940 | Hurlbert, Jr. |
| 2,218,428 | A | 10/1940 | Hurlbert, Jr. |
| D127,967 | S | 7/1941 | Meyer |
| 2,430,654 | A | 11/1947 | Voege |
| 2,963,127 | A | 12/1960 | Manville |
| 3,209,869 | A | 10/1965 | Hammitt |
| 3,462,892 | A | 8/1969 | Meyer |
| 3,492,766 | A | 2/1970 | Andrews |
| 3,567,260 | A | 3/1971 | Norris |
| 3,601,432 | A | 8/1971 | Fenwick |
| 3,638,376 | A | 2/1972 | Howes et al. |
| 3,697,034 | A | 10/1972 | Shell |
| 3,700,385 | A | 10/1972 | Sherwood |
| 3,713,474 | A | 1/1973 | Orlando |
| 3,745,732 | A | 7/1973 | Pritchard et al. |
| 3,749,432 | A | 7/1973 | Janssen |
| 3,789,567 | A | 2/1974 | Rae et al. |
| 3,858,988 | A | 1/1975 | Cohen |

| | | | | |
|---|---|---|---|---|
| 3,886,698 | A | | 6/1975 | Raith et al. |
| 3,888,440 | A | | 6/1975 | Rebentisch |
| 3,971,182 | A | | 7/1976 | Donahue et al. |
| 4,004,856 | A | | 1/1977 | Wesseler |
| 4,018,019 | A | | 4/1977 | Raith et al. |
| 4,048,768 | A | | 9/1977 | Good |
| 4,064,996 | A | * | 12/1977 | Shillum ..... 211/191 |
| 4,123,879 | A | | 11/1978 | Blodee et al. |
| 4,128,979 | A | | 12/1978 | Price |
| 4,154,419 | A | | 5/1979 | Breidenbach |
| 4,205,815 | A | | 6/1980 | Sauer et al. |
| 4,224,769 | A | | 9/1980 | Ball et al. |
| 4,249,578 | A | | 2/1981 | Freeman |
| 4,265,502 | A | | 5/1981 | Blodee et al. |
| 4,314,429 | A | | 2/1982 | Casteel et al. |
| 4,334,374 | A | | 6/1982 | Spamer et al. |
| 4,338,990 | A | | 7/1982 | Blodee et al. |
| 4,356,672 | A | | 11/1982 | Beckman et al. |
| 4,391,073 | A | | 7/1983 | Mollenkopf et al. |
| 4,406,374 | A | | 9/1983 | Yedor |
| 4,416,093 | A | | 11/1983 | Salkeld et al. |
| 4,434,596 | A | | 3/1984 | McAteer et al. |
| 4,448,231 | A | | 5/1984 | Salkeld et al. |
| 4,470,232 | A | | 9/1984 | Condevaux et al. |
| 4,485,597 | A | | 12/1984 | Worrallo |
| 4,489,530 | A | | 12/1984 | Chang |
| 4,535,577 | A | | 8/1985 | Tenser et al. |
| 4,567,698 | A | | 2/1986 | Morrison |
| 4,571,906 | A | | 2/1986 | Ashton |
| 4,625,476 | A | | 12/1986 | Shimada |
| 4,625,477 | A | | 12/1986 | Johnstonbaugh |
| 4,631,881 | A | | 12/1986 | Charman |
| 4,682,457 | A | | 7/1987 | Spencer |
| 4,685,255 | A | | 8/1987 | Kelley |
| 4,716,699 | A | | 1/1988 | Crossman et al. |
| 4,719,731 | A | | 1/1988 | Ravotti et al. |
| 4,757,657 | A | | 7/1988 | Mitchell et al. |
| 4,761,922 | A | | 8/1988 | Black |
| 4,771,583 | A | | 9/1988 | Ball et al. |
| 4,778,487 | A | | 10/1988 | Chenel |
| 4,837,988 | A | | 6/1989 | Menchetti et al. |
| 4,858,407 | A | | 8/1989 | Smolik |
| 4,876,835 | A | | 10/1989 | Kelley et al. |
| 4,914,873 | A | | 4/1990 | Newhouse |
| 4,914,878 | A | | 4/1990 | Tamaki et al. |
| 4,914,880 | A | | 4/1990 | Albertini |
| 4,918,879 | A | | 4/1990 | Bodurow et al. |
| 4,932,177 | A | | 6/1990 | Hinden |
| 4,936,066 | A | | 6/1990 | Rütsche et al. |
| 4,942,713 | A | | 7/1990 | Jackson |
| 4,971,281 | A | | 11/1990 | Steinbeck |
| 4,991,365 | A | | 2/1991 | Jackson |
| 4,991,368 | A | | 2/1991 | Amstutz |
| 5,033,526 | A | | 7/1991 | DeLong et al. |
| 5,038,539 | A | | 8/1991 | Kelley et al. |
| 5,054,255 | A | | 10/1991 | Maninfior |
| 5,056,285 | A | | 10/1991 | Frascaroli et al. |
| 5,062,246 | A | | 11/1991 | Sykes |
| 5,063,715 | A | | 11/1991 | Goodman |
| 5,065,559 | A | | 11/1991 | Zegel et al. |
| 5,069,263 | A | | 12/1991 | Edwards |
| 5,079,884 | A | | 1/1992 | Menchetti |
| 5,134,826 | A | | 8/1992 | La Roche et al. |
| 5,155,960 | A | | 10/1992 | Shaanan |
| 5,172,530 | A | | 12/1992 | Fishel et al. |
| 5,177,917 | A | | 1/1993 | del Castillo Von Haucke |
| 5,207,336 | A | | 5/1993 | Tyler |
| 5,209,035 | A | | 5/1993 | Hodges et al. |
| 5,211,502 | A | | 5/1993 | Upham-Hill |
| 5,214,890 | A | | 6/1993 | Levitan et al. |
| 5,216,859 | A | * | 6/1993 | Moreno et al. ..... 52/238.1 |
| 5,219,406 | A | | 6/1993 | Raz |
| 5,241,796 | A | | 9/1993 | Hellwig et al. |
| 5,274,970 | A | | 1/1994 | Roberts |
| 5,277,005 | A | | 1/1994 | Hellwig et al. |
| 5,287,666 | A | | 2/1994 | Frascaroli et al. |
| 5,377,466 | A | | 1/1995 | Insalaco et al. |
| 5,406,760 | A | | 4/1995 | Edwards |
| 5,464,302 | A | | 11/1995 | Menchetti |
| 5,477,971 | A | | 12/1995 | Howard |
| 5,487,246 | A | | 1/1996 | Hodges et al. |
| 5,491,943 | A | | 2/1996 | Vondrejs et al. |
| 5,495,952 | A | * | 3/1996 | Kainz ..... 211/90.04 |
| 5,511,349 | A | * | 4/1996 | Kelley et al. ..... 52/287.1 |
| 5,555,689 | A | * | 9/1996 | Gilmore ..... 52/489.1 |
| 5,586,593 | A | | 12/1996 | Schwartz |
| 5,600,926 | A | * | 2/1997 | Ehrlich ..... 52/239 |
| 5,606,919 | A | | 3/1997 | Fox et al. |
| 5,634,300 | A | * | 6/1997 | Huebner et al. ..... 52/36.1 |
| 5,642,593 | A | | 7/1997 | Shieh |
| 5,657,606 | A | | 8/1997 | Ressel et al. |
| 5,657,885 | A | | 8/1997 | White et al. |
| 5,685,121 | A | | 11/1997 | DeFrancesco et al. |
| 5,803,653 | A | | 9/1998 | Zuffetti |
| 5,806,258 | A | | 9/1998 | Miedema et al. |
| D407,665 | S | | 4/1999 | Churchville |
| 5,899,035 | A | | 5/1999 | Waalkes et al. |
| 5,931,429 | A | | 8/1999 | Hellwig et al. |
| 6,009,675 | A | | 1/2000 | Waalkes et al. |
| 6,079,173 | A | | 6/2000 | Waalkes et al. |
| 6,098,358 | A | | 8/2000 | Waalkes et al. |
| 6,115,977 | A | | 9/2000 | Hornberger et al. |
| 6,131,347 | A | | 10/2000 | Hornberger et al. |
| 6,178,702 | B1 | | 1/2001 | Hand et al. |
| 6,230,459 | B1 | | 5/2001 | Jeffers et al. |
| 6,276,103 | B1 | | 8/2001 | Waalkes et al. |
| 6,301,846 | B1 | | 10/2001 | Waalkes et al. |
| 6,363,663 | B1 | * | 4/2002 | Kane et al. ..... 52/36.6 |
| 6,442,909 | B2 | | 9/2002 | Waalkes et al. |
| 6,684,583 | B2 | * | 2/2004 | Hodges et al. ..... 52/220.7 |
| 6,910,306 | B2 | | 6/2005 | Waalkes et al. |
| 2003/0172602 | A1 | * | 9/2003 | DeFreitas ..... 52/220.3 |

FOREIGN PATENT DOCUMENTS

| | | |
|---|---|---|
| DE | 2425837 | 12/1975 |
| DE | 3726255 | 1/1989 |
| DE | 9419199 | 1/1995 |
| EP | 50241 | 4/1982 |
| EP | 0138658 | 4/1985 |
| JP | 06056237 | 3/1994 |
| JP | 06504344 | 5/1994 |

* cited by examiner

*Primary Examiner*—Richard E Chilcot, Jr.
*Assistant Examiner*—Mark R Wendell
(74) *Attorney, Agent, or Firm*—Price, Heneveld, Cooper, DeWitt & Litton, LLP

(57) ABSTRACT

A knock-down portable partition system has cover panels supported on a post and beam framework designed for quick and easy on-site manual assembly. The framework includes at least two vertical posts and at least two structural beams rigidly, yet detachably interconnecting the vertical posts. Connectors secure the beams to the posts, such that the partition system can be assembled and disassembled manually. The partition system may include utility troughs shaped to retain wires, cabling, etc. therein to provide power and/or communication to the system. The utility troughs have opposite ends shaped to be detachably mounted to the posts.

36 Claims, 50 Drawing Sheets

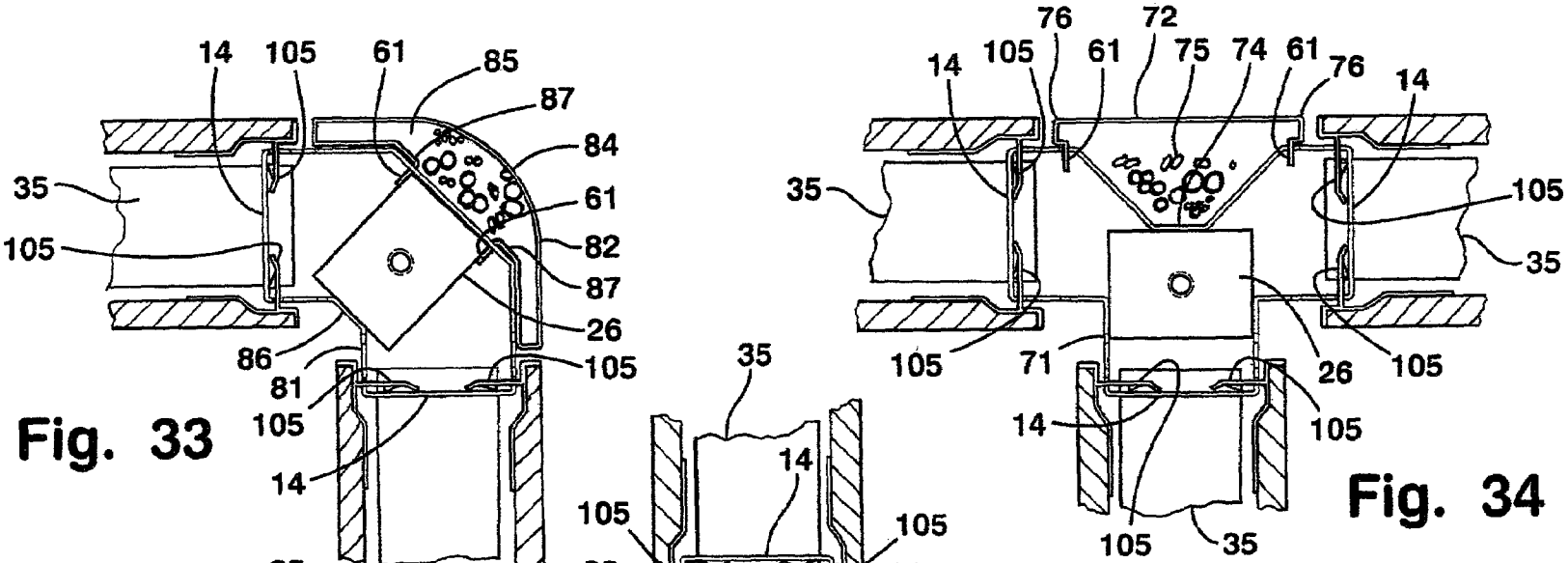
Fig. 34
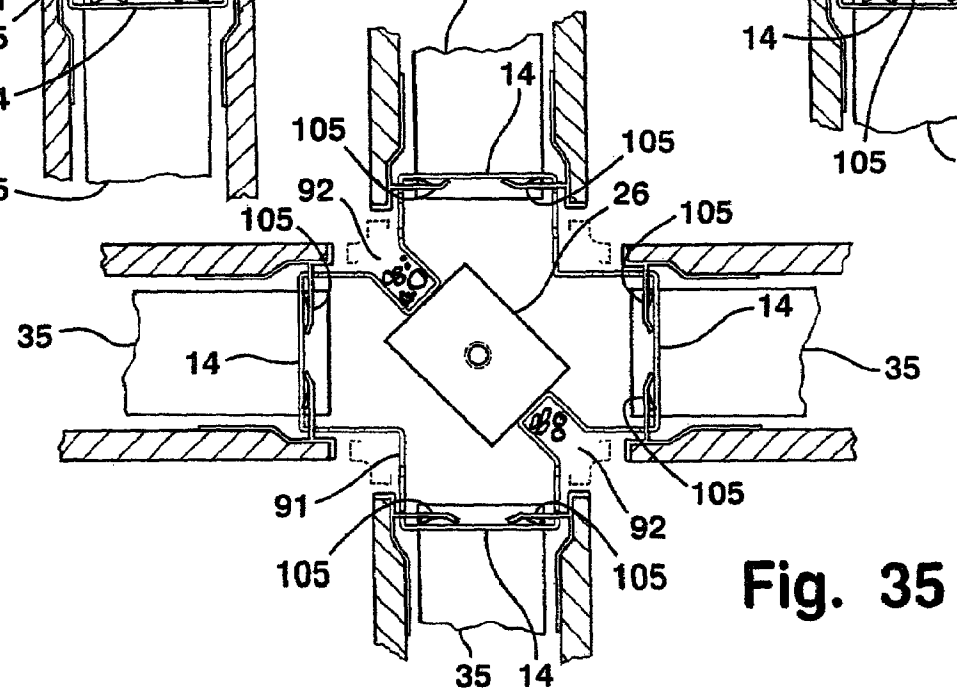
Fig. 35
Fig. 33

1006
1017
1016
1038
1098
1038
1034
1049
1072
1034
1022
1073
1015
1034
1048
1072
1010
1054
1021
1048
1050
1046
1012
1053
1051
A
1047
1011

1054
1121
1048
1006
1015
1037
1046
1012
1011

1010
1037
1015
1048
1048
1006
1054
1055
1053
1012
1121
1048
1051
A
1052
1011
1056

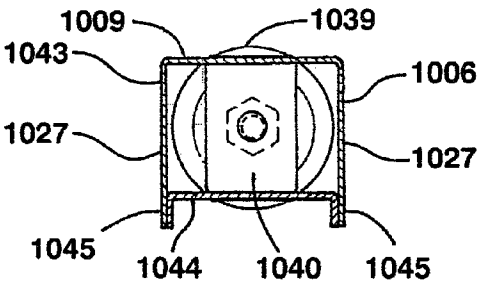
Fig. 50
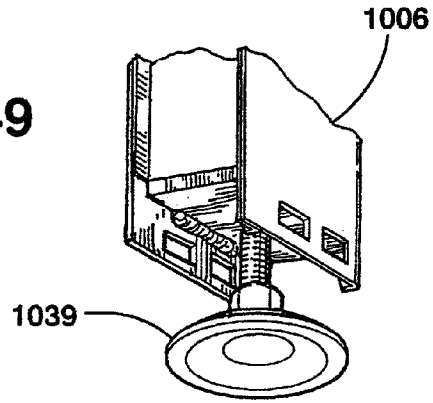
Fig. 51
Fig. 49
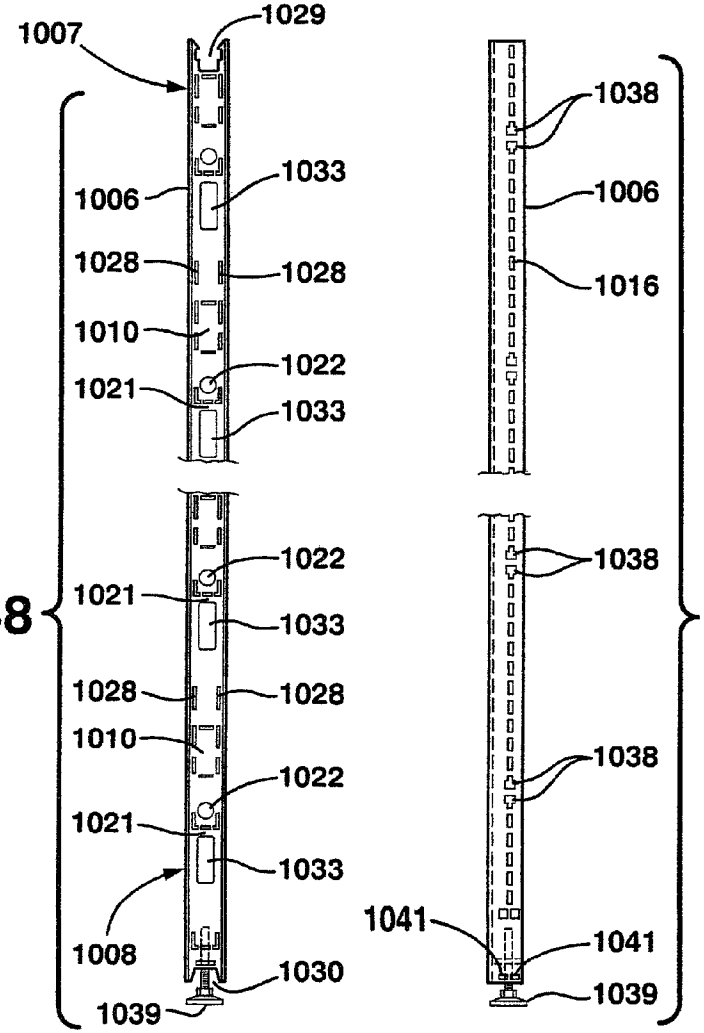
Fig. 48

1069
1070
1069
1087
1026
1088
1069
1071
1069
1070

1087
1066
1066
1026
1074
1066
1074
1066
1088
D 1092
1091
1097
1098
1097
1089
1004
1090
G
G
F
F
1092
1096
1095
1095
1096
1094
1093
1094

98
16,38
4
94
89
6
99
100

1067
1026
1068
1067

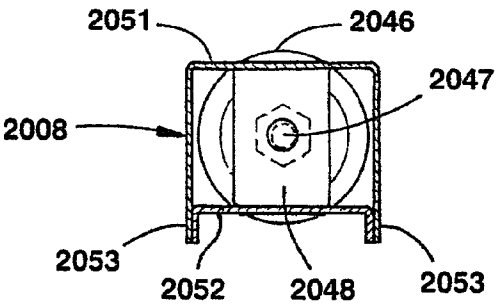
Fig. 84
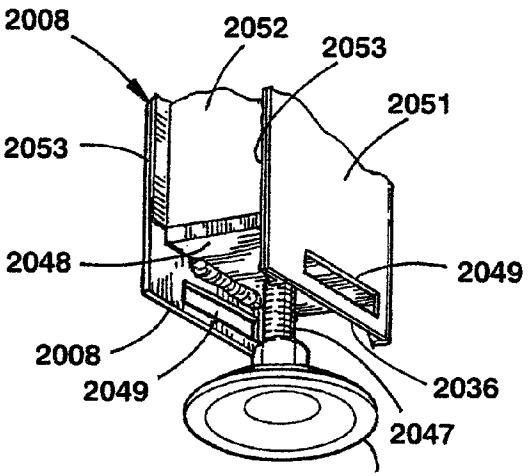
Fig. 85
Fig. 83
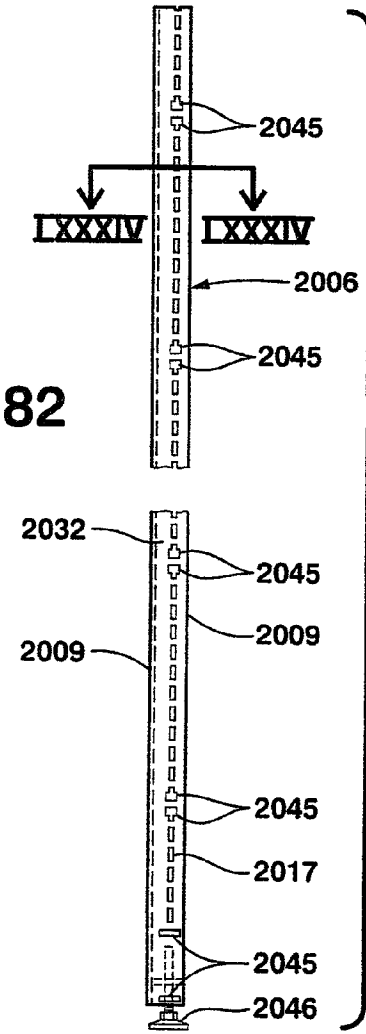
Fig. 82
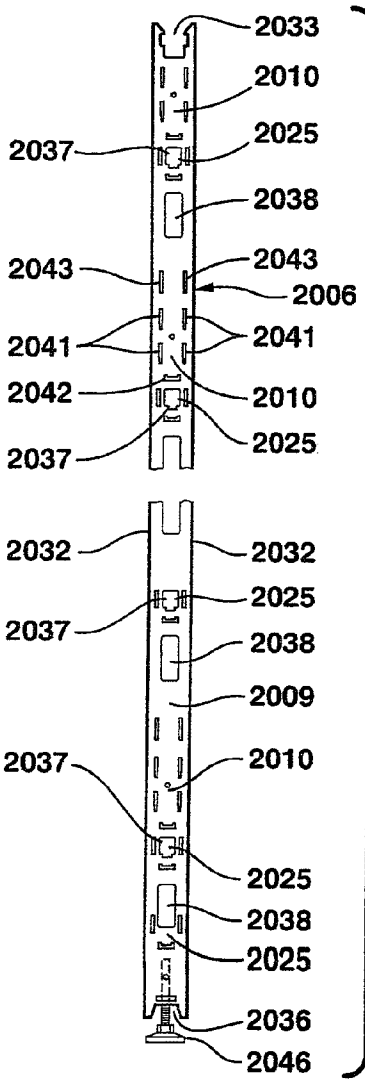

KNOCK-DOWN PORTABLE PARTITION SYSTEM

CROSS-REFERENCES TO RELATED APPLICATIONS

This application is a continuation of U.S. patent application Ser. No. 11/044,843, filed on Jan. 27, 2005, entitled KNOCK-DOWN PORTABLE PARTITION SYSTEM, which is a continuation of U.S. application Ser. No. 10/179,607 filed Jun. 25, 2002 now U.S. Pat. No. 6,910,306, which is a Continuation-In-Part of U.S. application Ser. No. 09/829,028 filed Apr. 9, 2001 now U.S. Pat. No. 6,442,909, which is a continuation of U.S. application Ser. No. 09/407,520 filed Sep. 28, 1999 now U.S. Pat. No. 6,301,846.

U.S. application Ser. No. 09/407,520 filed Sep. 28, 1999 now U.S. Pat. No. 6,301,846 is a Continuation-In-Part of U.S. application Ser. No. 08/914,664 filed Aug. 19, 1997 now U.S. Pat. No. 6,009,675, which claims the benefit of U.S. Provisional Application No. 60/033,884, filed Dec. 24, 1996.

U.S. application Ser. No. 09/407,520 filed Sep. 28, 1999 now U.S. Pat. No. 6,301,846 is also a Continuation-In-Part of U.S. application Ser. No. 09/243,915 filed Feb. 3, 1999 now U.S. Pat. No. 6,079,173, which is a continuation of U.S. application Ser. No. 08/856,995 filed May 15, 1997 now U.S. Pat. No. 5,899,035.

U.S. application Ser. No. 10/179,607 filed Jun. 25, 2002 now U.S. Pat. No. 6,910,306 is also a Continuation-In-Part of U.S. application Ser. No. 09/827,153 filed Apr. 5, 2001 now U.S. Pat. No. 6,546,684, which is a continuation of U.S. application Ser. No. 09/558,753 filed Apr. 21, 2000 now U.S. Pat. No. 6,276,103, which is a division of U.S. application Ser. No. 09/060,913 filed Apr. 15, 1998 now U.S. Pat. No. 6,098,358. The present application is also related to commonly assigned, U.S. Pat. No. 6,178,702, entitled FLEXIBLE LIGHT SEAL FOR PARTITION SYSTEMS. All of the above-identified applications and patents are hereby incorporated by reference.

BACKGROUND OF THE INVENTION

The present invention relates to office partition panel systems, and in particular to a knock-down portable partition that has a unique post and beam construction configured for quick and easy on-site manual assembly without tools.

The efficient use of building floor space is an ever growing concern, particularly as building costs continue to escalate. Open office plans have been developed to reduce overall officing costs, and generally incorporate large, open floor spaces in buildings that are equipped with modular furniture systems which are readily reconfigurable to accommodate the ever changing needs of a specific user, as well as the divergent requirements of different tenants. One arrangement commonly used for furnishing open plans includes movable or portable partition panels that are detachably interconnected to partition off the open spaces into individual workstations and/or offices. Such partition panels are configured to receive hang-on furniture units, such as worksurfaces, overhead cabinets, shelves, etc., and are generally known in the office furniture industry as "systems furniture".

Numerous partition panel systems have been developed for dividing office workspaces into smaller areas. Partition panel systems, like those disclosed in U.S. Pat. No. 4,996,811, utilize prefabricated rectangular partition panel members that have a unitary rigid perimeter frame with decorative cover panels fastened opposite sides thereof. Each perimeter frame member has a rectangular shape, and is fabricated and shipped as a single unit, often with the decorative cover panels pre-fastened to the frame. During installation, the prefabricated perimeter frame of each panel member is fastened to the perimeter frame of an adjacent panel member along the vertical edges thereof, either directly, or by a separate fastener post. Each partition panel member includes two height adjustable feet or glides along the bottom edge of each panel member, with one glide being located adjacent each vertical panel edge. Since there are two vertical frame members at each panel joint, this type of panel construction results in structural redundancy. In addition, since each glide must be properly adjusted for height, this configuration requires adjustment of both glides at each panel joint during assembly. Furthermore, although longer panels typically have a lower cost per unit length, longer panels are difficult to handle, which places a practical limit on the size of the partition panel member that can be shipped and installed as a prefabricated unit.

Other partition panel systems, like that disclosed in U.S. Pat. No. 5,150,554, utilize prefabricated rectangular partition panel members having a unitary perimeter frame that attaches to a post member along each vertical panel edge. Although this type of design may have a single glide at each post, each panel-to-post connection has at least two vertical structural members. Since only a single vertical member is needed to provide support and height adjustment, this type of system has redundant structure. In addition, the rectangular partition panel members are manufactured and shipped as a unit, limiting the size of the partition panel members that can be used.

Other office divider systems, like that disclosed in U.S. Pat. No. 5,406,760, utilize vertical posts and horizontal beams wherein each post attaches to an adjacent post along adjacent vertical edges. Since each post is attached directly to an adjacent post, this configuration also has redundant vertical structural members and glides.

Other office panel dividers, like that disclosed in U.S. Pat. Nos. 5,287,666 and 5,219,406, have multiple posts and beams with connector members that hold a pair of beams to adjacent posts. This configuration has two horizontal beams in a side-by-side relationship at each height location, and also has two vertical posts attached directly together in either a back-to-back or side-by-side relationship. Thus, there is redundancy in both the post and the beam structures. In addition, connector pieces are required to attach the beams to the posts.

SUMMARY OF THE INVENTION

A knock-down portable partition system has cover panels supported on a post and beam framework designed for quick and easy on-site manual assembly. The framework includes at least two vertical posts and at least two structural beams rigidly, yet detachably interconnecting the vertical posts. Connectors secure the beams to the posts, such that the partition system can be assembled and disassembled manually. The partition system may include utility troughs shaped to retain wires, cabling, etc. therein to provide power and/or communication to the system. The utility troughs have opposite ends shaped to be detachably mounted to the posts.

These and other features, objects and advantages of the present invention will become apparent upon reading the following description thereof together with reference to the accompanying drawings.

BRIEF DESCRIPTION OF THE DRAWINGS

FIG. 33 is a fragmentary, cross-sectional, top plan view of an L-post and trim strip, showing the vertical raceway;

FIG. 34 is a fragmentary, horizontal cross-sectional view of an L-post and trim strip, showing a vertical raceway;

FIG. 35 is a fragmentary, horizontal cross-sectional view of an X-post, showing vertical cable channels;

FIG. 48 is a fragmentary, front elevational view of the vertical post;

FIG. 49 is a fragmentary, side elevational view of the vertical post;

FIG. 50 is a top plan view of the vertical post;

FIG. 51 is a fragmentary, perspective view of the bottom end of the vertical post showing the foot;

FIG. 82 is a fragmentary, front elevational view of the vertical post;

FIG. 83 is a fragmentary, side elevational view of the vertical post;

FIG. 84 is a cross-sectional view of the vertical post taken along the line LXXXIV-LXXXIV, FIG. 83;

FIG. 85 is a fragmentary, perspective view of the bottom end of the vertical post showing the foot;

DETAILED DESCRIPTION OF PREFERRED EMBODIMENT

Figure 1:
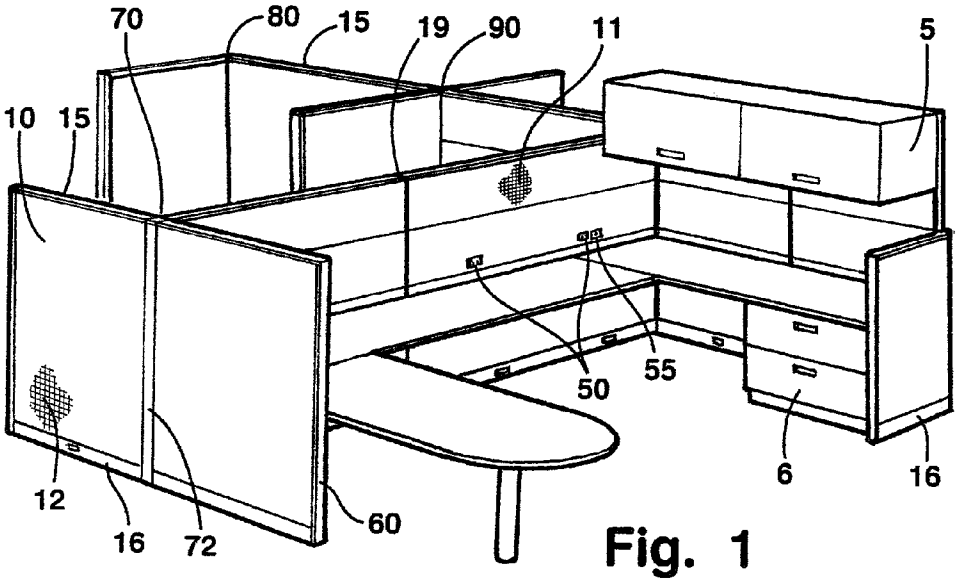
FIG. 1 is a perspective view of a knock-down partition system embodying the present invention, comprising a post and beam construction which is covered by decorative cover panels.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 5:
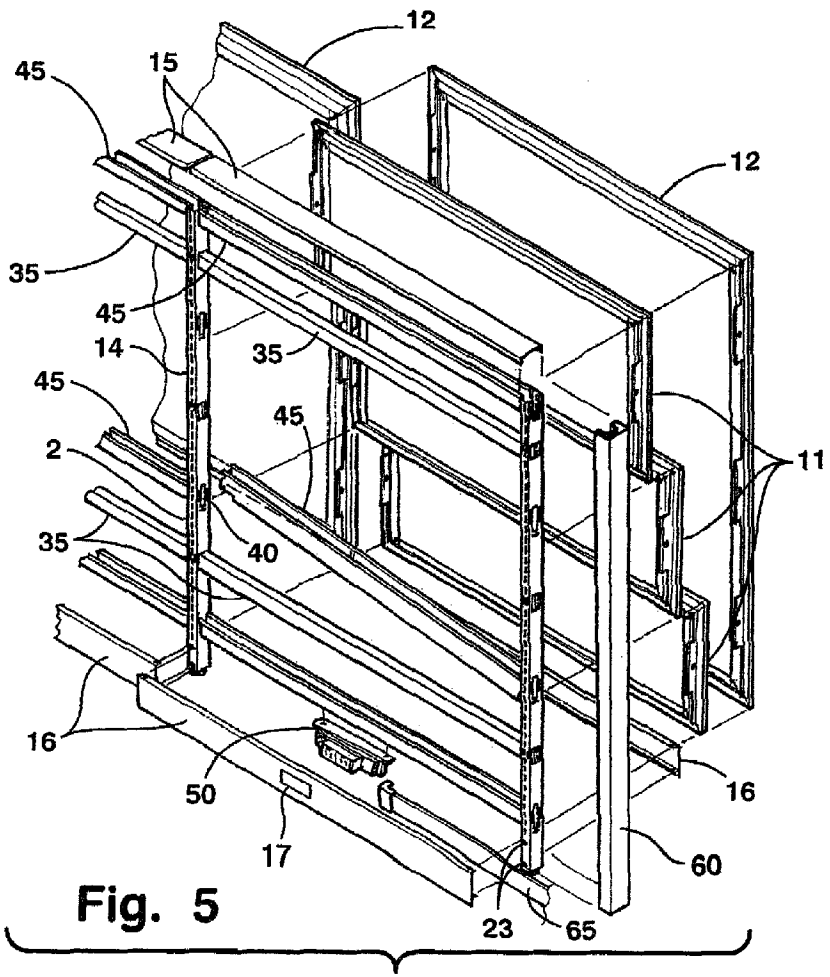
FIG. 5 is a fragmentary, exploded, perspective view of the partition showing the cover panels and trim pieces, and installation of a utility trough.
Figure 16:
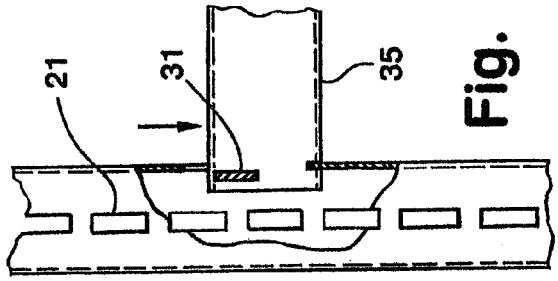
FIG. 16 is a fragmentary, front elevational view of the vertical post with the structural beam in an installed condition.

The reference numeral 1 (FIG. 1) generally designates a knock-down portable partition system embodying the present invention. The illustrated knock-down portable partition system 1 has cover panels 11, 12 supported on a post and beam framework 2 (FIG. 5) designed for quick and easy on-site manual assembly without tools. Framework 2 includes at least two vertical posts 20 with at least two beam connection ports 30 on opposite side faces 14 adjacent upper and lower portions of the posts. Each beam connection port 30 (FIG. 14) has a window 34 through the side face 14 of post 20, and first and second horizontally aligned fastener apertures 32 and 33 in front and rear faces 27 and 28 of the post 20 adjacent opposite sides of the window 34. At least two structural beams 35 rigidly, yet detachably interconnect vertical posts 20 at the upper and lower portions thereof (FIG. 5). Each end of each of the structural beams 35 (FIG. 14) is shaped for close reception in an associated post window 34, and includes a vertically oriented, transverse notch 39 through a lower portion of the beam 35 in which a lower edge of the post window 34 is closely received to longitudinally lock each beam 35 in its associated post 20 (FIG. 16). Each structural beam end also has a third fastener aperture 36 that is spaced from the notch 39, and is horizontally aligned with the two post apertures 32 and 33. Fastener pins 31 (FIG. 13) are closely, yet manually received in the first, second and third fastener apertures 32, 33, and 36 of each of the beam connection ports 30 to positively retain the beams 35 locked in the posts 20, such that the partition system 1 can be completely assembled and disassembled manually without tools. Utility troughs 45 (FIGS. 18-21) shaped to retain wires, cabling, etc. therein have first and second ends 57 and 58 that are shaped to be detachably mounted in horizontally aligned pairs of utility trough ports 40 on the posts 20 while the framework 2 is in its assembled condition (FIG. 5).

Figure 4:
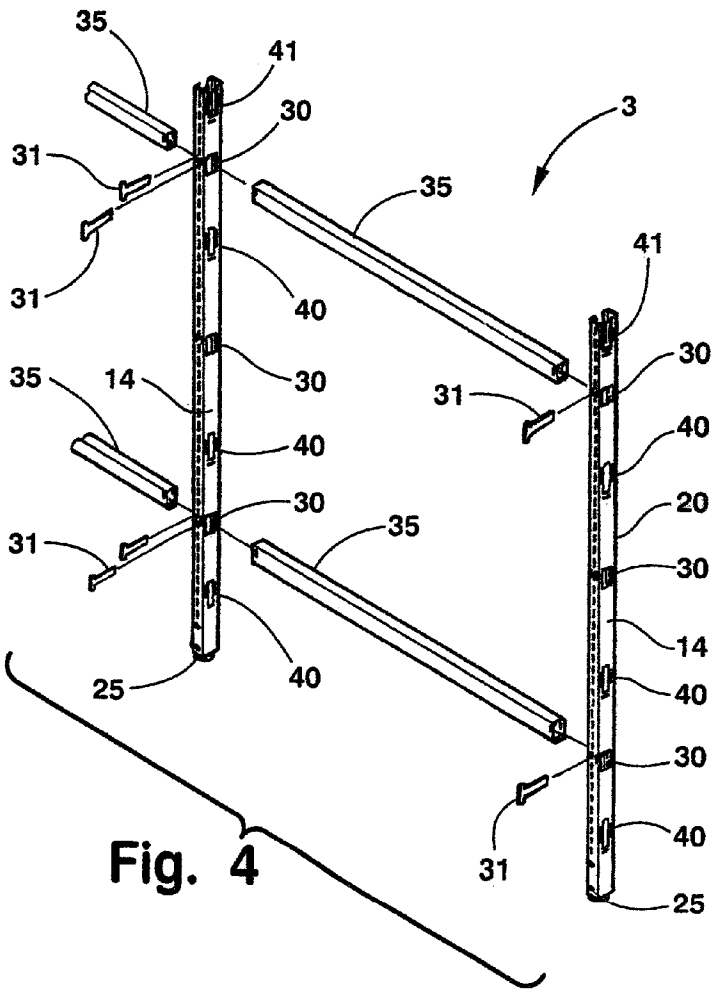
FIG. 4 is a fragmentary, exploded, perspective view of the vertical posts, beams, and pins.
Figure 3:
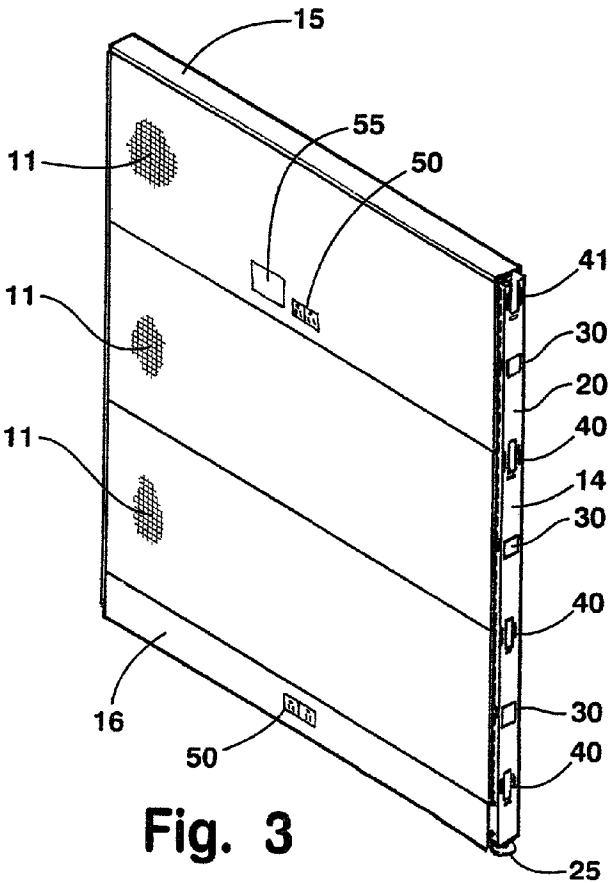
FIG. 3 is a perspective view of an individual panel section.
Figure 7:
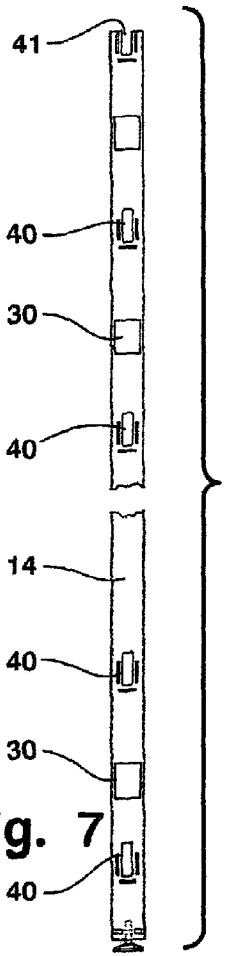
FIG. 7 is a fragmentary, side elevational view of the vertical post.

Four different post configurations are utilized, including an in-line or end-of-run post 20, a T-post 71, L-post 81, and X-post 91. Each of the post configurations has a plurality of beam connection ports 30 and utility trough connection ports 40 located on side faces 14 in a similar arrangement as the vertical post 20 described below. With reference to FIGS. 3-5, each vertical post 20 may be used for an in-line joint 19, or at an end-of-run location, where the vertical post 20 is covered by a vertical trim strip 60. Structural beams 35 are received into structural beam connection ports 30 located on the vertical faces of a pair of vertical posts 20. Pins 31 are received in first, second and third horizontally aligned fastener apertures 32, 33, and 36, rigidly locking the structural beams to the vertical posts 20. Base covers 16 may be made from roll-formed steel sheet, and include retainer tabs 18 which removably retain the base cover 16 in base cover mounting slots 23, located at the lower end of vertical posts 20. Base covers 16 include apertures 17 for receiving electrical receptacles 50. Since each post 20 receives at least two structural beams 35 into the connection ports 30 on both opposite side faces 14 at an in-line joint 19, each panel frame 3 shares a common vertical post 20 with an adjacent panel frame 3. Each panel frame 3 may include either segmented cover panels 11, or a single cover panel 12 to form a panel section 10.

Figure 8:
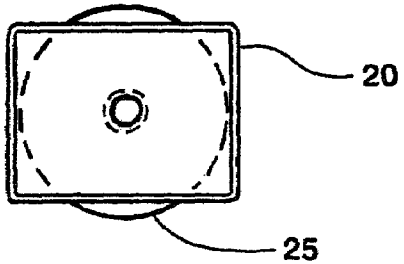
FIG. 8 is a top plan view of the vertical post.
Figure 9:
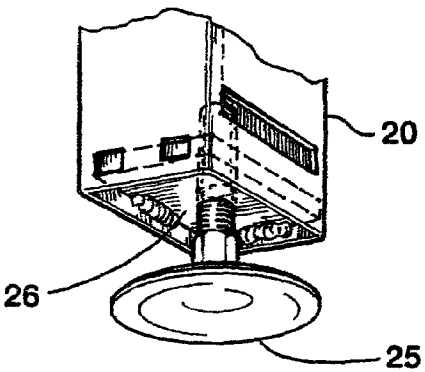
FIG. 9 is a fragmentary, perspective view of a glide.

With reference to FIGS. 6-9, each vertical post 20 has a plurality of structural beam connection ports 30, and a plurality of utility trough connection ports 40 on each opposite side face 14. The upper utility trough 41 is similar to utility trough connection port 40, but includes an open upper edge for laying-in cabling along the upper edge of panel sections 10. First quick-disconnect connectors are formed by a plurality of cover panel mounting slots 22 which are evenly spaced along the front and rear faces 27, 28 of the vertical post 20 near the opposite side faces 14. Base cover mounting slots 23 are located on front and rear faces 27 and 28 near the lower end of vertical posts 20. As shown in FIG. 9, each foot or glide 25 is threadingly received into a glide plate 26. The rectangular glide plate 26 is welded into the lower end of vertical post 20. Each in-line vertical post 20 has a rectangular tubular cross-section as illustrated in FIG. 8.

Figure 10:
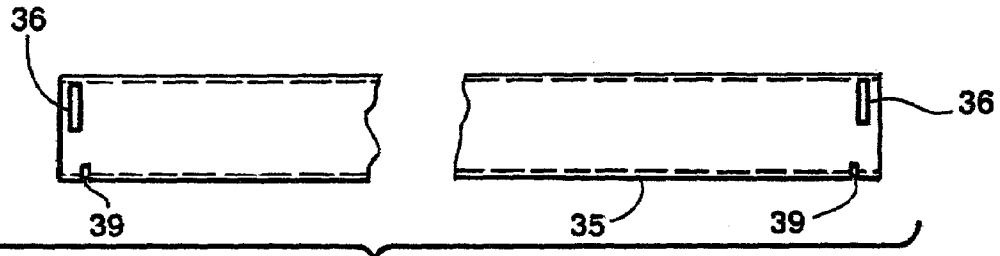
FIG. 10 is a fragmentary, front elevational view of the structural beam.
Figure 11:
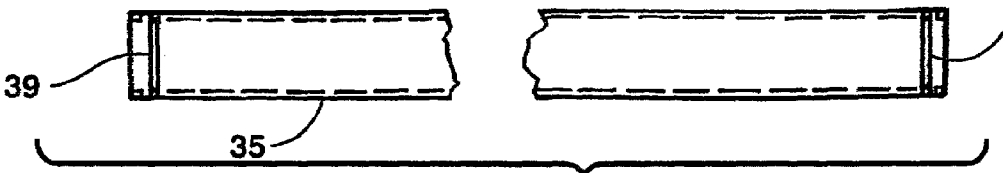
FIG. 11 is a fragmentary, bottom plan view of the structural beam.
Figure 12:
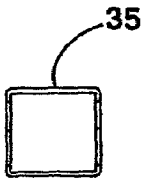
FIG. 12 is a side elevational view of the structural beam.
Figure 14:
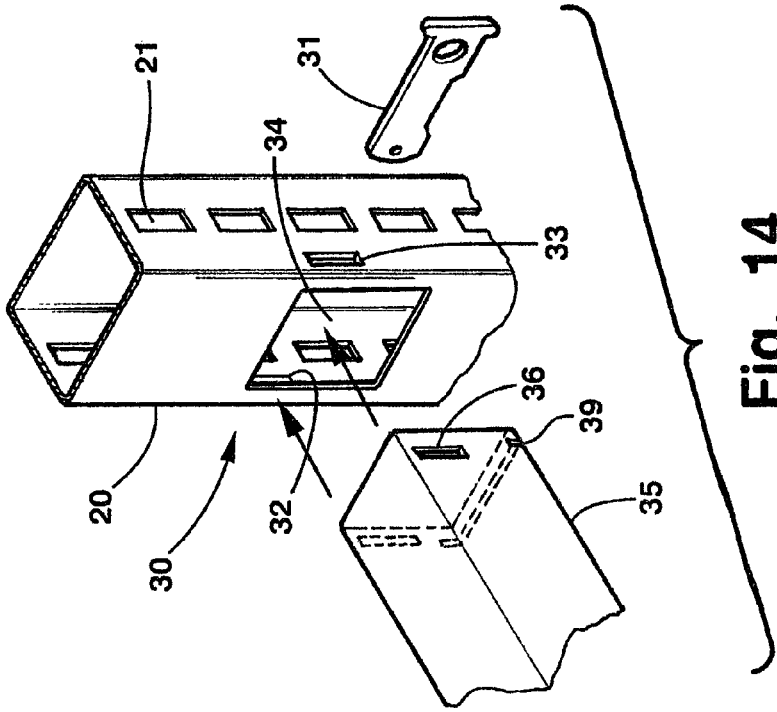
FIG. 14 is a fragmentary, perspective view of the vertical post, structural beam, and pin, showing a structural beam connection port in the vertical post.

With reference to FIGS. 10-12, each structural beam 35 has a square or rectangular tubular cross section and includes a vertically oriented notch 39 extending transversely. A third fastener aperture 36 is located adjacent each end of the structural beam 35. As shown in FIG. 14, each structural beam connection port 30 includes a window 34 defined by an edge having a shape similar to that of structural beams 35 for receiving an end of the structural beams 35. The vertically oriented transverse notch 39 has a width that is approximately equal to the thickness of the wall of the vertical post 20, resulting in a frictional engagement when the notch 39 is engaged on the lower edge of a window 34. Each structural beam connection port 30 includes first and second horizontally aligned fastener apertures 32 and 33 which receive pin 31 when a structural beam 35 is received in the window 34.

Figure 13:
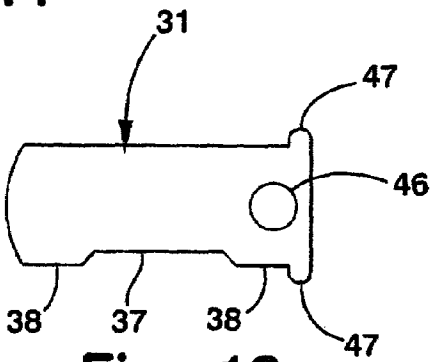
FIG. 13 is a side elevational view of the pin.

Each pin 31 is made from flat metal stock, and has a profile as illustrated in FIG. 13. Contact surfaces 38 engage the upper and lower edges of first, second and third fastener apertures 32, 33 and 36 with a minimal clearance, thereby providing a rigid, secure connection between the structural beam 35 and vertical post 20 and also allowing insertion and removal of the pin 31 without use of tools. Narrow intermediate section 37 provides clearance to facilitate installation of pin 31. Stops 47 contact the front or rear face 27 or 28 of post 20 when the pin 31 is fully engaged. Circular aperture 46 receives a tool such as a screwdriver to aid in the removal of pin 31 if required.

Figure 15:
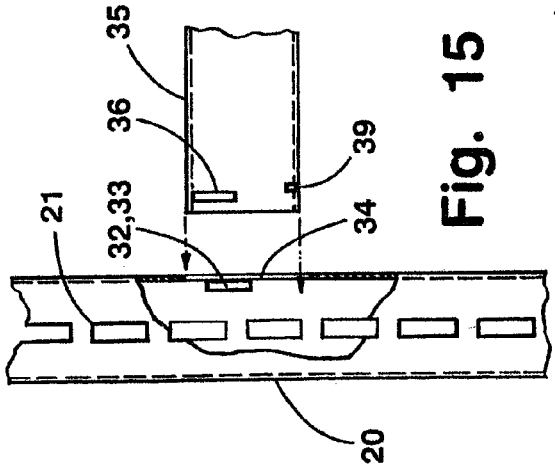
FIG. 15 is a fragmentary, front elevational view of the vertical post and structural beam prior to assembly.
Figure 17:
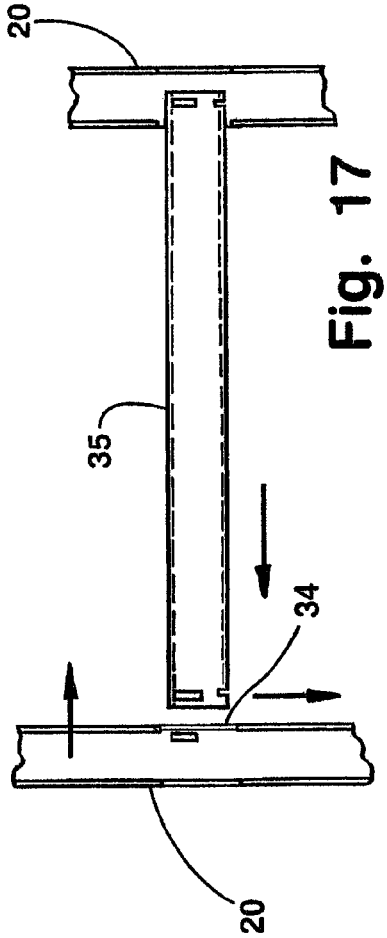
FIG. 17 is a fragmentary, front elevational view of a structural beam during installation to a pair of vertical posts.

As illustrated in FIGS. 15-17, during assembly of the framework 2, each end of a structural beam 35 is inserted into the window 34 of a structural beam connection port 30. The structural beam 35 is then pressed downward to engage the lower edge of window 34 into the vertically oriented transverse notch 39. The first, second and third fastener apertures 32, 33 and 36 are then horizontally aligned, and a pin 31 is inserted through the fastener apertures, thereby securely locking the structural beam to the vertical post. Each vertical post 20 that is used at an in-line joint 19 receives structural beam 35 into each of the opposite faces, such that each adjacent panel frame 3 shares a common vertical post 20.

Figure 18:
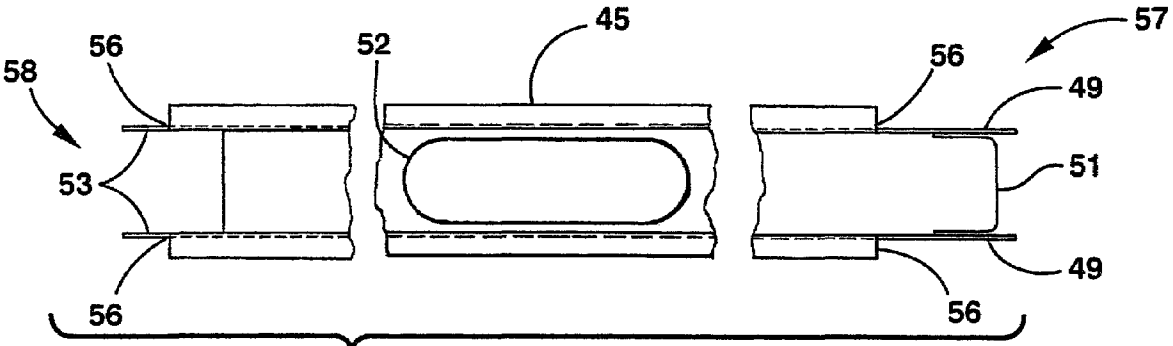
FIG. 18 is a fragmentary, top plan view of the utility trough.
Figure 19:
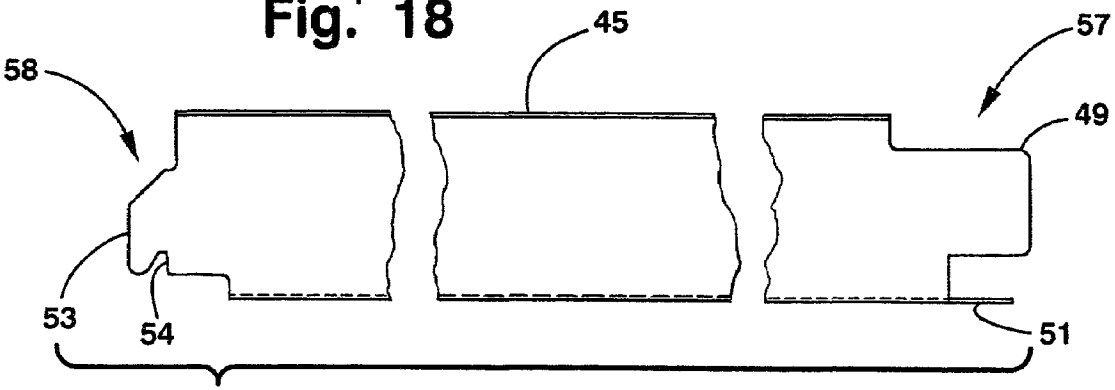
FIG. 19 is a fragmentary, front elevational view of the utility trough.
Figure 20:
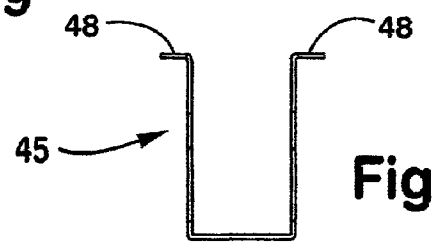
FIG. 20 is a side elevational view of the utility trough.
Figure 24:
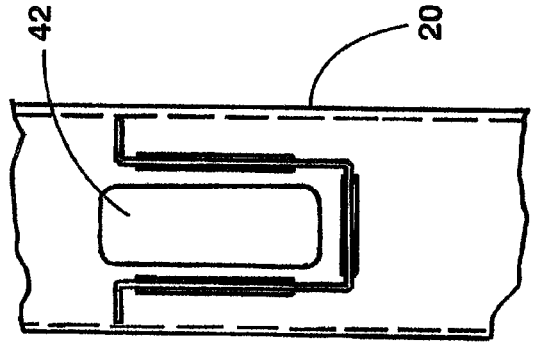
FIG. 24 is a fragmentary, side elevational view showing the utility trough in an installed condition.
Figure 23:
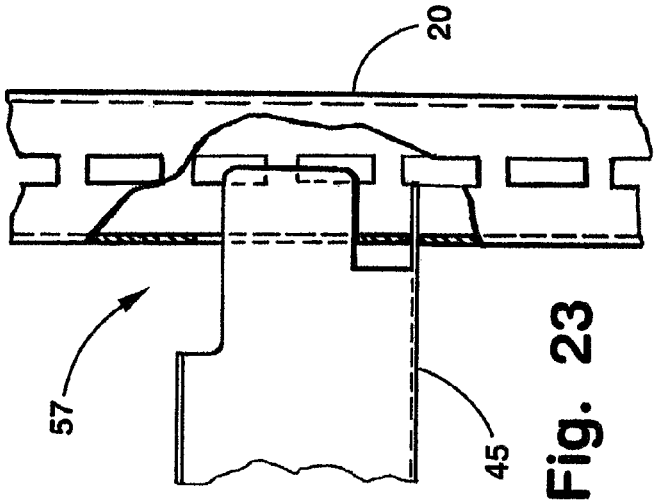
FIG. 23 is a fragmentary, front elevational view of the vertical post with a first end of the utility trough in an installed condition.
Figure 22:
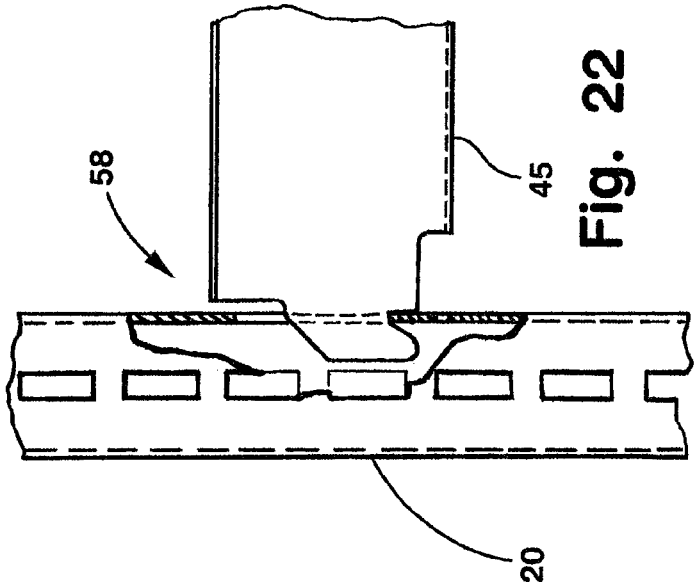
FIG. 22 is a fragmentary, front elevational view of a vertical post and a second end of the utility trough in an installed condition.
Figure 25:
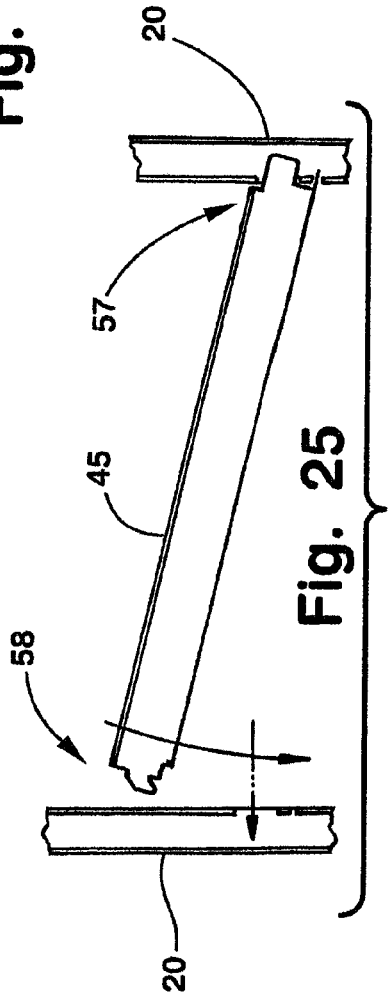
FIG. 25 is a fragmentary, front elevational view showing the installation of a utility trough between a pair of the vertical posts.

As shown in FIGS. 18-20, each utility trough 45 may be roll-formed from a pre-coated roll of steel and has an inverted U-shaped cross section that extends substantially uninterrupted between a pair of posts 20. Each utility trough 45 includes horizontal flanges 48 along the upper edge. The horizontal flanges 48 are configured to provide support for a cover panel 11 or 12, and have a cutout portion 56 near each end of the utility trough 45 to provide clearance for the frame 100 of cover panel 11 or 12. Vertical tabs 49 and horizontal tab 51 are located at a first end 57 of the utility trough 45. Hook-shaped tabs 53 are located at a second end 58 of utility trough 45, and define a tapered, vertically-oriented slot 54.

Figure 21:
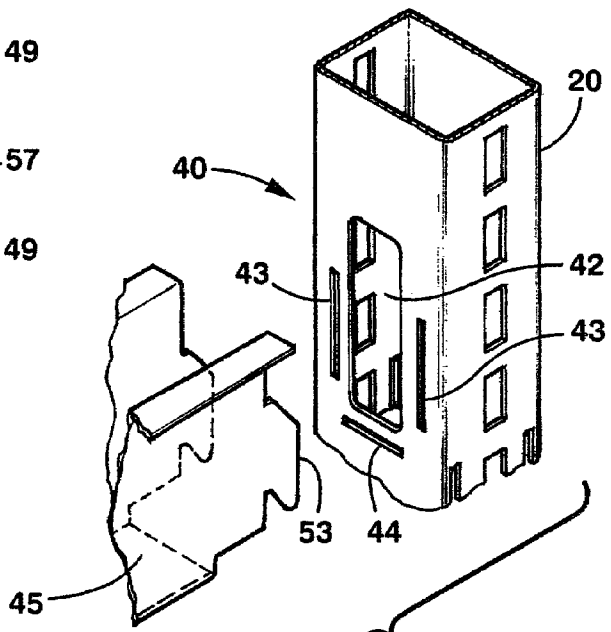
FIG. 21 is a fragmentary, perspective view of the vertical post and utility trough in an unassembled condition, showing the utility trough connection port.

With reference to FIG. 21, each utility trough connection port 40 includes a window 42 for passing electrical or communications conduit through the vertical post 20. A pair of vertically-oriented slots 43 receive the vertical tabs 49 or hook-shaped tabs 53 of a utility trough 45. Each utility trough connection port 40 also includes a horizontally oriented slot 44 that receives horizontal tab 51 when the first end 57 of a utility trough 45 is inserted.

Utility troughs 45 are installed after the framework 2 is assembled from posts 20 and beams 35. As illustrated in FIGS. 22-25, during installation the first end 57 of utility trough 45 is slid into the vertical slots 43 and horizontal slot 44 of a utility trough connection port 40. The second end 58 of utility trough 45 is then rotated downward to partially engage hook-shaped tabs 53 into slots 43 and shifted in a horizontal direction to engage the tapered, vertically oriented slots 54 into the bottom edge of vertically oriented slots 43. In a similar manner, utility trough 45 may be removed from a pair of vertical posts 20 after the framework 2 has been assembled. When in an installed condition, utility troughs 45 are aligned with the windows 42 in vertical post 20 to allow electrical or communications cabling to pass therethrough.

Figure 26:
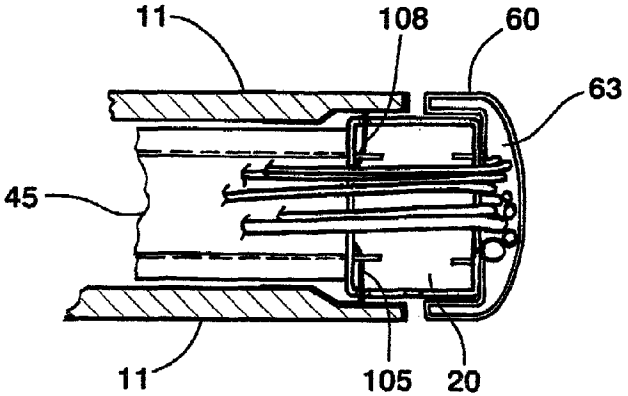
FIG. 26 is a fragmentary, horizontal cross-sectional view of an end-of-run post and vertical trim strip.
Figure 29:
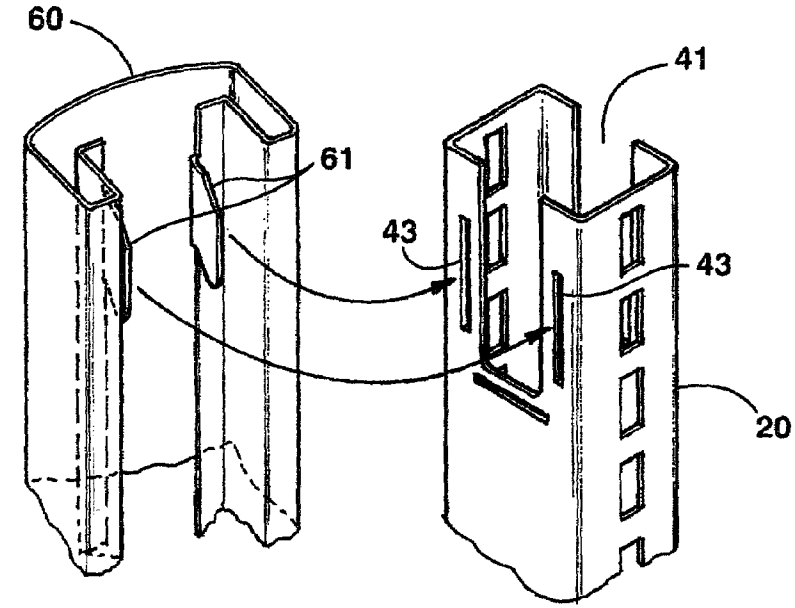
FIG. 29 is a fragmentary, perspective view of the end-of-run post and vertical trim strip.

As illustrated in FIGS. 26 and 29, at an end-of-run location, a vertical post 20 receives a vertical trim strip 60. Trim strip 60 includes hooks 61 which are received in vertical slots 43 of a utility trough connection port 40 or 41. Vertical trim strip 60 extends away from vertical post 20 to provide an external vertical raceway 63 for laying-in of wires along an outer face of the vertical post 20.

Figure 28:
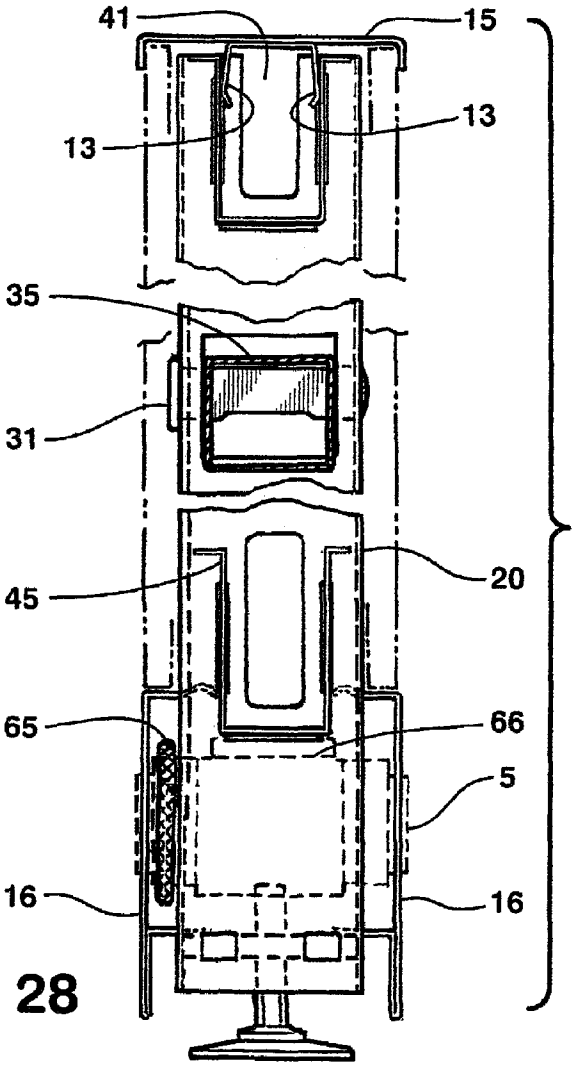
FIG. 28 is a fragmentary, vertical cross-sectional view of a wall panel showing flat electrical cables running between the front face of a vertical post and the base cover.

As illustrated in FIG. 28, bracket 66 retains electrical receptacle 50 to the under side of a utility trough 45 located adjacent the lower edge of a panel section 10. Flat electrical cable 65 runs along the base of panel sections 10, and passes over a front or rear face 27 or 28 of a vertical post 20, and is covered by base covers 16.

Figure 27:
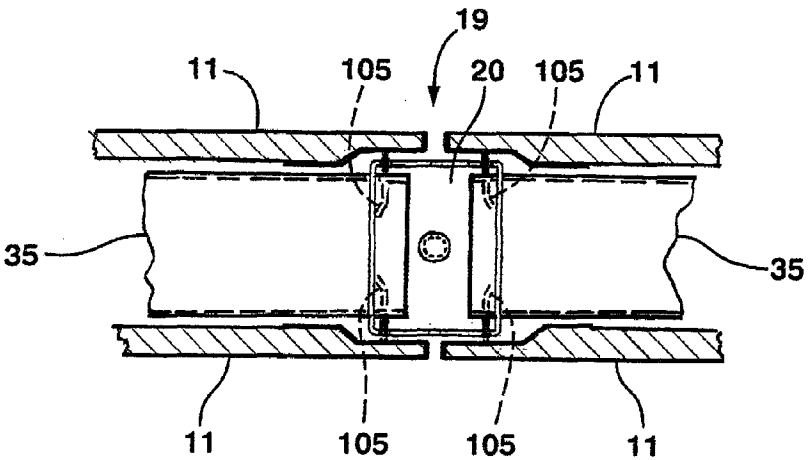
FIG. 27 is a fragmentary, horizontal cross-sectional view of an in-line vertical post with structural beams and cover panels from adjacent panel sections connected to the vertical post.
Figure 30:
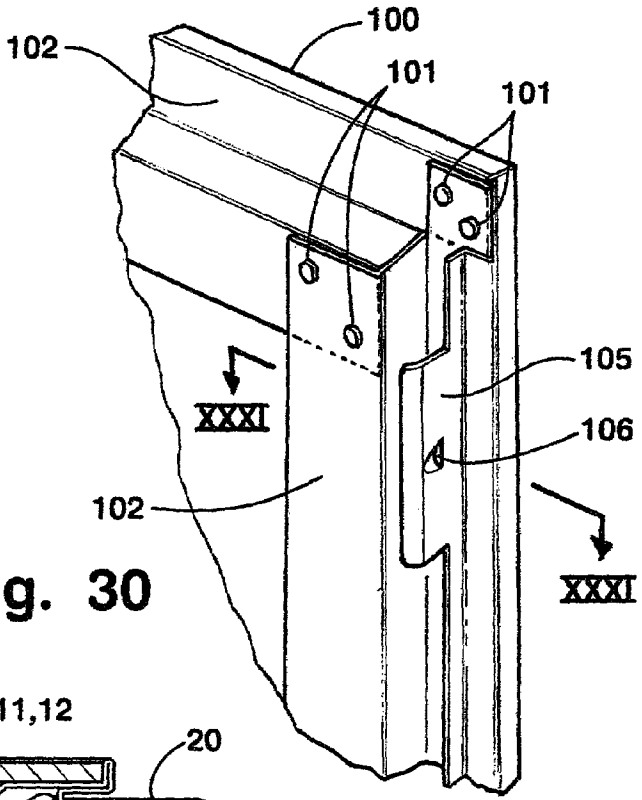
FIG. 30 is a fragmentary, perspective view of a cover panel showing the cover panel retainer tabs.
Figure 31:
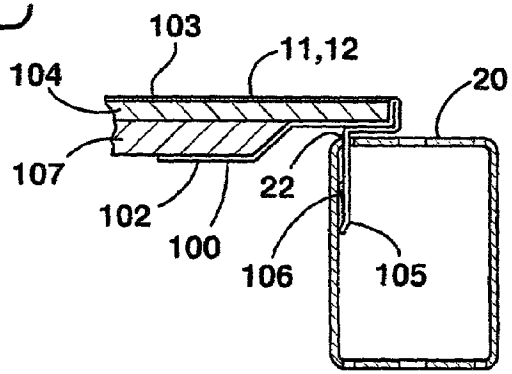
FIG. 31 is a fragmentary, cross-sectional view of the cover panel and vertical post, taken along the line XXXI-XXXI, FIG. 30.
Figure 32:
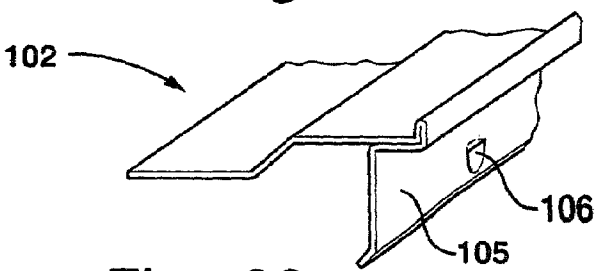
FIG. 32 is a fragmentary, horizontal cross-sectional view of the cover panel frame channel, taken along the line XXXI-XXXI, FIG. 30, shown mounted on a vertical post.

As illustrated in FIGS. 30-32, a frame 100 of cover panel 11 or 12 includes cover panel retainer tabs 105. Each cover panel retainer tab 105 has a lance tab 106 which engages the inner surface of vertical post 20 when the cover panel retainer tab 105 is inserted into the cover panel mounting slots 22. At each corner of frame 100, the channels 102 are joined with integrated rivets or "toggle locks" 101. The retainer tabs 105 have a cross-sectional shape illustrated in FIG. 31. As illustrated in FIG. 27, each vertical post 20 has two rows of cover panel mounting slots 22 on side faces 14 that receive cover panel retainer tabs 105 of cover panels 11. Each vertical post 20 retains two adjacent edges of two cover panels 11 on each side face 14.

As illustrated in FIGS. 33-35, T-post 71, L-post 81 and X-post 91 are used at T-joints 70, L-joints 80 and X-joints 90, respectively. All of the post configurations have a plurality of structural beam connection ports 30 and a plurality of utility trough connection ports 40 located on side faces 14 in substantially the same configuration as vertical post 20. In addition, each of the post configurations has a plurality of vertical slots 22 for receiving cover panel retainer tabs 105 in substantially the same manner as vertical post 20. All of the post configurations have a cross-sectional shape that receives a single-size glide plate 26 which is welded into a lower end of each post. With reference to FIG. 33, each L-post 81 has an outer chamfered portion 84, and receives an L-post trim strip 82 over the outer chamfered portion 84 to form a vertical raceway 85. The inner and outer chamfered portions 86 and 84, respectively are configured to receive a glide plate 26. The L-post trim strip 82 has hooks 61 which are received in slots 87 on the chamfered portion 84 of L-post 81 to retain the trim strip 82. As illustrated in FIG. 34, each T-post 71 includes a recessed portion 74 which is covered with a T-post trim strip 72, thereby creating a vertical raceway 75 for the laying-in of cabling. The recessed portion 74 is configured to receive a glide plate 26, which is welded into the lower portion of the T-post 71. The T-post trim strip 72 includes hooks 61 which are received in slots 76 in T-post 71. As shown in FIG. 35, X-post 91 has opposing vertical channels 92 which are configured to receive a glide plate 26 at the lower end of X-post 91. Cables may be laid into vertical channels 92. Each post configuration includes base cover mounting slots 23 adjacent to receive retainer tabs 18 of base covers 16.

Figure 36:
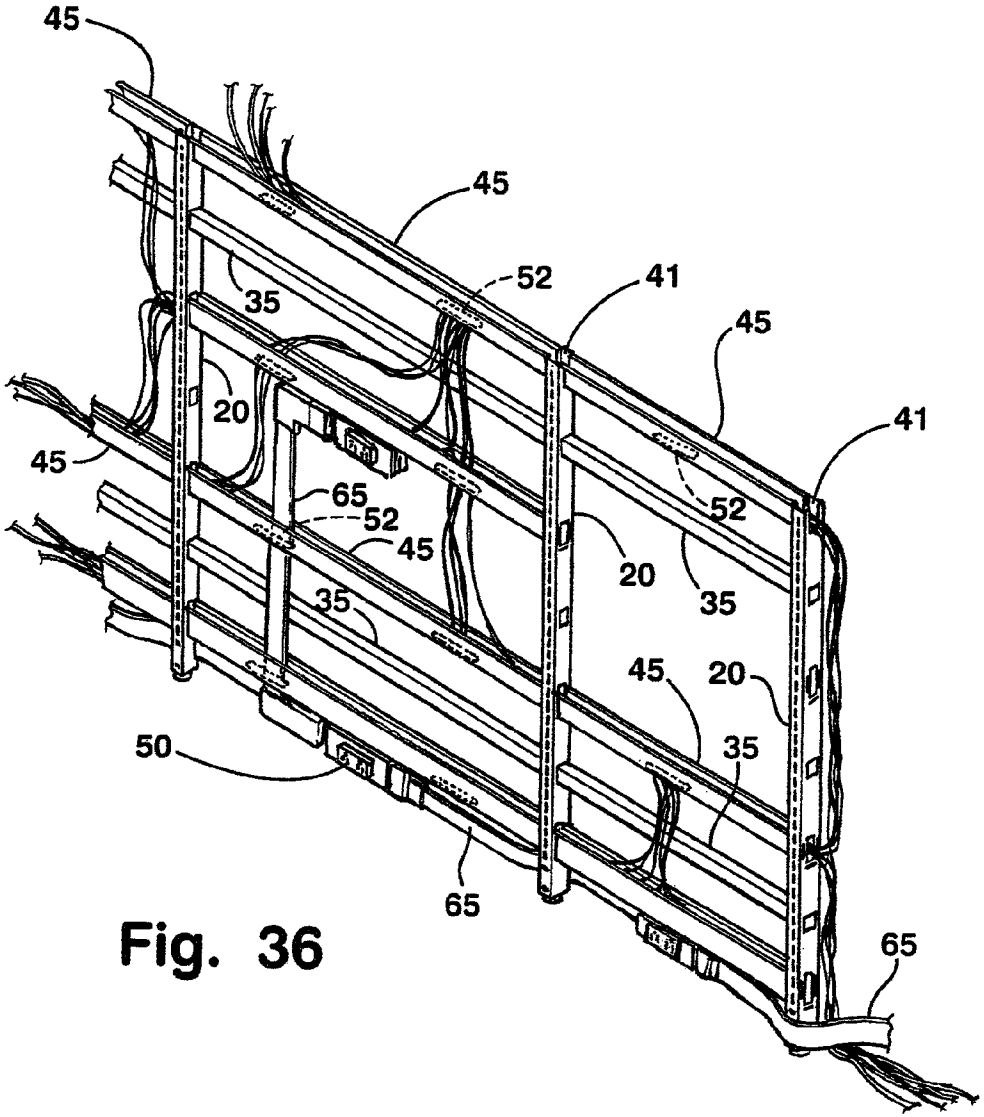
FIG. 36 is a fragmentary, perspective view of the post and beam framework with utility troughs and wiring installed.

As illustrated in FIG. 36, a utility trough 45 may be installed in various utility trough connection ports 40 or 41 to provide electrical and communication cabling at the desired heights. Utility troughs 45 can be quickly and easily removed or installed to reconfigure the cabling as required. Apertures 52 in utility troughs 45 allow the electrical and/or communications cabling to be run vertically in the open interior of a panel section 10. The upper utility connection ports 41 facilitate laying-in of communication and/or electrical cabling along the top edge of the partition system 1. The vertical trim strips 60, 72 and 82, allow for vertical cabling external of a vertical post 20, T-post 71, or L-post 81, respectively.

Figure 37:
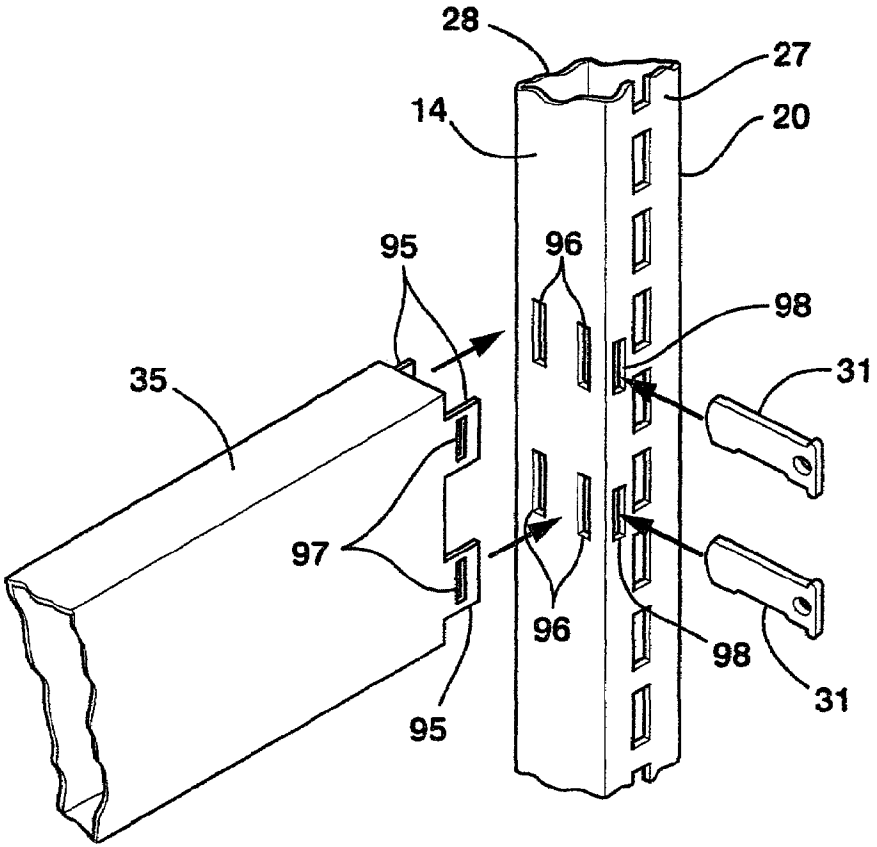
FIG. 37 is a fragmentary, perspective view of an alternative structural beam, vertical post, and associated structural beam connection port.

An alternative embodiment of the structural beam and structural beam connection port is illustrated in FIG. 37. In this embodiment, each structural beam connection port 30 includes two pairs of structural connector slots 96 on a side face 14 of a vertical post 20, and first and second pairs of fastener apertures 98 positioned adjacent opposite sides of each of the slots 96 in front and rear faces 27 and 28 of the post 20. Each end of each structural beam 35 has two pairs of structural connector tabs 95. Each structural connector tab 95 has a third pair of fastener apertures 97, which are aligned with a corresponding pair of second fastener apertures 98, and receive pins 31 to rigidly secure the structural beam 35 to the vertical post 20.

Cover panels 11 and 12 include a glass fiber mat 104 which is covered by a fabric material 103 for decorative purposes (FIG. 31). An acoustical layer 107 of loosely woven synthetic material provides additional insulation. The cover panels 11 and 12 are decorative, non-structural members.

Figure 2:
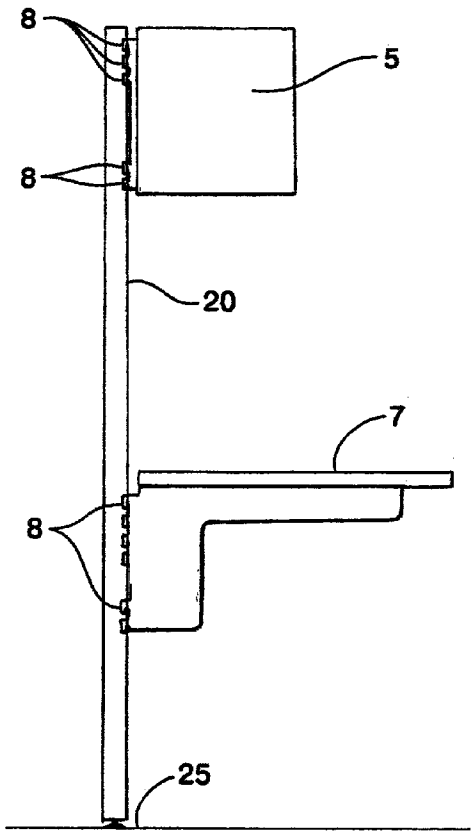
FIG. 2 is a partially schematic side elevational view of the partition system with hang-on bins and worksurfaces installed.
Figure 6:
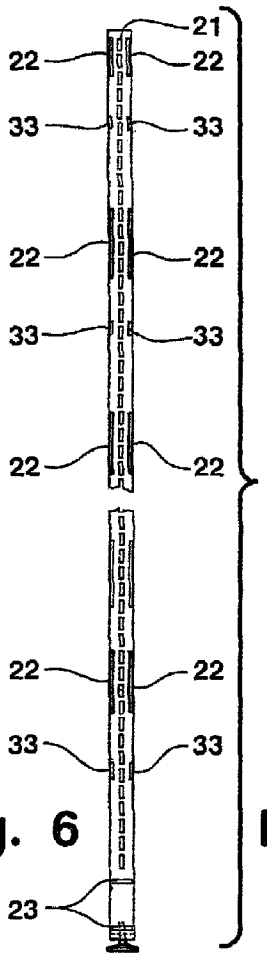
FIG. 6 is a fragmentary, front elevational view of the vertical post.

With reference to FIGS. 1, 2 & 6, each of the vertical post configurations has a row of slots 21 which receive hooks 8 for supporting conventional hang-on items such as overhead bin 5, lower file bin 6, and worksurface 7. This arrangement provides flexibility to install and remove the various hang-on items, and also allows vertical adjustment of the worksurfaces 7.

With reference to FIG. 28, each top trim strip 15 has a pair of retainer tabs 13 which engage the inner surface of a utility trough 45 to removably retain the trim strip 15 along the top edge of the partition panel system 1. Alternately, tabs 13 may be configured to be inserted between a cover panel 11 and the flange 48 of a utility trough 45 to removably retain the trim strip 15 (not shown).

Figure 38:
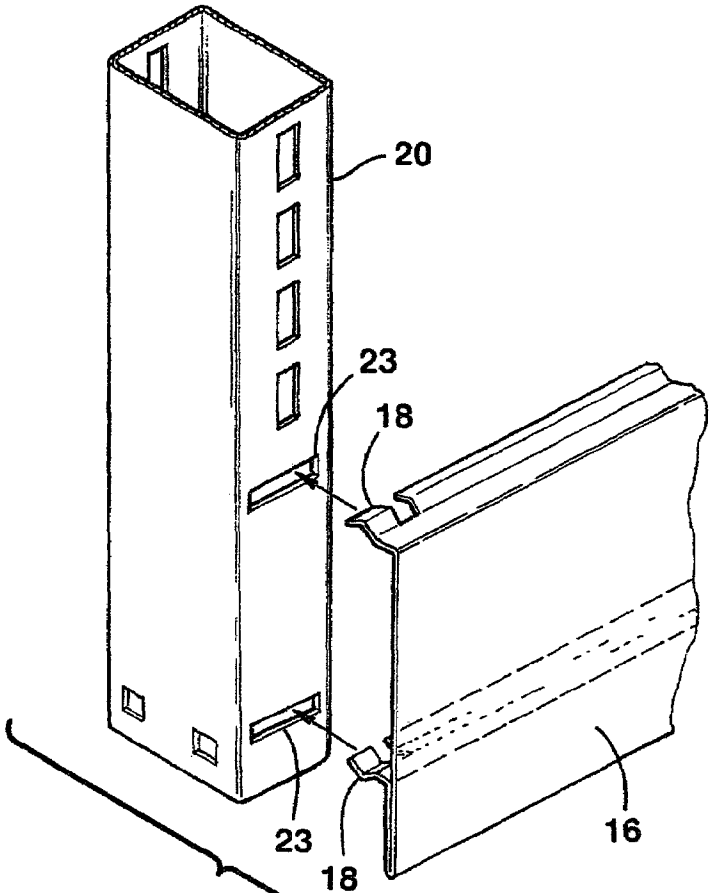
FIG. 38 is a fragmentary, perspective view of a base cover showing the retainer tabs and base cover mounting slots.

As illustrated in FIG. 38, each base cover 16 includes a pair of tabs 18 located at each end thereof. Each tab 18 is received into a base cover mounting slot 23, located adjacent the lower end of a vertical post 20. Each base cover mounting slot 23 receives two retainer tabs 18, one from each adjacent base cover 16.

During assembly of the knock-down portable partition system 1, a pair of structural beams 35 are installed between a pair of vertical posts 20 to form panel frames 3. After the post and beam framework 2 is assembled, the framework 2 is leveled by adjusting glides 25. Alternatively, an L-post 81, or a T-post 71, or an X-post 91 may be used as the first vertical post in the assembly process for stability. After the post and beam framework 2 is assembled, the utility troughs 45 are installed between each adjacent pair of posts at the desired height (FIG. 5). The electrical and communications cabling may then be installed at the desired heights (FIGS. 5, 36). A flat electrical cable 65 and electrical receptacles 50 may be installed to a utility trough 45 located at the base of the framework 2. The electrical receptacles 50 may be mounted to utility troughs 45 utilizing brackets 66 along the base of framework 2. The flat electrical cables 65 are run across the front and/or rear faces of the vertical posts 20 (FIG. 36), and behind base covers 16. The cabling can be routed vertically either between panels through apertures 52 in utility troughs 45, or at a vertical post 20 at an end-of-run location. Alternatively, the electrical and/or communications cabling may be run vertically at an L-post, T-post, or X-post as illustrated in FIGS. 33-35. In addition, cabling may be run vertically through the center of any of the vertical posts if required. Cover panels 11 or 12 are then installed by inserting the tabs 105 into slots 22 in the vertical posts 20. Base covers 16 are then snapped into slots 23 in the vertical posts 20. If desired, knock-outs on the base cover are removed to create apertures 17 which provide clearance for the electrical receptacle 50. The top trim strips 15 and the vertical post trim pieces 60, 72 and 82 may then be installed.

FIGS. 39-72 illustrate a second embodiment of a knock-down portable partition system according to the present invention. The knock-down portable partition system 1001 has a panel frame 1002 (FIGS. 40, 41) with a central portion 1003 generally indicated by the reference numeral 1003 in FIG. 41. At least one cover panel 1004 covers at least a portion of the central portion 1003 of the panel frame 1002. Connectors 1005 detachably mount the cover panel 1004 on the panel frame 1002 to facilitate assembly and removal of the cover panel 1004 on the panel frame 1002. The panel frame 1002 includes at least two vertical junctions such as vertical posts 1006 each having an upper end 1007, a lower end 1008, and opposite faces 1009 with at least two beam connection ports 1010 thereon positioned adjacent the upper and lower ends 1007, 1008 of the associated one of the posts 1006. Upper and lower bars or beams 1011 extend generally horizontally between the vertical posts 1006 adjacent the upper and lower ends 1007, 1008 thereof, and interconnect the same adjacent the connection ports 1010. Movable lock wedges 1012 are positioned on one of the posts 1006 and the beams 1011 adjacent the connection ports 1010, and are movably mounted thereon for shifting between a retracted unlocked position 1013 and an extended locked position 1014. As best seen in FIGS. 42 and 43, wedge-engaging surfaces 1015 are positioned on the other of the posts 1006 and the beams 1011 adjacent the connection ports 1010, and are located thereon to engage the wedges 1012 in a tight interference fit when the wedges 1012 are shifted to the extended locked position to rigidly yet detachably interconnect the posts 1006 and the beams 1011 for quick and complete assembly and disassembly of the knock-down portable partition 1001.

Figure 39:
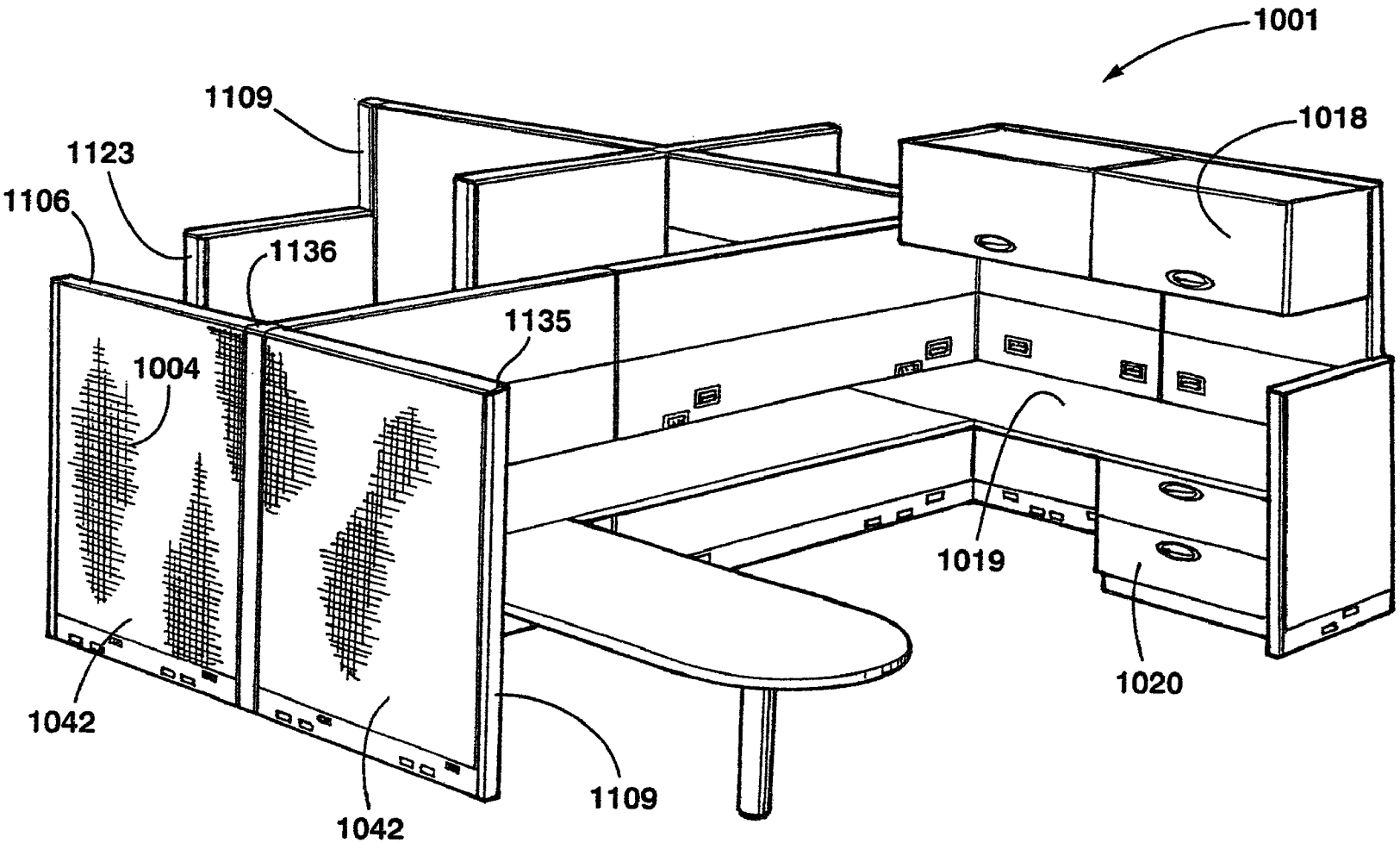
FIG. 39 is a perspective view of a second embodiment of a knock-down partition system according to the present invention.
Figure 45:
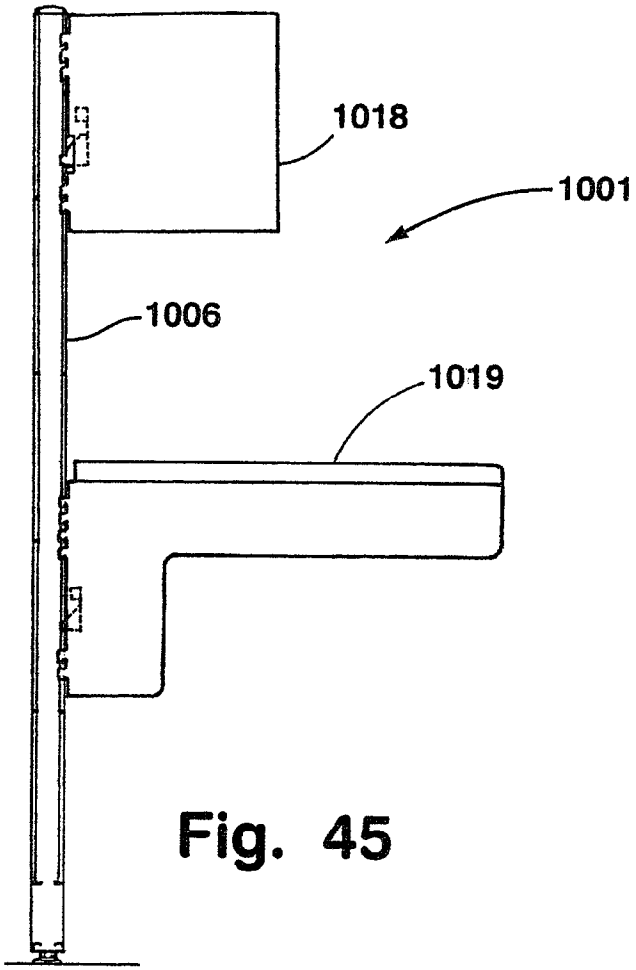
FIG. 45 is a partially schematic side elevational view of the partition system of FIG. 39 with hang-on bins and work surfaces installed.

In the illustrated example, the movable lock wedges 1012 of the present invention form a quick-disconnect connector that engages and inelastically deforms the wedge-engaging surface 1015 when the wedge 1012 is shifted to the extended locked position 1014 to create a tight interference fit which rigidly yet detachably interconnects the post 1006 and the beam 1011 (FIG. 43). In addition, each post 1006 includes a vertical row of slots 1016 extending along a vertical face 1017. With reference to FIGS. 42 and 44, the vertical row of slots 1016 provide for removably attaching a hang-on accessory unit such as a binder bin 1018 or a work surface 1019 (FIG. 45). A lower file storage unit 1020 is also removably supported by the vertical row of slots 1016 in the posts 1006 (FIG. 39). Accordingly, the posts 1006 each have sufficient structural strength to support the hang-on accessory units.

Figure 40:
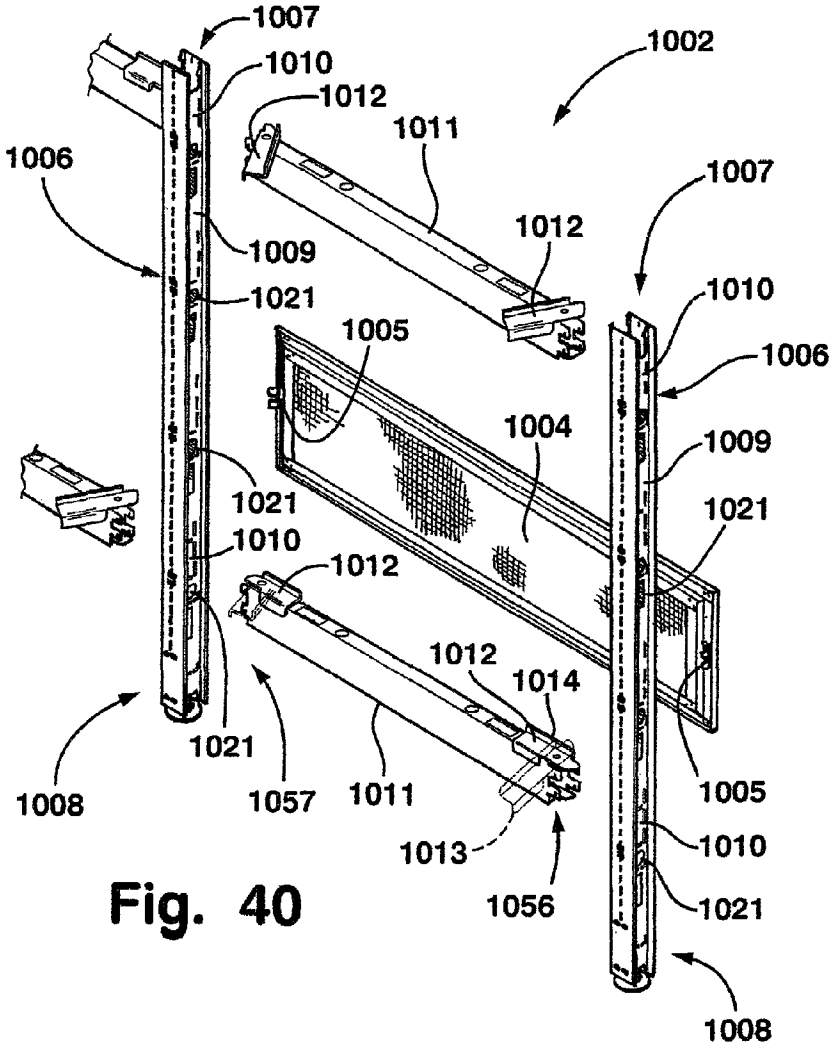
FIG. 40 is a fragmentary, exploded perspective view of the vertical posts, beams, and cover panels of the partition system of FIG. 39.
Figure 41:
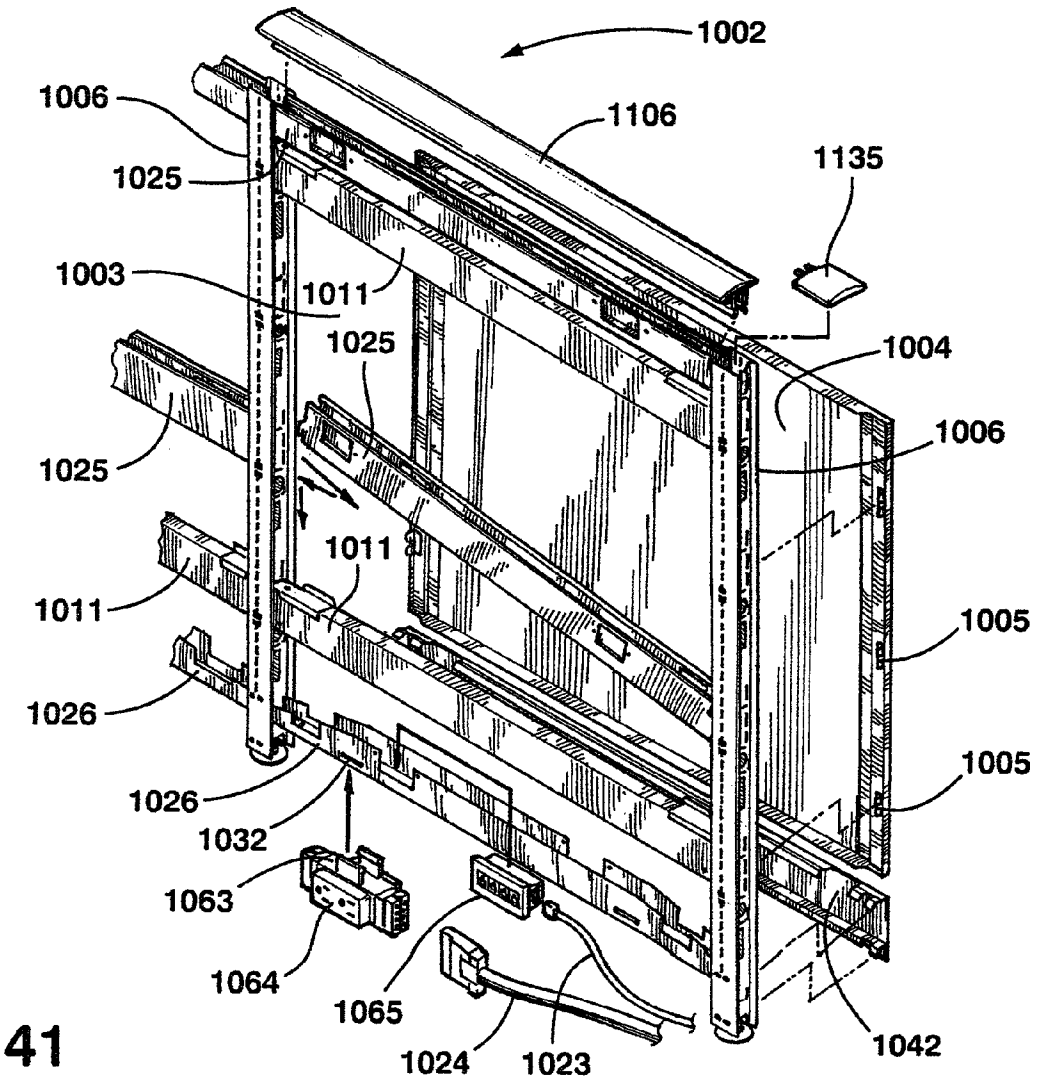
FIG. 41 is a fragmentary, exploded perspective view of the vertical posts, data and power troughs, beams and cover panels.
Figures 42, 43, 44:
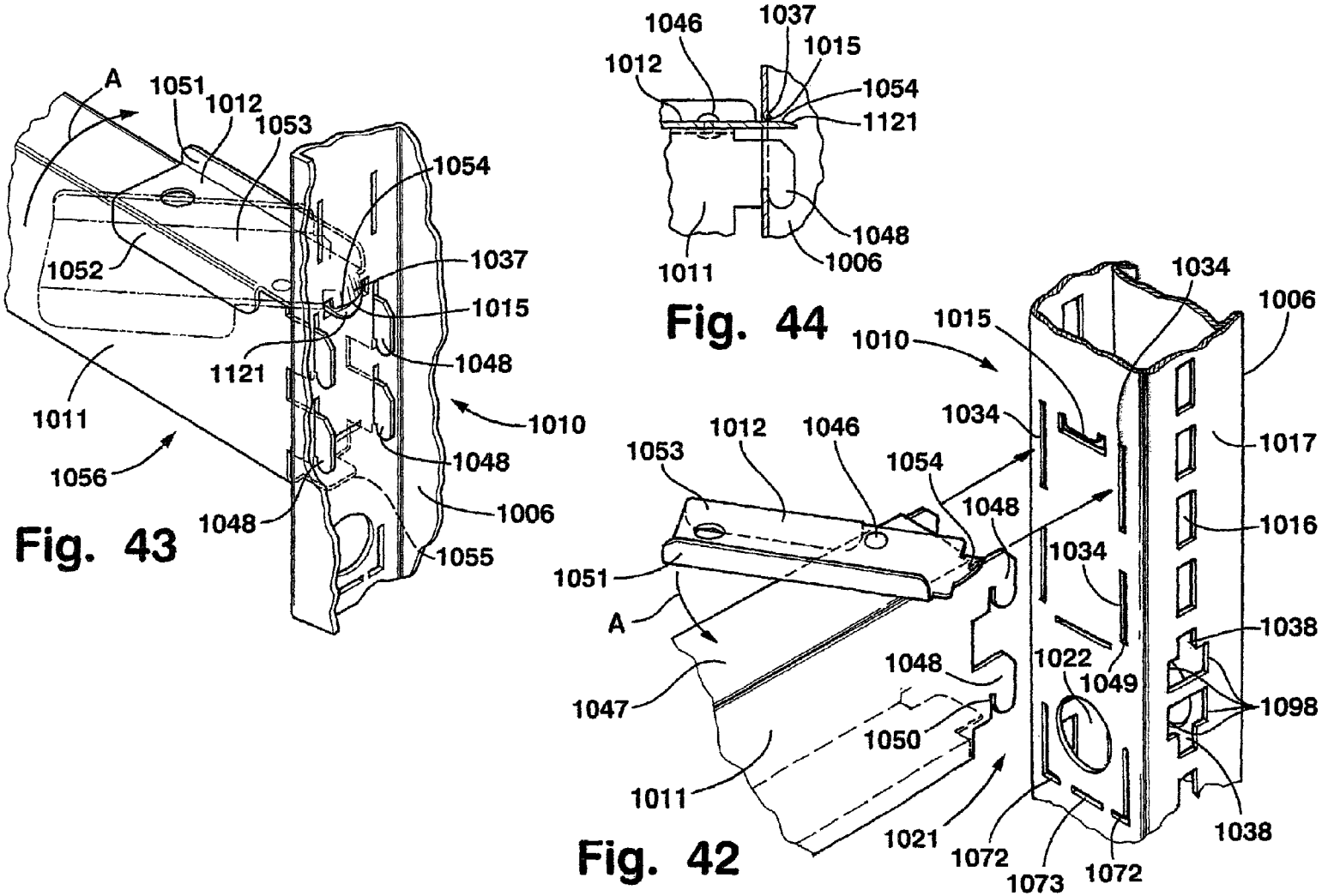
FIG. 42 is a fragmentary, perspective view of the wedge lock and beam connection port.
FIG. 43 is a fragmentary, perspective view of the lock wedge in the engaged position showing the inelastic deformation of the wedge-engaging surface.
FIG. 44 is a fragmentary, front elevational view of the lock wedge in the engaged position showing the deformation of the wedge-engaging surface.

With reference to FIGS. 40-42, each of the vertical posts 1006 include a plurality of utility trough ports 1021 with associated windows 1022 (FIG. 46) through the posts 1006 for passing utility conduits such as data or communications lines 1023 or power lines 1024 therethrough (FIG. 41). The partition includes at least one utility trough such as data trough 1025 or power trough 1026 that are shaped to receive and retain utility conduits therein. The utility troughs have opposite ends thereof configured to be detachably connected with a horizontally aligned pair of utility trough ports 1021 on the posts 1006 when the panel frame 1002 is in an assembled condition.

Figure 47:
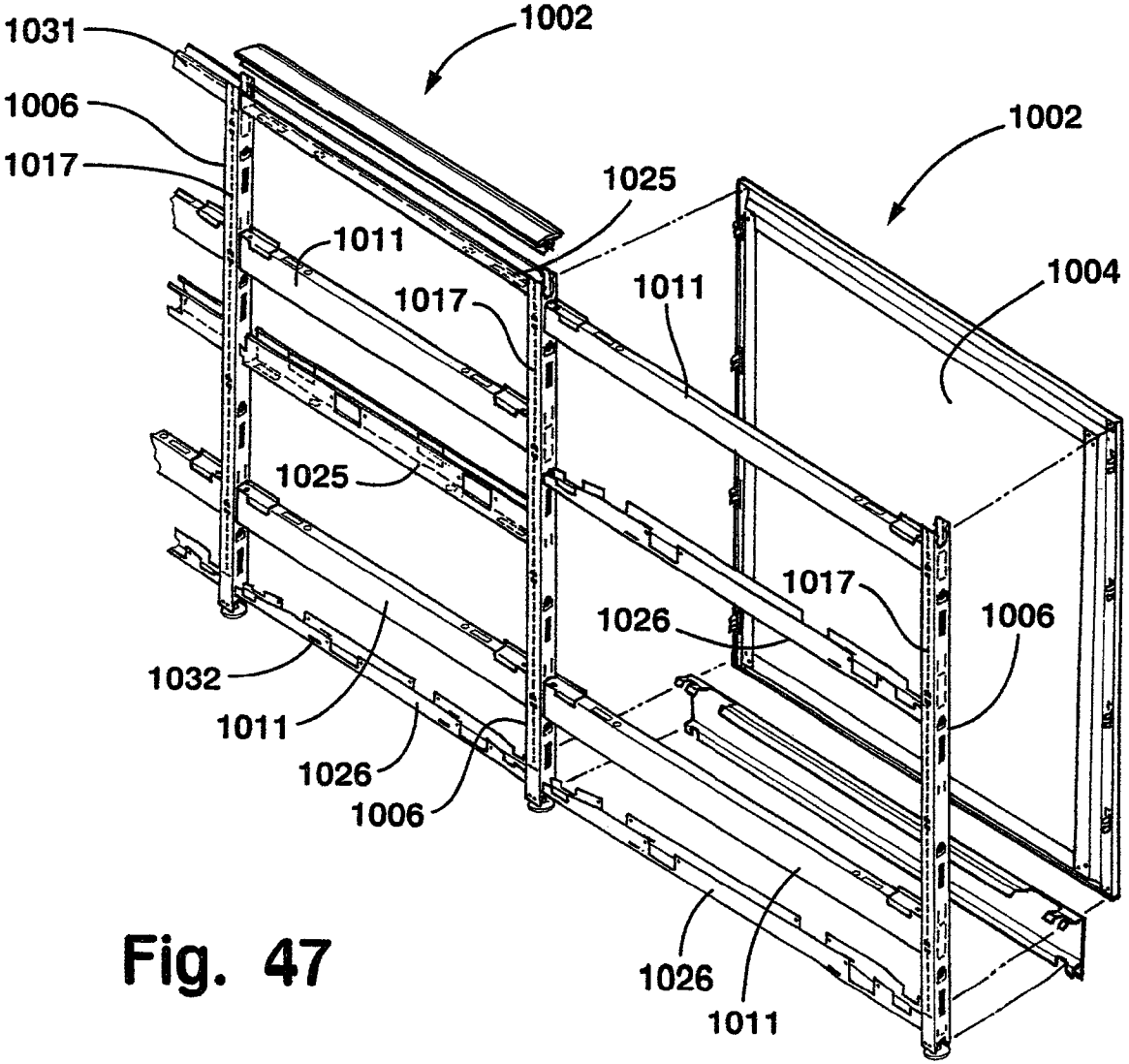
FIG. 47 is a fragmentary, perspective view of two adjacent panel frames showing an intermediate post with beams rigidly connected to both opposite side faces.

As best seen in FIG. 47, two adjacent rigid panel frames 1002 are formed by three vertical posts 1006 and at least four beams 1011 extending generally horizontally between the posts 1006 adjacent the upper and lower ends 1007, 1008 thereof. The beams 1011 provide the primary structural interconnection between the posts 1006, with the cover panels 1004 providing acoustical and decorative functions.

Figure 46:
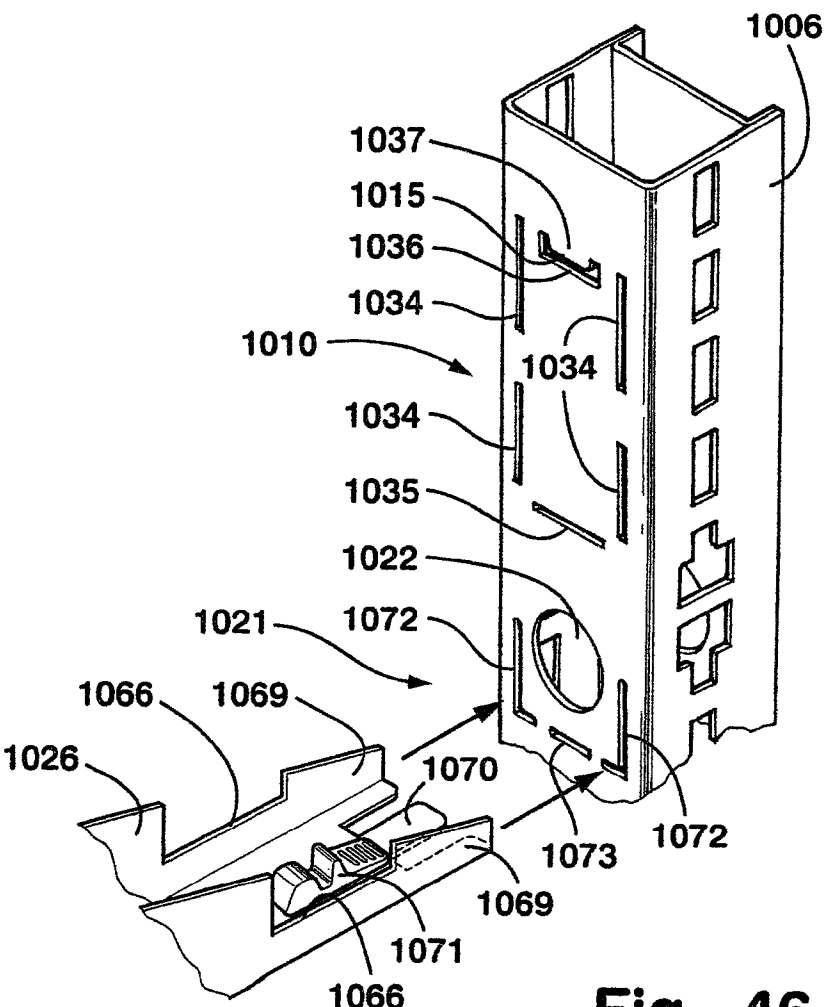
FIG. 46 is a fragmentary, perspective view of the utility trough port and a power trough with sliding wedge.

As shown in FIGS. 48-51, each vertical post 1006 has a pair of opposite faces 1009 and front faces 1027. Each post 1006 includes an upper utility trough port 1029 having a window that is open along the upper side for lay-in of utility conduits such as data lines 1023 along the top edge 1031 of the panel frame 1002. In addition, each post 1006 has a utility trough port 1021 adjacent the lower end, with a window 1030 (FIG. 63) having an open lower edge for lay-in of utility conduits such as power lines 1024 along the bottom edge 1032 of the panel frame 1002 (FIG. 41). Each of the utility trough ports 1021 includes a circular window 1022 and a rectangular window 1033. Data and power lines 1023, 1024 that are routed in the data or power troughs 1025, 1026 may be fed through the windows 1022. If required, power box 1063 may be snapped to the bottom of the power trough 1026 (FIG. 41), and the power line 1024 passed through the rectangular windows 1033. As best seen in FIG. 46, each beam connection port 1010 includes four vertical slots 1034 and a horizontal slot 1035. In addition, a pair of upper slots 1028 (FIG. 48) are located directly above the beam connection ports 1010 for connecting an upper utility trough of a shorter panel frame 1002 at a change of height location. A small window 1036 (FIGS. 42-44) of the beam connection port 1010 includes a downwardly extending tab 1037 having a wedge-engaging surface 1015 along the lower edge thereof. In addition, the front faces 1027 of each post 1006 include apertures 1038 for mounting of the cover panels 1004. Each of the posts 1006 has a single, vertically adjustable foot 1039 which is received in a threaded plate 1040 that is welded to the lower end 1008 of the post. The front faces 1027 also include four apertures 1041 near the lower end 1008 of each post for removably mounting a base cover 1042. Each post 1006 is made from a larger U-shaped piece 1043 and a smaller U-shaped piece 1044, each of which is formed from sheet metal. The larger and smaller U-shaped pieces 1043 and 1044 are welded together at the edge 1045.

With reference to FIGS. 40-44, each beam 1011 has a movable lock wedge 1012 that is rotatably mounted to the upper side 1047 of the beam 1011 by a rivet 1046. The beam 1011 includes four tabs and slots that form downwardly extending hooks 1048 at each end that are received in vertical slots 1034 of the beam connection port 1010. Each hook 1048 forms a slot 1050 that engages the bottom edge 1049 of each vertical slot 1034. The lock wedge 1012 is formed from sheet metal, and includes a flat body portion 1053 that forms a lever arm for mechanical advantage whereby the lock wedges 1012 can be manually shifted from a retracted unlocked position to an extended locked position by a person without the use of tools. An upwardly turned flange 1051 provides a surface for an installer to push against for manually rotating the locking wedge 1012 out of the engaged position in a direction opposite the arrow "A" shown in FIGS. 42 and 43. Each locking wedge 1012 also includes a downward flange 1052 that provides a stop when the locking wedge 1012 is rotated into the extended locked position shown in FIG. 43. Shifting the locking wedge 1012 to the extended locked position inelastically deforms the wedge-engaging surface 1015 of the downwardly extending tab 1037 due to the tight interference fit between the extension 1054 of the locking wedge 1012 and the wedge-engaging surface 1015. The extension 1054 is "coined," or flattened at 1121 to facilitate engagement with the wedge engaging surface 1015. In the illustrated example the wedge-engaging surface 1015 is permanently or inelastically deformed; however, a tight interference fit that does not result in inelastic deformation may also be used to lock the beam 1011 to the post 1006. Alternatively, the locking wedge 1012 could have a tapered cam surface on the extension 1054 to progressively engage the wedge-engaging surface 1015 to form a tight interference fit. This interference fit may be chosen such that the wedge-engaging surface 1015 is inelastically deformed in a similar manner to that shown in FIGS. 43 and 44.

Figures 52, 53, 54, 55, 56, 57:
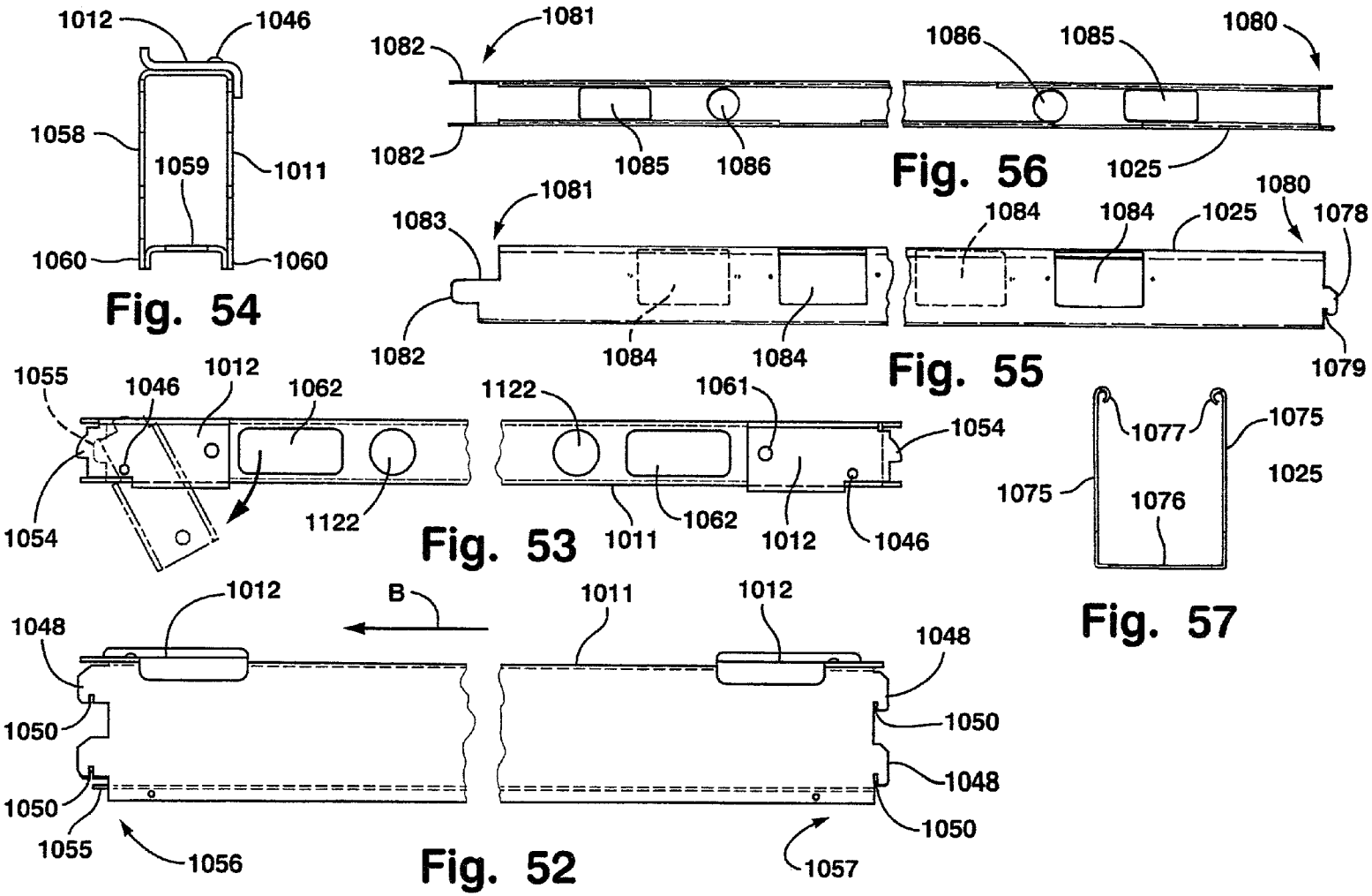
FIG. 52 is a fragmentary, side elevational view of the beam.
FIG. 53 is a fragmentary, top plan view of the beam.
FIG. 54 is a side elevational view of the beam.
FIG. 55 is a fragmentary, front elevational view of the data trough.
FIG. 56 is a fragmentary, top plan view of the data trough.
FIG. 57 is a side elevational view of the data trough.

Each beam 1011 is designed to be removed from between a pair of posts 1006 that form assembled panel frames 1002 adjacent the panel frame being disassembled in a manner similar to the data trough 1025 illustrated in FIG. 41. This is accomplished by providing longer, extended hooks 1048 at a first end 1056 of the beam 11 (FIG. 52). In addition, a horizontal tab 1055 is provided at the first end 1056 (FIGS. 52-54). The beam 1011 is removed by shifting it in the direction of the arrow "B" (FIG. 52) and then raising the second end 1057 in the direction of the arrow "C" and then sliding the beam 1011 in a direction opposite the arrow B. The horizontal tab 1055 provides stability and guides the first end 1056 of the beam 1011 when shifted in a direction indicated by the arrow B, but does not engage the horizontal slot 1035 when the beam is shifted downward into the vertical slots 1034. Each beam 1011 is made from an upper U-shaped piece 1058 and a lower U-shaped piece 1059 which are welded together adjacent the edge 1060 (FIG. 54). In addition, each beam 1011 may include rectangular windows 1062 and circular windows 1122 through the beam 1011 for vertical routing of data or power lines 1023, 1024 through the beams 1011 within the panel frame 1002. Each locking wedge 1012 includes an aperture 1061 which is used to hang the locking wedge 1012 for painting during the fabrication process.

Figures 58, 59, 60, 61, 62:
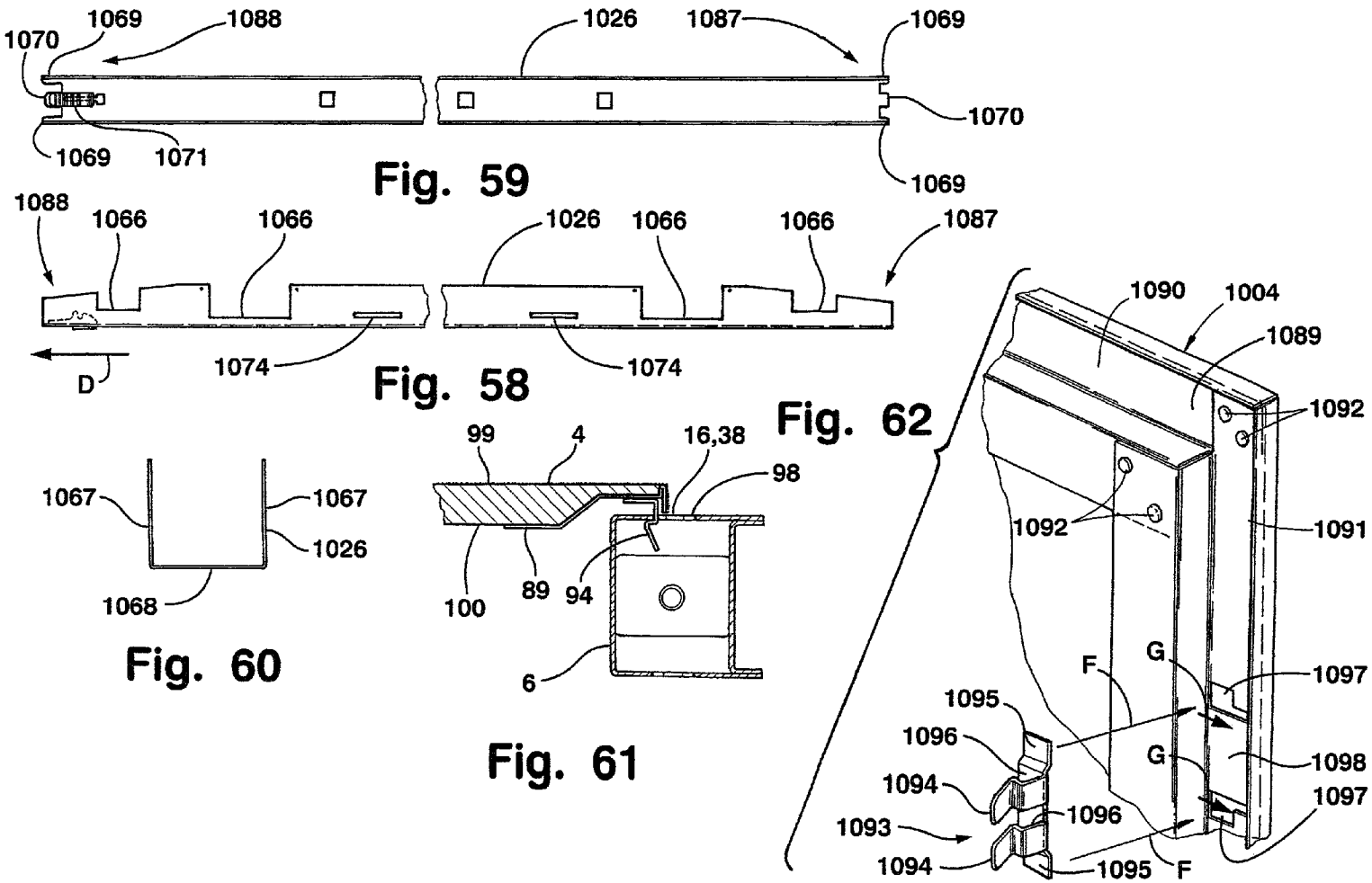
FIG. 58 is a fragmentary, front elevational view of the power trough.
FIG. 59 is a fragmentary, top plan view of the power trough.
FIG. 60 is a side elevational view of the power trough.
FIG. 61 is a fragmentary, top plan view of a vertical post showing the cover panel engaging the cover mounting apertures.
FIG. 62 is a fragmentary, perspective view of the cover panel showing the mounting of the cover retaining clips.

Two types of utility troughs may be utilized for routing of data and power lines 1023, 1024. A data trough 1025 is illustrated in FIGS. 55-57, and a power trough 1026 is illustrated in FIGS. 58-60. Either trough may be used for routing of data or power lines 1023, 1024 within the trough; however, only the power trough 1026 is utilized for hanging power boxes 1063 and power lines 1024 therebelow.

With reference to FIGS. 55-57, each data trough 1025 has a U-shaped cross-sectional shape that includes a bottom wall 1076 and side walls 1075 having a curved-under top edge 1077. Each data trough 1025 also includes a pair of tabs 1078 and a slot 1079 forming a downwardly extending hook at a first end 1080. At a second end 1081, the data trough 1025 includes a pair of tabs 1082 with a cutback portion 1083 that provides clearance when the first end 1080 of the data trough is tipped upward in a direction of the arrow "E" (FIG. 55) during removal and installation of the data trough 1025 between a pair of posts 1006 when the panel frame 1002 is in an assembled condition (FIG. 41). Each of the data troughs 1025 includes cutout portions 1084 for mounting of data receptacles 1065, and rectangular apertures 1085 and circular apertures 1086 for vertical routing of data and power lines 1023, 1024 within the panel frame 1002.

With reference to FIGS. 58-60, each power trough 1026 has a generally U-shaped cross-sectional shape, and includes cutout portions 1066 along the side walls 1067 for mounting data receptacles 1065 (FIG. 41). Each end of the power trough 1026 includes two L-shaped tabs 1069 and a horizontal tab 1070 (FIG. 46) which are received in the L-shaped slots 1072 and the horizontal slot 1073, respectively, of a utility trough port 1021 (FIG. 42). One end of the power trough 1026 includes a locking wedge such as sliding wedge 1071 that is moved in the direction of the arrow "D" of FIG. 58 after the power trough 1026 is positioned in the utility trough port 1021, thereby providing a tight interference fit which prevents movement of the utility trough 1026 when an electrical line is plugged into the power receptacle 1064. Alternatively, a locking wedge 1012 could also be utilized for attachment of the power trough 1026 to the post 1006. Elongated slots 1074 provide a snap-in mounting for power boxes 1063 as illustrated in FIG. 41.

Figure 64:
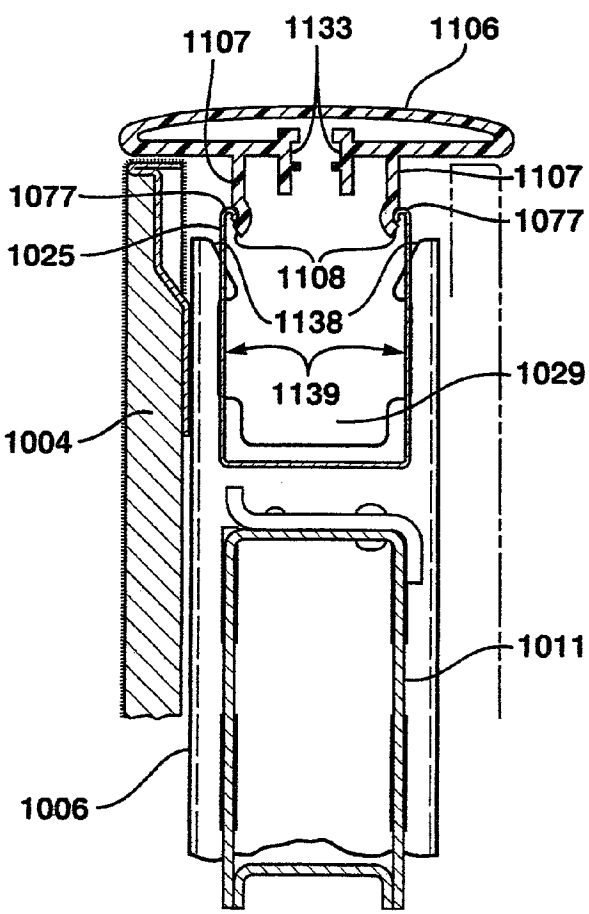
FIG. 64 is a fragmentary, side elevational view of the assembled knock-down portable partition showing the top cap installed into the data trough.

As best seen in FIGS. 41, 55 and 56, the data trough 1025 may be installed by inserting the second end 1081 into the utility trough port of a post 1006. The first end 1080 is rotated downward, the beam is then shifted in the direction of the first end 1080 and down, opposite the arrow E (FIG. 55) to engage the slots 1079 into the L-shaped slots 1072 of the utility trough port 1021. With reference to FIG. 64, each of the upper utility ports 1029 includes tapered upper edges 1138 and vertical notch portions 1139. During installation of the upper data troughs 1025, the tabs 1078 and 1082 are pushed downward along the tapered edges 1138 and snap into the vertical notch portions 1139. The power troughs 1026 may be installed in a similar manner by inserting the L-shaped tabs 1069 and horizontal tab 1070 into the corresponding L-shaped slots 1072 and horizontal slot 1073 of a utility trough port 1021 (FIG. 46). The second end 1088 is then rotated downward and the utility trough is shifted in the direction of the second end 1088 to engage the L-shaped tabs 1069 and the horizontal tab 1070 into the corresponding L-shaped slots 1072 and horizontal slot 1073 of a utility trough port 1021. The sliding wedge 1071 is then shifted in the direction indicated by the arrow D shown in FIG. 58.

With reference to FIGS. 61 and 62, each cover panel 1004 includes a cover frame 1089 that includes horizontal members 1090 and vertical members 1091 that are "toggle locked" together at 1092. Clips 1093 include tabs 1095 and spurs or bent-out portions 1096, and arms 1094. The clips 1093 are installed to the cover frame 1089 by inserting the tabs 1095 into apertures 1097 in the direction indicated by the arrows "F" shown in FIG. 62. The clip 1093 is then slid in the direction of the arrows "G." This causes the spurs or bent-out portions 1096 to engage the surface 1098 between the apertures 1097, thereby preventing the clip from shifting in a direction opposite the arrow G. With reference to FIGS. 42 and 61, the arms 1094 of each clip 1093 are received into the outer portion 1098 of the apertures 1038 in the vertical post 1006. The apertures 1038 position adjacent covers 1004 in a spaced-apart relationship to provide clearance for the vertical row of slots 1016. In addition, the apertures 1038 provide support for the cover 1004 so that the cover is held securely in position and does not shift vertically. Each cover 1004 includes an outer decorative fabric layer 1099 and a thicker acoustic layer 1100 which may be made from a fiberglass mat or other suitable material.

Figure 63:
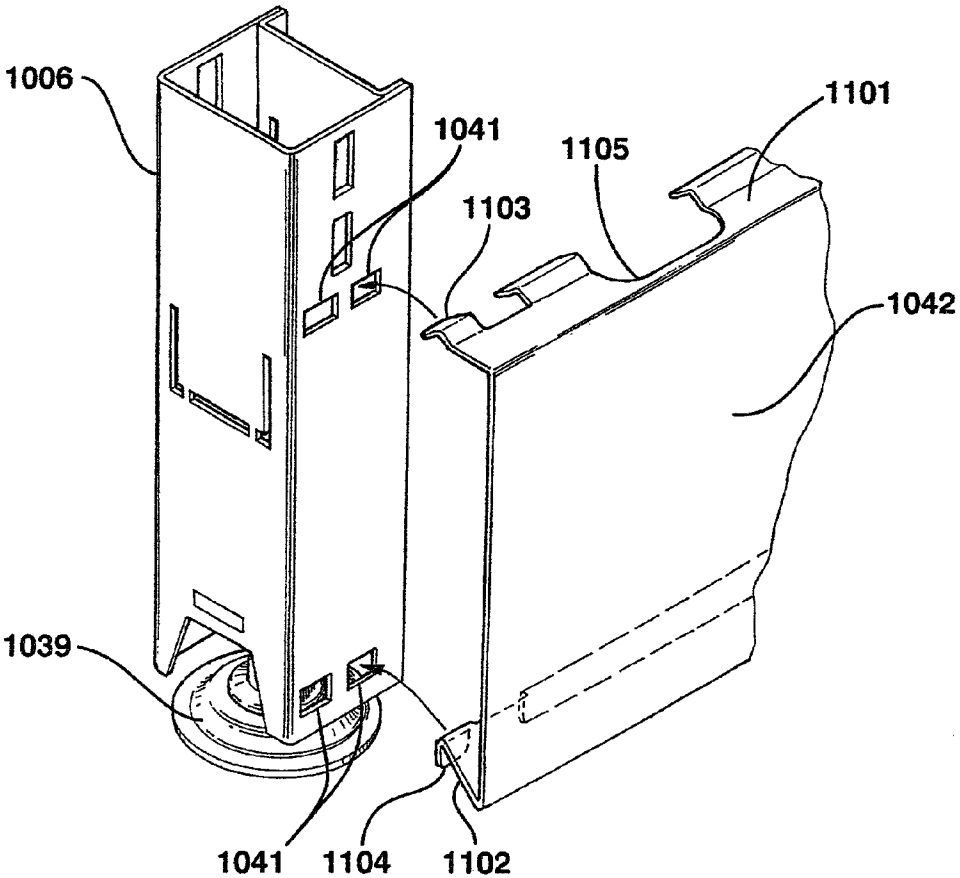
FIG. 63 is a fragmentary, perspective view showing the base cover and mounting tabs.

With reference to FIG. 63, each base cover 1042 is formed from sheet metal and includes an upper flange 1101 and a lower flange 1102. An upper tab 1103 at each end of the upper flange 1101 snaps into engagement with an aperture 1041, and a lower tab 1104 engages an aperture 1041 to retain the base cover 1042 to the post 1006. A cutout 1105 along the upper flange 1101 provides clearance for vertical routing of data or power lines 1023, 1024.

With reference to FIG. 64, a top cap 1106 which is molded from a polymeric material includes a pair of downwardly extending legs 1107 with arcuate portions 1108 which snap into the curved-under top edge 1077 of a data trough 1026.

Figures 65, 68A, 69A:
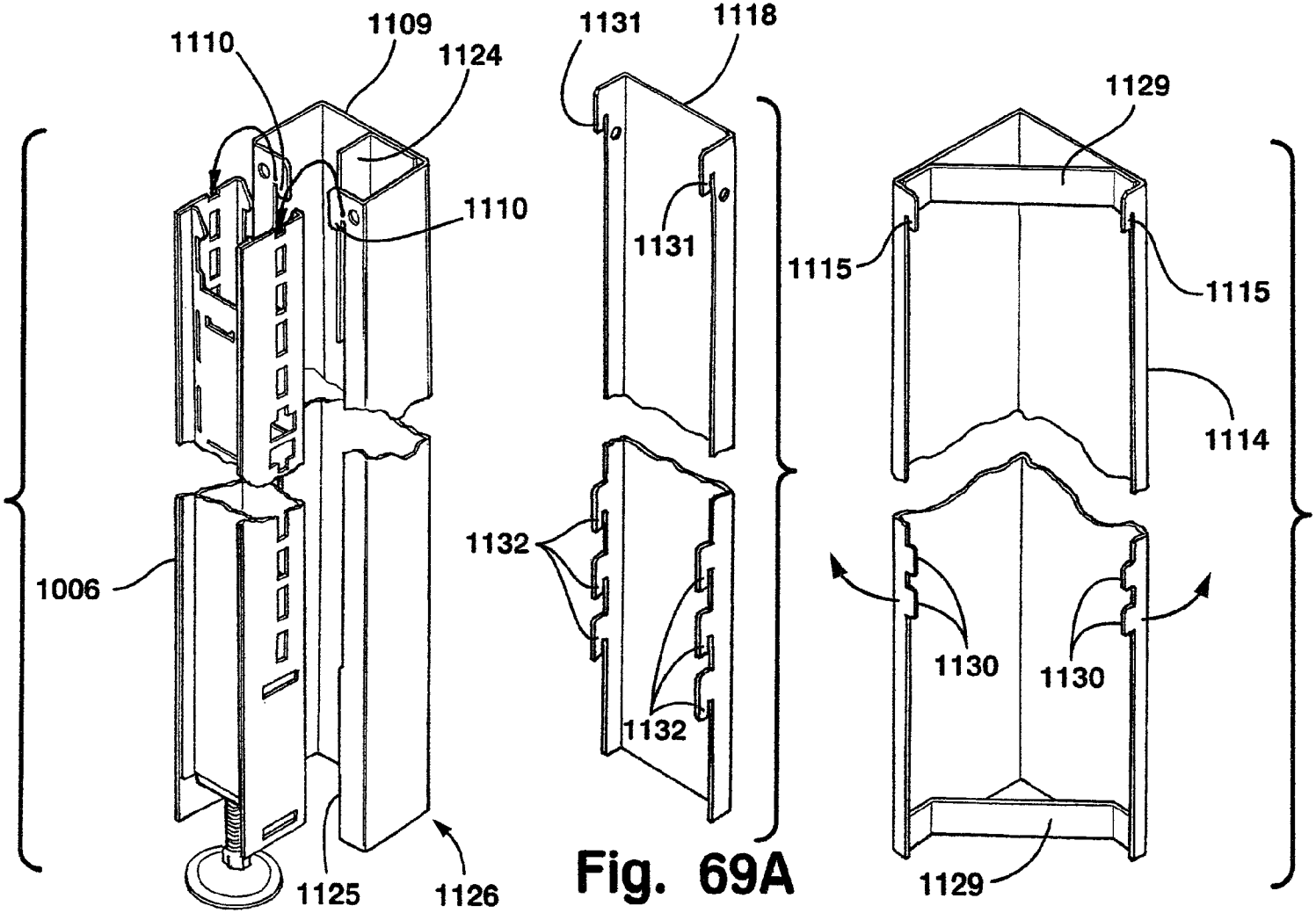
FIG. 65 is a fragmentary, perspective view showing an end cover and vertical, end-of-run post.
FIG. 68A is a fragmentary, perspective view of an L-cover.
FIG. 69A is a fragmentary, perspective view of a T-cover.
Figure 66A:
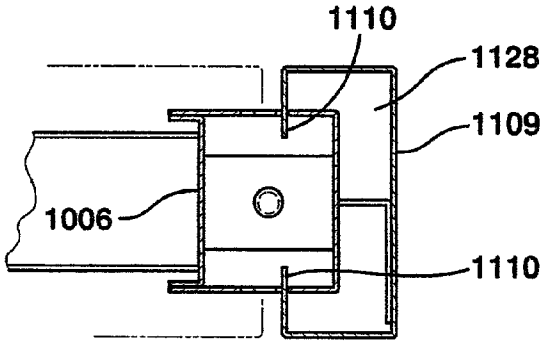
FIG. 66A is a fragmentary, top plan view of an end-of-run post with a change-of-height end cover installed.
Figure 66:
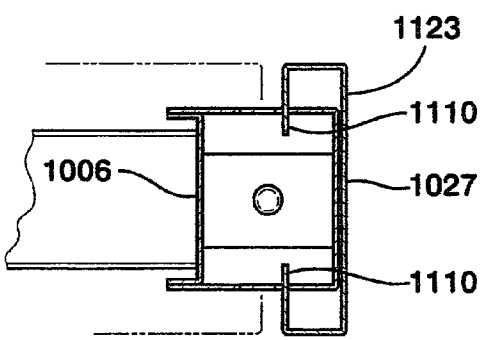
FIG. 66 is a fragmentary, top plan view of an end-of-run post with an end cover installed.

With reference to FIGS. 65, 66 and 66A, a change-of-height end cover 1109 includes slotted tabs 1110 which engage the uppermost slots in a vertical row of slots 1016 (FIG. 49) to provide a decorative cover for the post 1006. After the slotted tabs 1110 are engaged, the lower end 1126 of the end cover 1109 is slid over the lower end 1008 of the post 1006 to frictionally engage the narrow portions 1125 against the post 1006. The end cover 1109 includes a brace 1124 that offsets the end cover 1109 to provide a vertical passage 1128 for data and power lines 1023 and 1024. The end-of-run cover 1123 is similar to the change-of-height end cover 1109, except that the end-of-run cover 1123 rests against the post 1006 at the inner surface 1127.

Figure 68B:
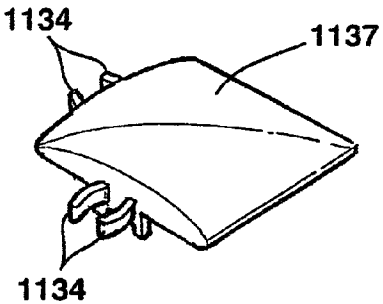
FIG. 68B is a perspective view of an L-top cap.
Figure 65A:
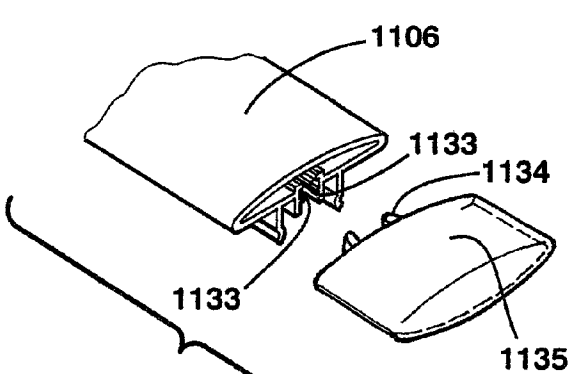
FIG. 65A is a fragmentary, perspective view of an end-of-run top cap and a top cap.
Figure 70:
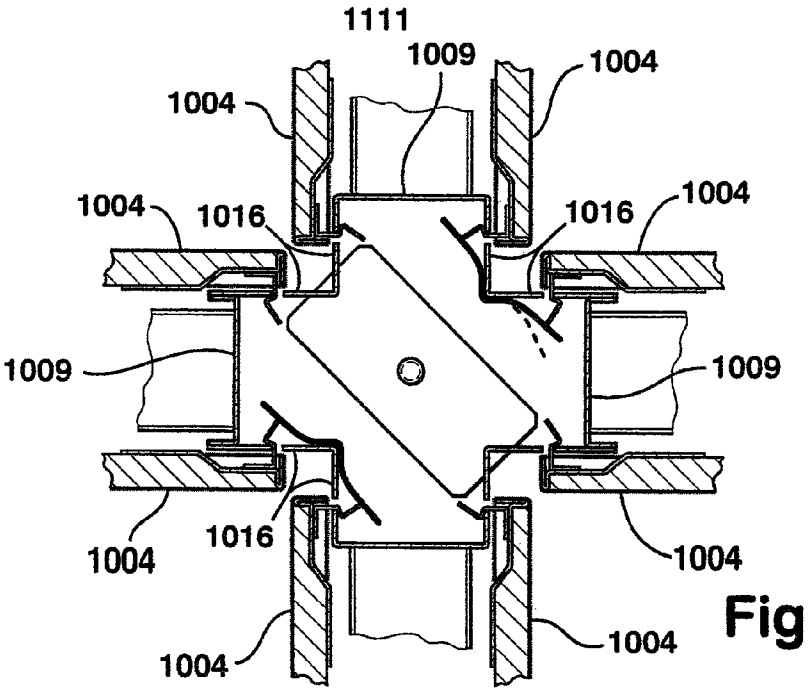
FIG. 70 is a fragmentary, top plan view of an X-post.
Figure 67:
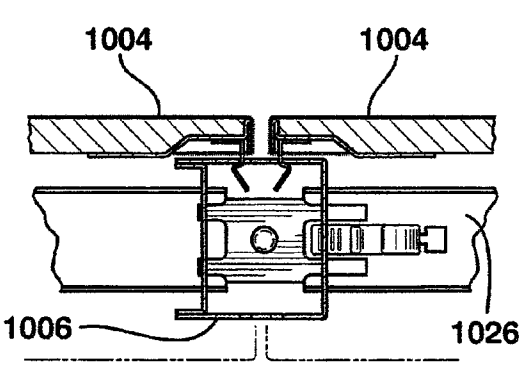
FIG. 67 is a vertical intermediate post with cover panels installed into a front face, and power troughs installed on the opposite side faces.
Figure 68:
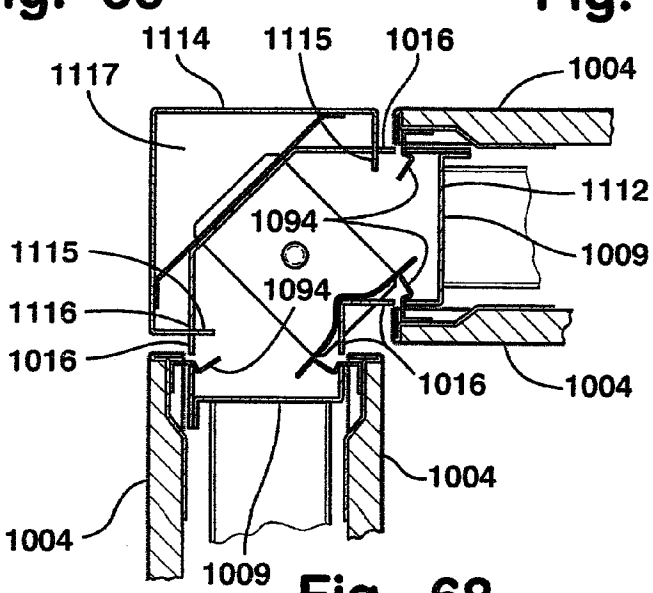
FIG. 68 is a fragmentary, top plan view of an L-post and cover.

With reference to FIGS. 67-70, the partition system 1001 may include an in-line or end-of-run post 1006 (FIG. 67), an L-post 1112 (FIG. 68), a T-post 1113 (FIG. 69), and an X-post 1111 (FIG. 70). The intermediate or end-of-run post 1006 may be used at an end-of-run location with an end cover 1109, or at an intermediate location as illustrated in FIG. 67. With reference to FIG. 65A, an end-of-run top cap 1135 is made of a polymeric material, and includes integral clips 1134 which are received into the notch areas 1133 of the top cap 1106. The change-of-height top cap (not shown) is similar to the end-of-run top cap 1135, except that it is slightly longer as required to correspond to the greater width of the change-of-height end cover 1109 (FIG. 66A). With reference to FIGS. 68 and 68A, each L-post may be covered by an L-cover 1114 which includes hooks 1115 for engaging slots 1116 in the L-post 1112. Each L-cover 1114 also includes smaller tabs 1130 (FIG. 68A) which engage the vertical row of slots 1016 to retain the lower end thereof. A brace 1129 provides a rigidity at the upper and lower ends of the L-cover 1114. The L-cover 1114 provides an open vertical passage 1117 that may be utilized for vertical routing of electrical or power lines. With reference to FIG. 68B, an L-top cap is made of a polymeric material, and includes integral clips 1134 that are received into the notch areas 1133 of the top cap 1106 (FIG. 64). The spacing of the covers 1004 and the L-cover 1114 provides clearance such that hang-on binder bins or other accessories may be hung from the vertical row of slots 1016.

Figure 69B:
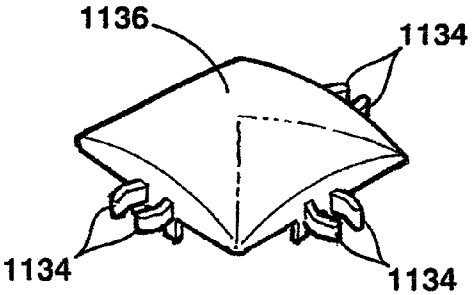
FIG. 69B is a perspective view of a T-top cap.
Figure 69:
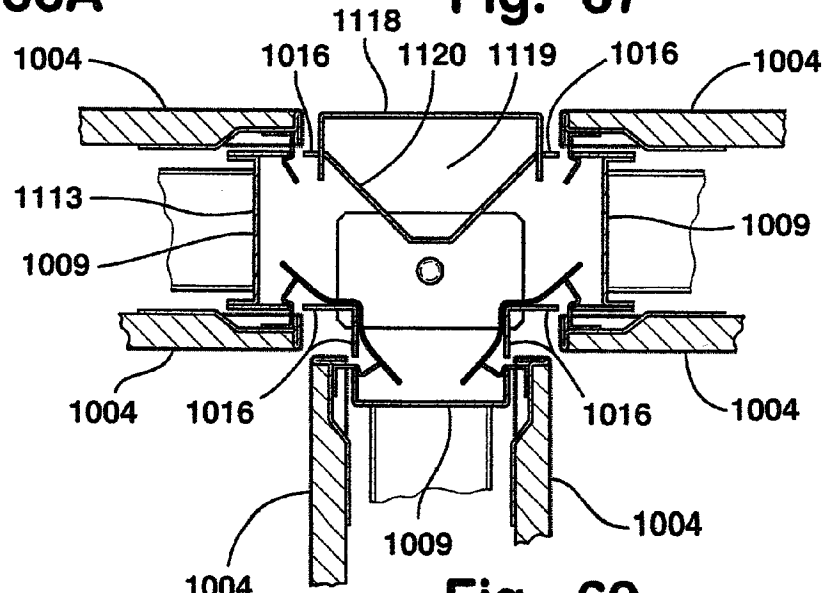
FIG. 69 is a fragmentary, top plan view of a T-post and cover.

The T-post 1113 includes a recessed portion 1120, which, in combination with the T-cover 1118 provides a vertical passage 1119 for vertical wiring of power or communications cabling (FIG. 69). The T-cover 1118 includes upper hooks 1131 and lower hooks 1132 that engage the vertical row of slots 1016. With reference to FIG. 69B, a T-top cap 1136 includes integrally formed clips 1134 that are received in the notch areas 1133 of the top cap 1106.

With reference to FIG. 70, an X-post 1111 has a generally X-shaped plan configuration for joining four panel frames 1002 in an X formation. All of the post configurations have a single foot 1039, and also have opposite faces with a plurality of beam connection ports 1010 and utility trough ports 1021 in the same configuration as the in-line post 1006. In addition, each of the posts includes a vertical row of slots 1016 for support of hang-on accessory units.

Figure 71:
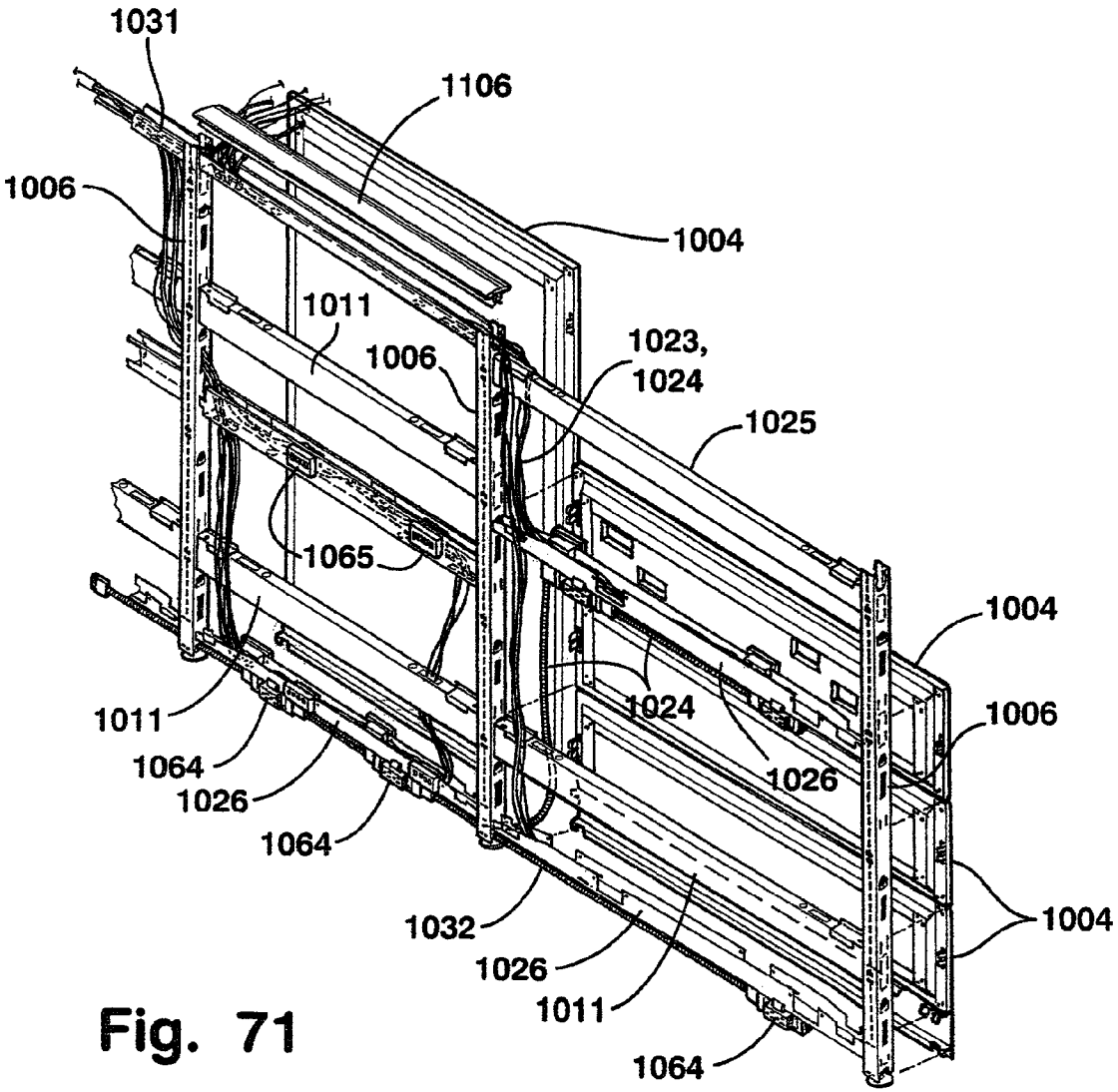
FIG. 71 is a fragmentary, exploded perspective view of the partition system showing the data and power lines and receptacles.
Figure 72:
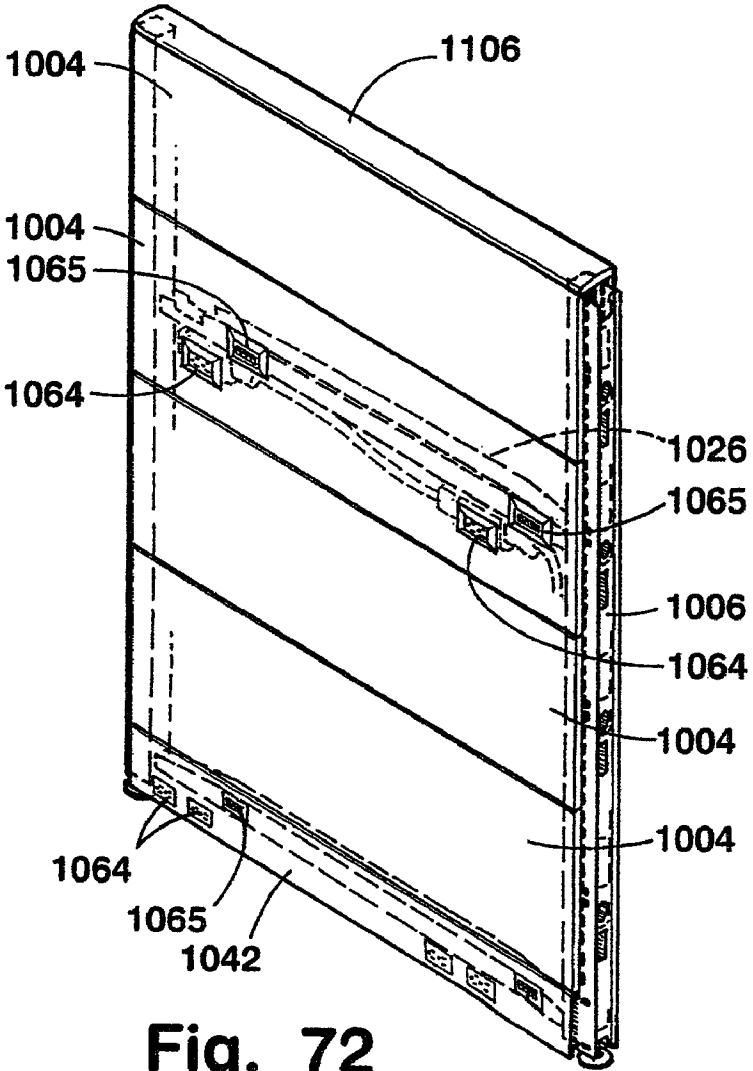
FIG. 72 is a perspective view of an individual panel section showing the data and power receptacles at the base and beltway heights.
Figure 73:
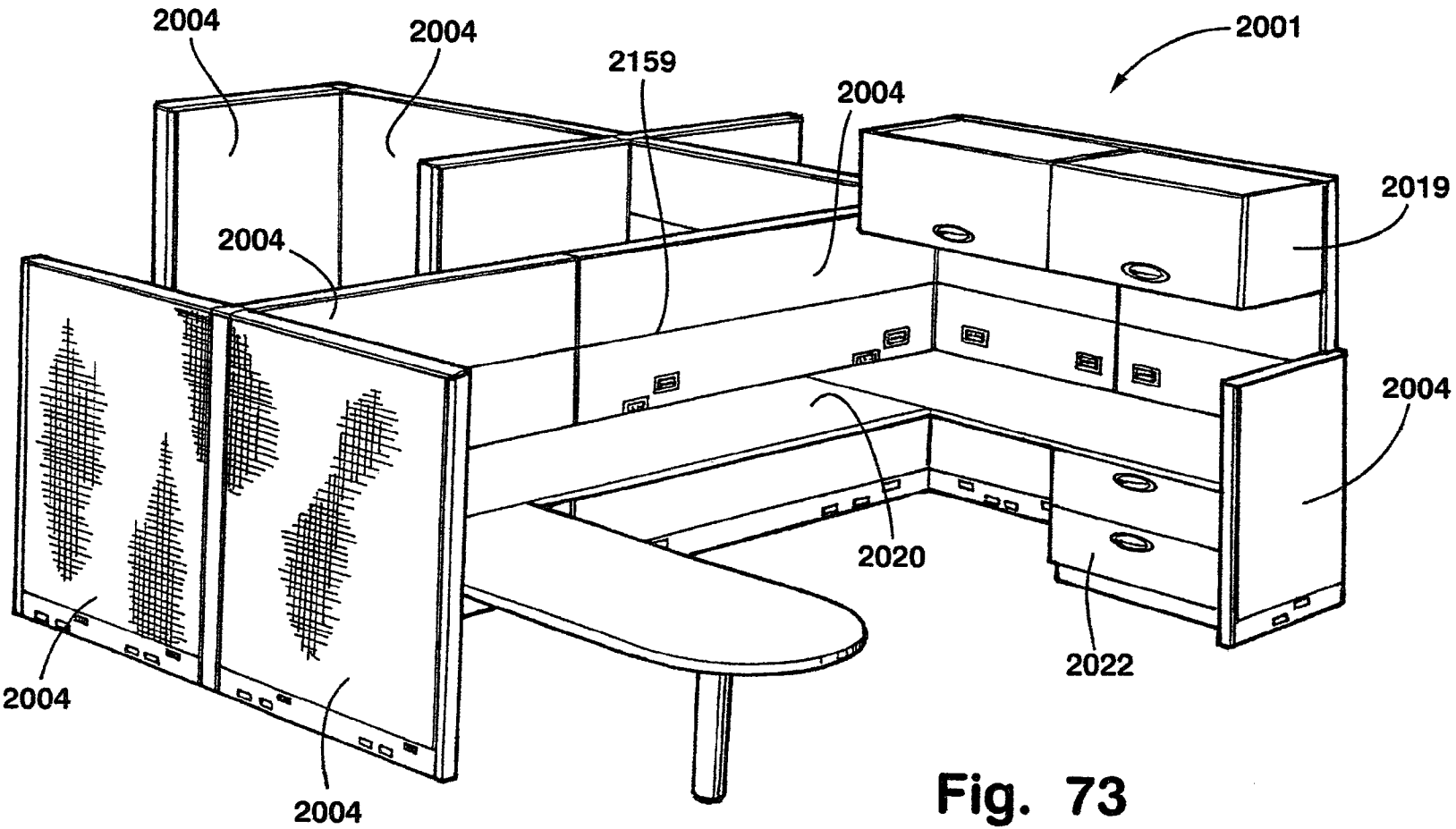
FIG. 73 is a perspective view of a third embodiment of a knock-down partition system according to the present invention.

With reference to FIG. 71, the data and power troughs 1025 and 1026 provide a flexible, easily installed system for support of data and power lines 1023 and 1024, and the power and data receptacles 1064, 1065. The data and power lines 1023, 1024 may be run vertically through the apertures in the utility troughs and beams. As illustrated in FIG. 72, a single power trough mounted at a beltway-high level may provide for both power receptacles 1064 and data receptacles 1065. The base covers 1042 are also cut out to provide for both power and data receptacles 1064, 1065 at the base of the panel.

The knock-down portable partition system 1001 provides a flexible, easily shipped and assembled system having capability for handling a wide range of power and communications cabling needs. The panel frame 1002 is simple, and quickly assembled yet provides sufficient structural strength for support of hang-on accessories such as binder bins 1018, work surfaces 1019, and lower file storage units 1020. Each post utilizes a single foot for support, thereby simplifying the vertical adjustment of the panel frame 1002. The beams 1011 and the data and power troughs 1025, 1026 may all be removed from between a pair of vertical posts 1006 while the adjacent panel frames 1002 are in an assembled condition. The cover panels 1004 are easily removed and installed and provide an acoustic, sound-absorbing layer.

Figure 76:
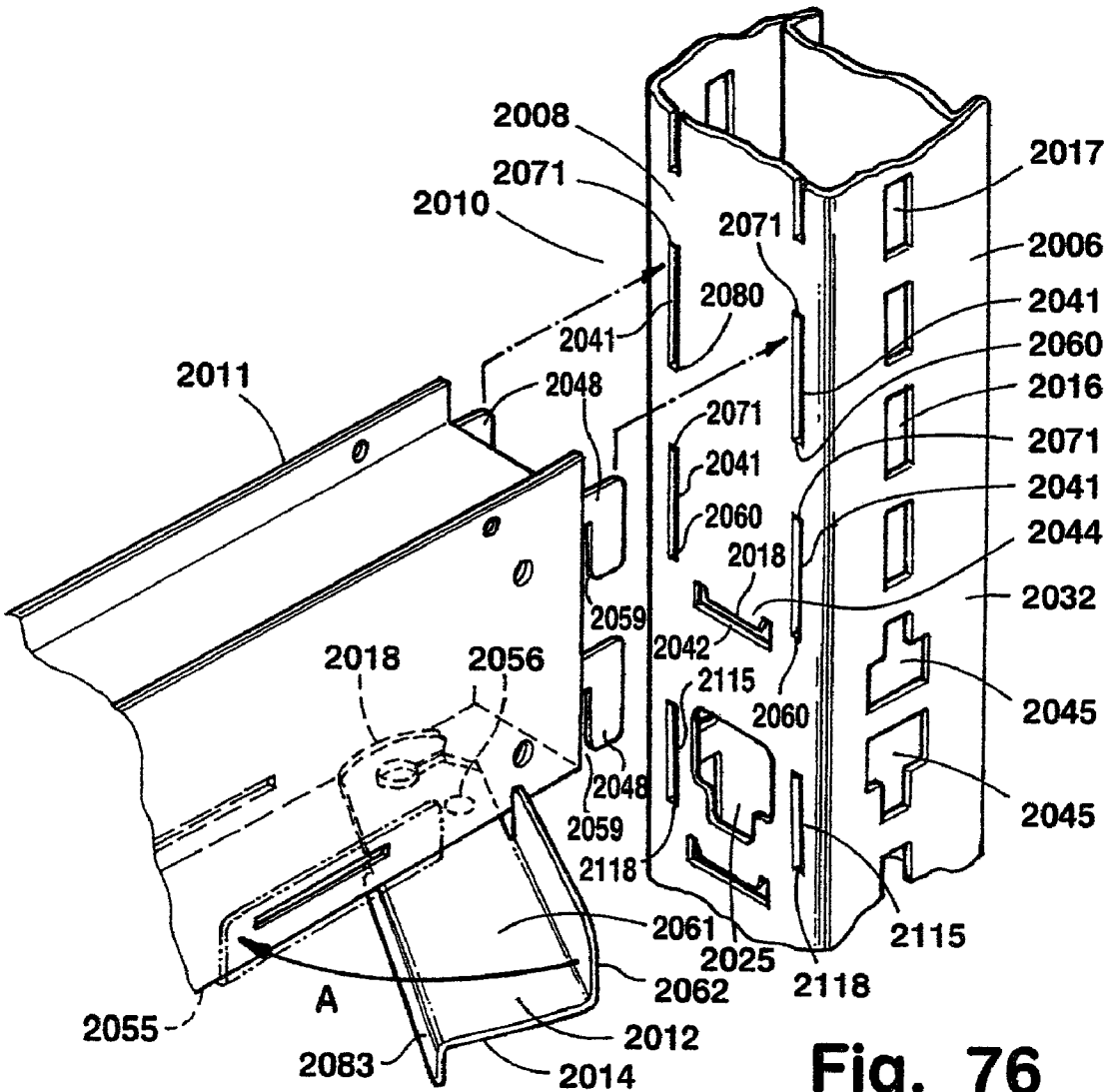
FIG. 76 is a fragmentary, perspective view of the lock member and beam connection port.
Figure 78:
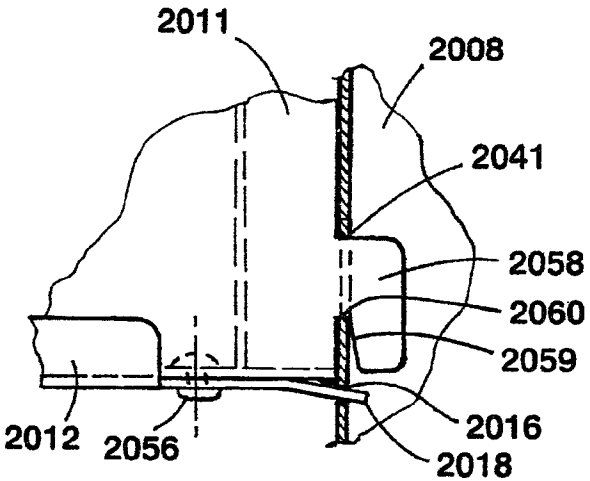
FIG. 78 is a fragmentary, front elevational view of the lock member in the engaged position showing the deformation of the flexible extension.
Figure 77:
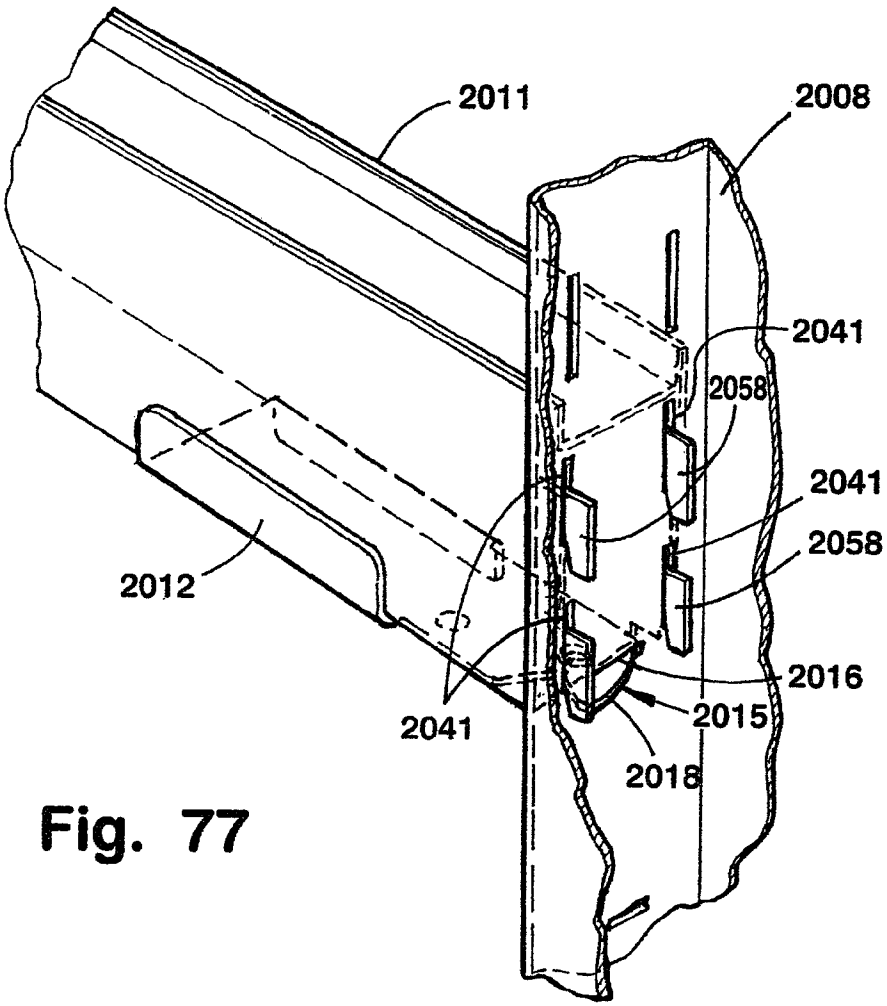
FIG. 77 is a fragmentary, perspective view of the lock member in the engaged position showing the elastic deformation of the flexible extension.

FIGS. 73-113 illustrate a third embodiment of a knock-down portable partition system according to the present invention. The third embodiment of knock-down portable partition system 2001 has a panel frame 2002 (see also FIGS. 74, 75) with a central portion 2003. At least one cover panel 2004 covers at least a portion of the central portion 2003 of the panel frame 2002. Connectors 2005 detachably mount the cover panel 2004 on the panel frame 2002 to facilitate assembly and removal of the cover panel 2004 on the panel frame 2002. The panel frame 2002 includes at least two vertical posts 2006 each having an upper end 2007, a lower end 2008, and opposite faces 2009 with at least two beam connection ports 2010 thereon positioned adjacent the upper and lower ends 2007, 2008 of the associated one of the posts 2006. Upper and lower bars or beams 2011 extend generally horizontally between the vertical posts 2006 adjacent the upper and lower ends 2007, 2008 thereof, and interconnect the same adjacent the connection ports 2010. Panel frame 2002 includes movable lock members 2012 having flexible extensions 2013. Lock members 2012 are positioned on one of the posts 2006 and the beams 2011 adjacent the connection ports 2010, and are movably mounted thereon for shifting between an unlocked position 2014 and a locked position 2015. As best seen in FIGS. 76 and 77, lock-engaging surfaces 2016 are positioned on the other of the posts 2006 and the beams 2011 adjacent the connection ports 2010, and are located thereon to engage the flexible extensions 2013 when the lock members 2012 are shifted to the locked position to rigidly yet detachably interconnect the posts 2006 and the beams 2011 for quick and complete assembly and disassembly of the knock-down portable partition 2001.

Figure 74:
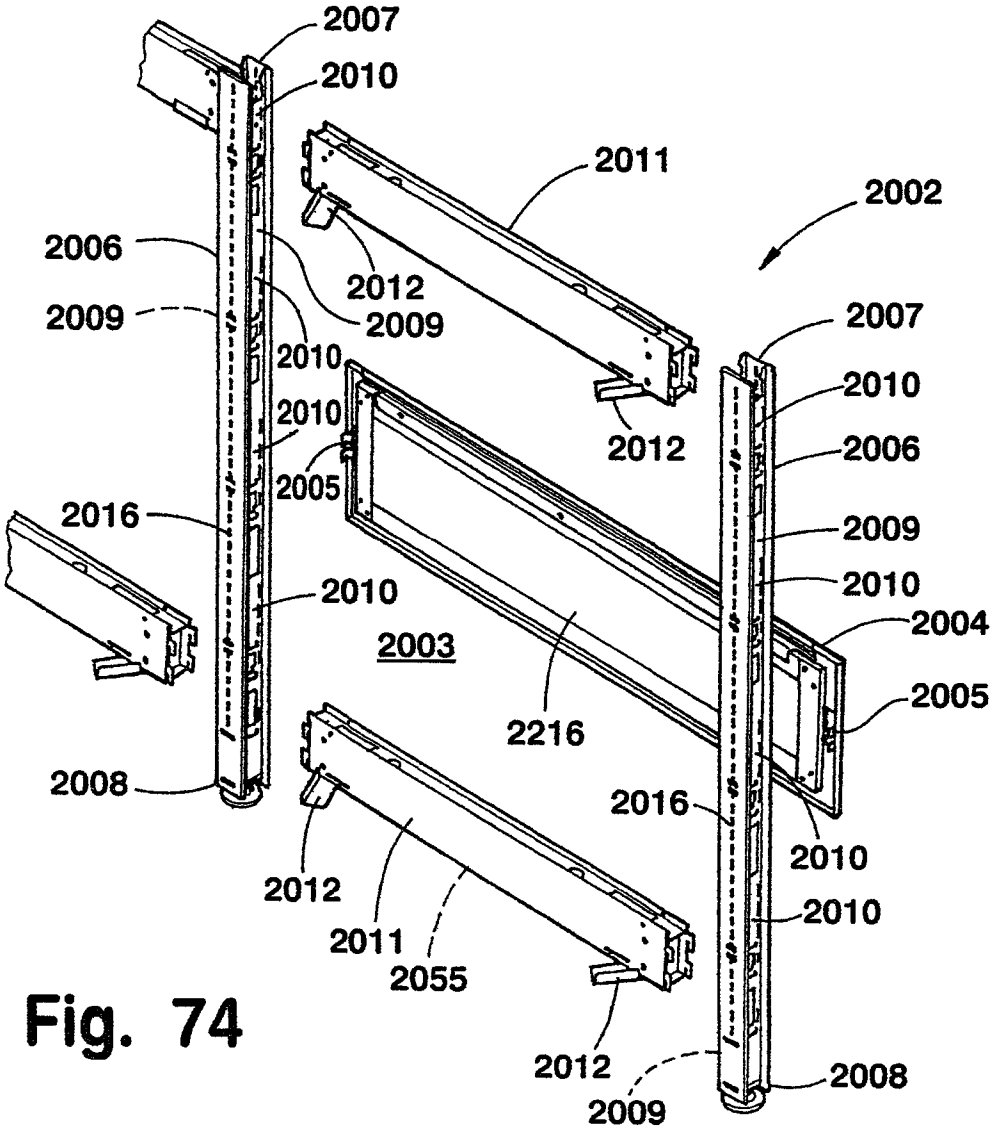
FIG. 74 is a fragmentary, exploded perspective view of the vertical posts, beams, and cover panels of the partition system of FIG. 73.
Figure 75:
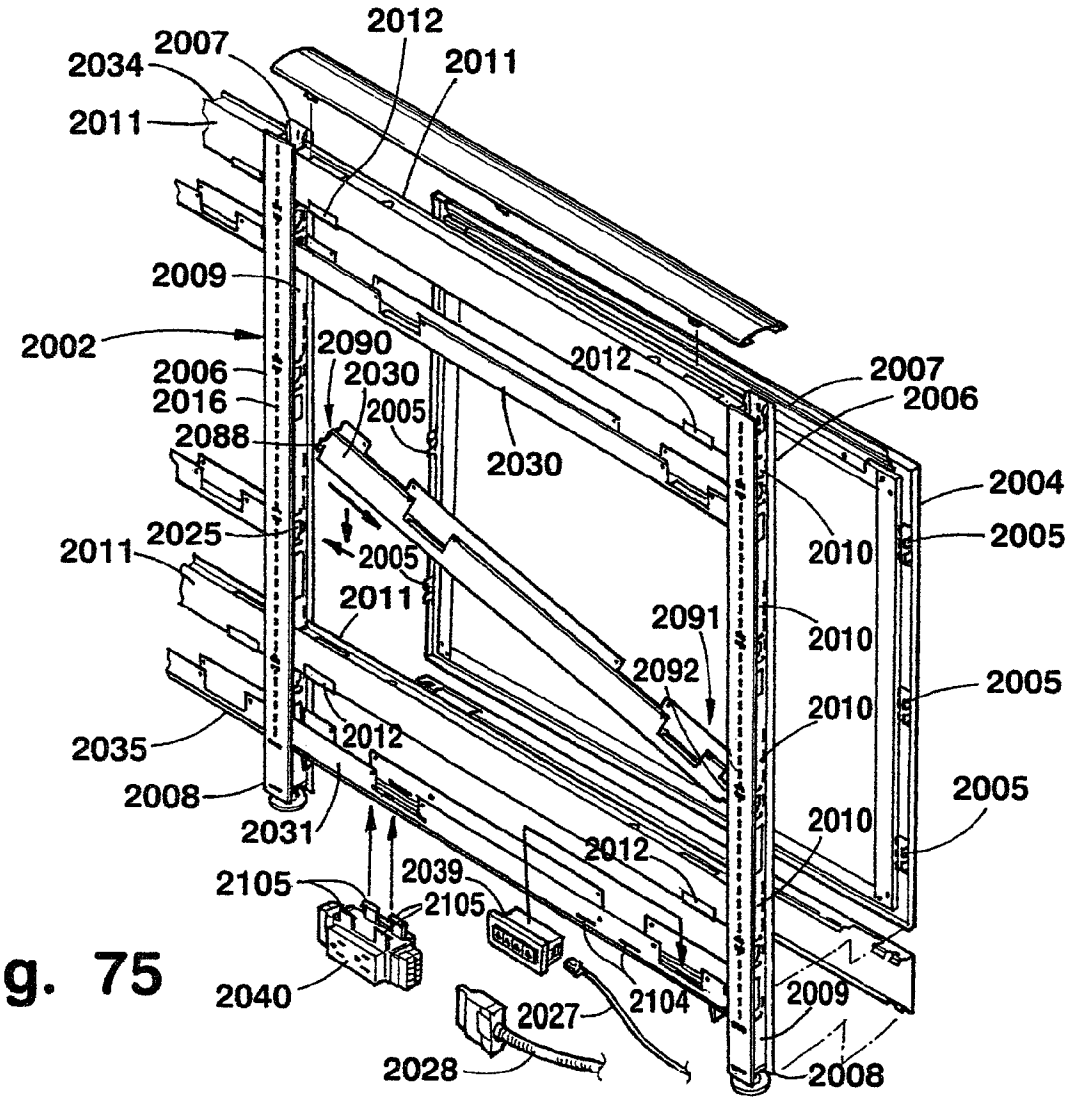
FIG. 75 is a fragmentary, exploded perspective view of the vertical posts, data and power troughs, beams and cover panel.

With reference to FIGS. 74 and 75, each vertical post 2006 includes a plurality of utility trough ports 2025 with associated windows 2026 (See also FIG. 80) through the posts 2006 for passing utility conduits such as data or communications lines 2027 or power lines 2028 therethrough. The partition 2001 includes at least one utility trough such as data trough 2030 or power trough 2031 that is shaped to receive and retain utility conduits therein. The utility troughs have opposite ends thereof configured to be detachably connected with a horizontally aligned pair of utility trough ports 2025 on the posts 2006 when the panel frame 2002 is in an assembled condition.

Each post 2006 includes a vertical row of slots 2017 extending along a vertical face 2018. The vertical row of slots 2017 receive hooks 2021 to removably attach hang-on accessory units such as a binder bin 2019 or a work surface 2020

Figure 79:
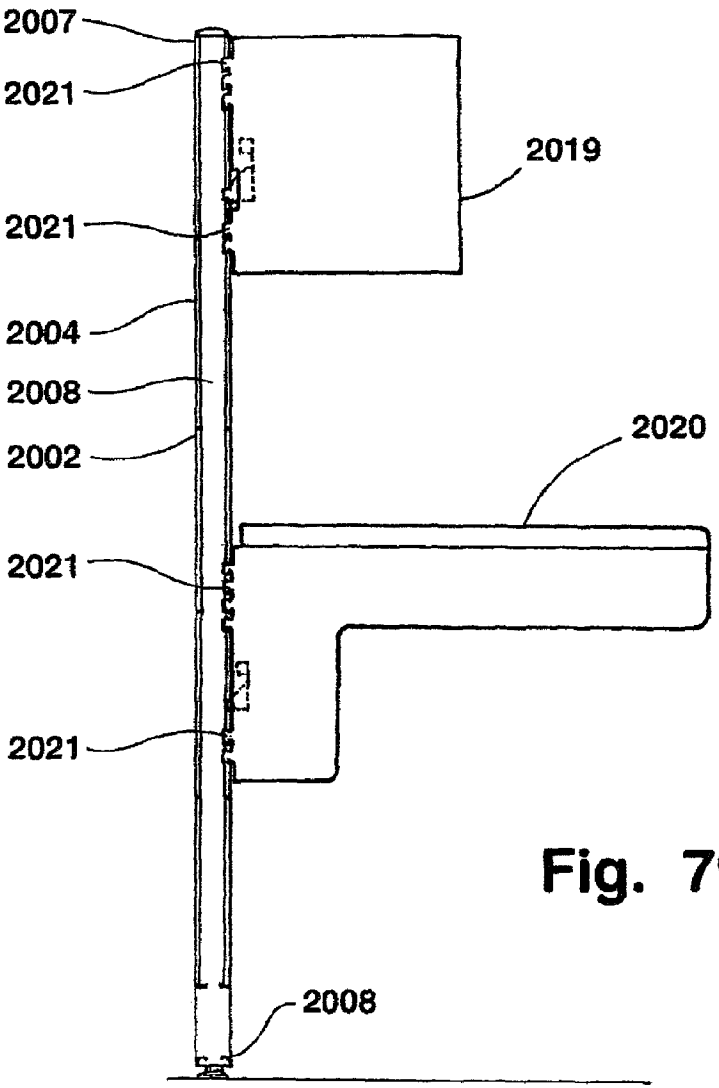
FIG. 79 is a partially schematic side elevational view of the partition system with hang-on bins and work surfaces installed.

(FIG. 79). A lower file storage unit 2022 (FIG. 73) may also be removably supported by the vertical row of slots 2017 in the posts 2006. Posts 2006 are each constructed to have sufficient structural strength to support the hang-on accessory units.

Figure 81:
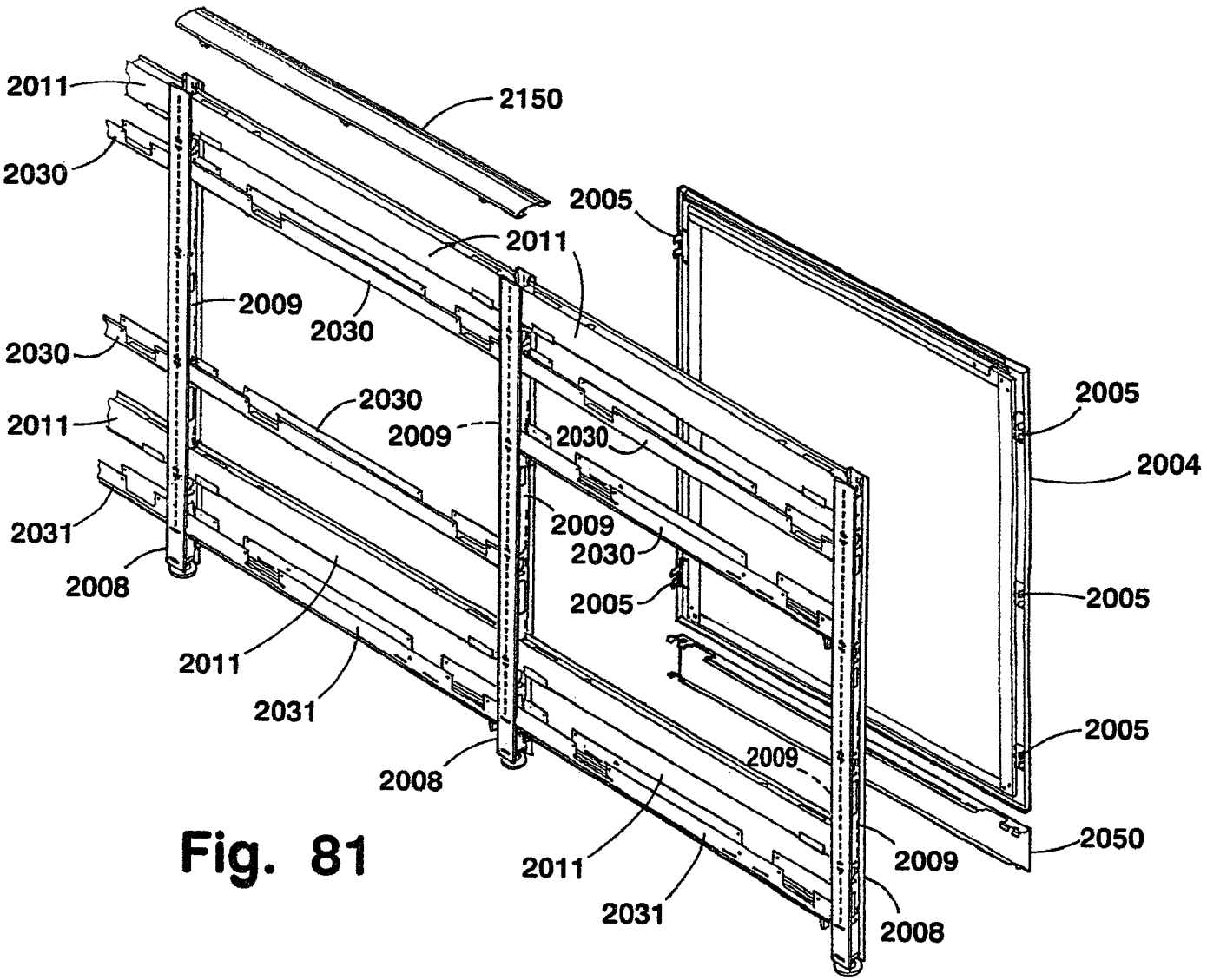
FIG. 81 is a fragmentary, perspective view of two adjacent panel frames showing an intermediate post with beams rigidly connected to both opposite side faces.

As best seen in FIG. 81, two adjacent rigid panel frames 2002 are formed by three vertical posts 2006 and at least four beams 2011 extending generally horizontally between the posts 2006 adjacent the upper and lower ends 2007, 2008 thereof. The beams 2011 provide the primary structural interconnection between the posts 2006, with the cover panels 2004 providing acoustical and decorative functions.

As shown in FIGS. 82-85, each vertical post 2006 has a pair of opposite faces 2009 and front faces 2032. Each post 2006 includes an upper utility trough port 2033 with a window that is open along the upper side for lay-in of utility conduits such as data lines 2027 along the top edge 2034 (FIG. 75) of the panel frame 2002. In addition, each post 2006 has a utility trough port 2025 adjacent the lower end 2008, with a lower window 2036 (see also FIG. 97) having an open lower edge for lay-in of utility conduits such as power lines 2028 along the lower edge 2035 (FIG. 75) of the panel frame 2002. Each of the utility trough ports 2025 has an upper window 2037 and a lower rectangular window 2038. Data and power lines 2027, 2028 that are routed in the data or power troughs 2030, 2031 may be passed through the windows 2037. If required, one or more power boxes 2040 (FIG. 75) may be connected to the bottom of a power trough 2031 with power lines 2028 routed through the rectangular windows 2038.

Figure 80:
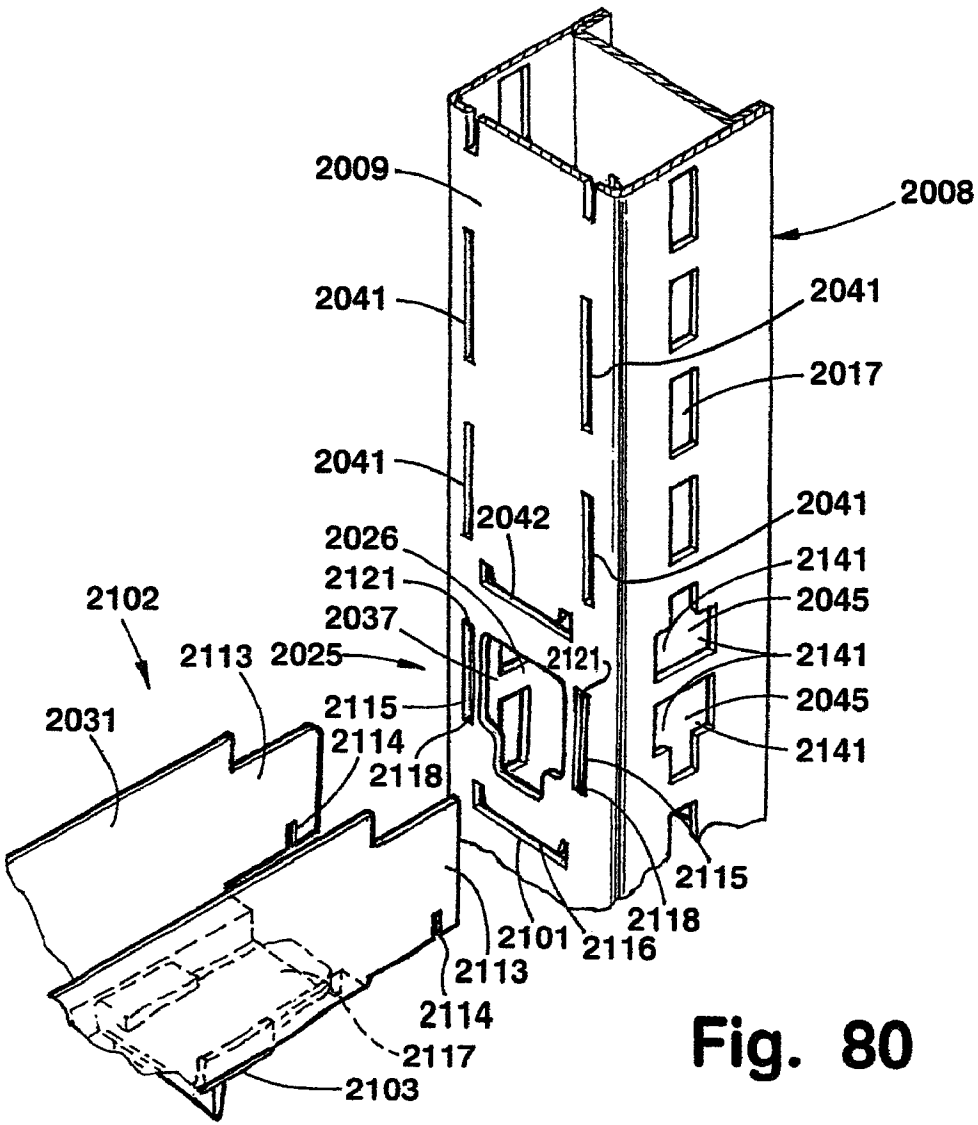
FIG. 80 is a fragmentary, perspective view of the utility trough port and a power trough with sliding wedge.

As best seen in FIG. 80, each beam connection port 2010 includes four vertical slots 2041 and a horizontal slot 2042. In addition, a pair of upper slots 2043 (FIG. 82) are located directly above the beam connection ports 10 for connecting an upper utility trough 2030 of a shorter panel frame 2002 at a change of height location. Horizontal slot 2042 of the beam connection port 2010 has a downwardly extending tab 2044 (FIG. 76) having a lock-engaging surface 2016 along the lower edge thereof. As described in more detail below, front faces 2032 of each post 2006 include apertures 2045 that receive connectors 2005 for mounting cover panels 2004. Each of the posts 2006 have a single, vertically adjustable foot 2046 with threaded portion 2047 that is received in a threaded plate 2048 welded to the lower end 2008 of the post 2006 (FIG. 85). As also described in more detail below, front face 2032 of post 2006 includes apertures 2049 near the lower end 2008 that removably mount a base cover 2050. (See also FIG. 97). Posts 2006 are made from a larger U-shaped piece 2051 and a smaller U-shaped piece 2052, each of which is roll-formed from sheet metal. The larger and smaller U-shaped pieces 2051 and 2055 are welded together along overlapping edge portions 2045. Alternatively, posts 2006 could have a one-piece, roll-formed tubular construction.

Figure 87:
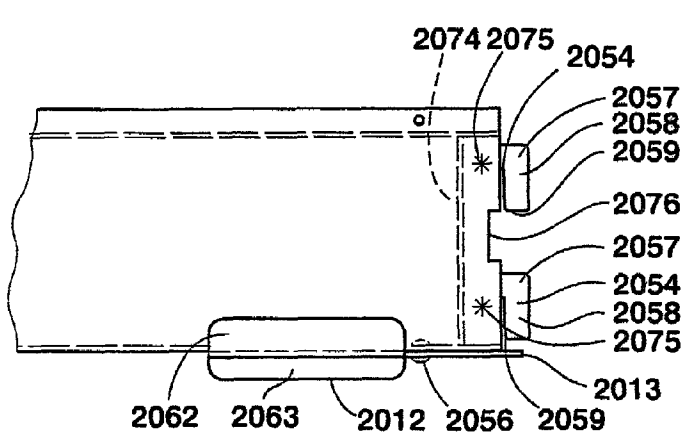
FIG. 87 is a fragmentary, front elevational view of the beam.
Figure 88:
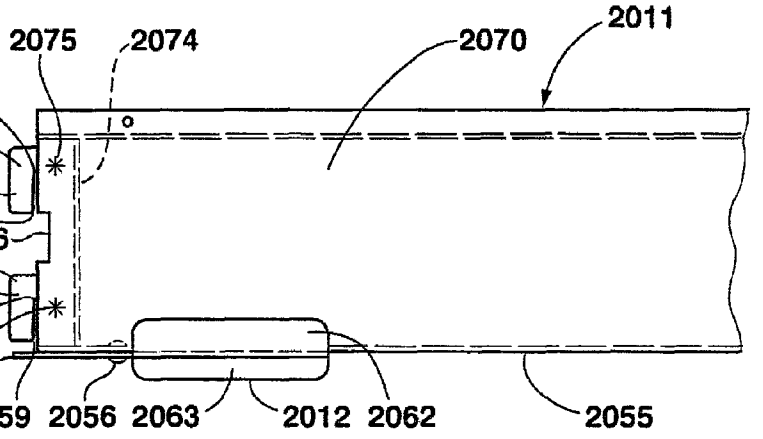
FIG. 88 is a side elevational view of the beam.
Figure 88:
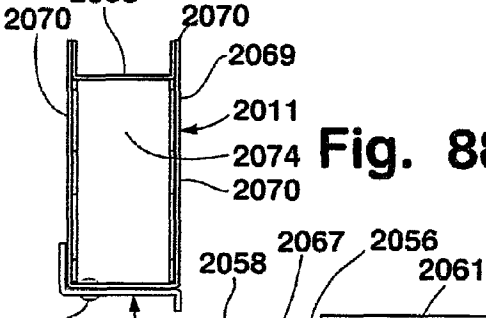
Figure 86:
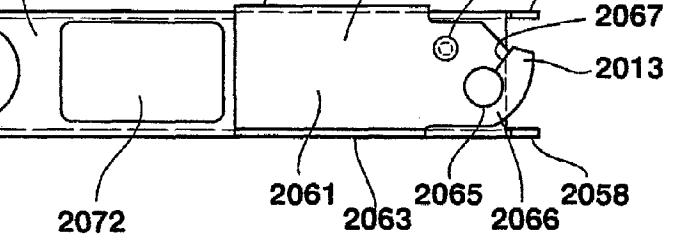
FIG. 86 is a fragmentary, bottom view of the beam.
Figure 86:
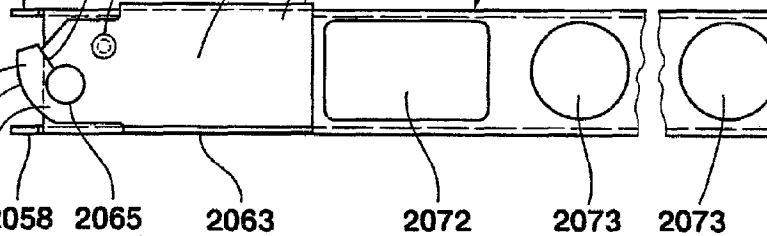
Figure 88A:
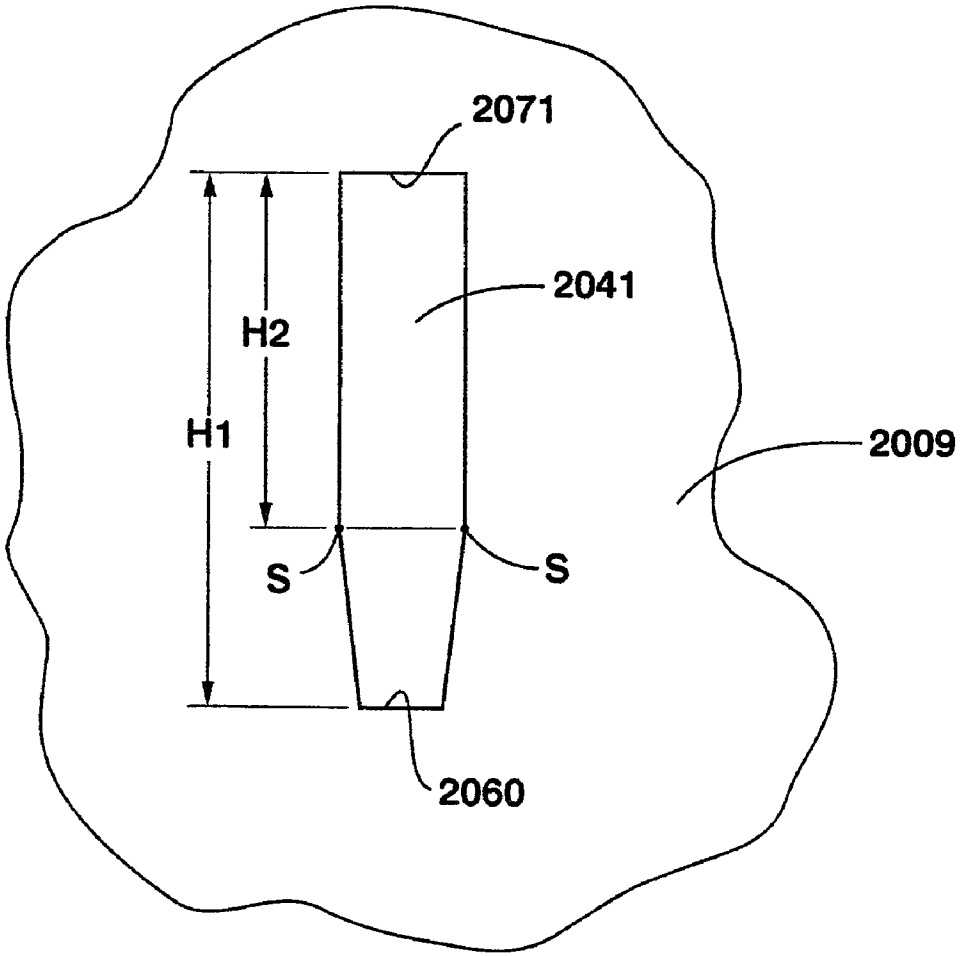
FIG. 88A is a fragmentary view illustrating the tapered slots in the side faces of the posts.

With reference to FIGS. 86-88, each beam 2011 has a movable lock member 2012 that is rotatably mounted to the lower side 2055 of the beam 2011 by a rivet 2056. The beam 2011 includes four tabs 2057 and slots 2054 that form downwardly extending hooks 2058 at each end. Hooks 2058 are formed on U-shaped end insert 2074 that is spot welded to the sidewalls 2070 of the beam 2011 at 2075. The insert 2074 and hooks 2058 are fabricated from a thicker sheet metal material than beam 2011 to provide additional strength. Hooks 2058 are received in vertical slots 2041 of the beam connection port 2010. Slots 2059 of hooks 2058 engage bottom edges 2060 of vertical slots 2040 (FIG. 76). Slots 2059 have tapered, or angled side edges such that the width of the slot 2059 is greater at the opening than at the base, or vertex 2054. The taper of slot 2059 ensures that beam 2011 is securely and rigidly interconnected with post 2006 when assembled. With further reference to FIG. 88A, vertical slots 2041 in posts 2006 have tapered, or angled side edges such that top edge 2071 is wider than bottom edge 2060. Top edge 2071 has a width W1 of 0.165 inches, and bottom edge 2060 has a width W2 of 0.115 inches. Slots 2041 have a height H1 of 1.100 inches, and the side edges are parallel (i.e., 0.165 inches apart) along the upper 0.800 inch portion H2 of slot 2041. The side edges taper inwardly to the 0.115 inch bottom edge 2060 starting at a point S 0.300 inches from bottom edge 2060. The taper of slots 2059 further ensures that beam 2011 is securely and rigidly interconnected with post 2006 when assembled. Hooks 2058 have a thickness that is approximately the same as the width of slot 2041 at the bottom edge 2060. Hooks 2058 may also be slightly thicker or thinner than bottom edge 2060 of slot 2041. Base 2054 of slot 2059 is approximately the same width as the thickness of the sidewall of post 2006. Base 2054 can also be slightly wider or narrower than the thickness of the sidewall of post 2006. The taper of slots 2041 and 2059 provide a snug wedging fit, ensuring that beam 2011 rigidly and securely interconnects with posts 2006. If hooks 2058 are wider than lower edge 2060 of slots 2041, and/or base 2054 of slot 2059 is narrower than the thickness of the sidewall of posts 2006, a downward force on beam 2011 is required to seat hooks 2058 in slots 2041. A rubber mallet or other suitable tool can be used to quickly and easily seat hooks 2058 in slots 2041.

Lock member 2012 is formed from sheet metal, and includes a flat body portion 2061 that forms a lever arm for mechanical advantage such that the lock members 2012 can be grasped and manually shifted from the unlocked position to the locked position by a person without the use of tools. An upwardly turned flange 2062 provides a surface for a person to push against for manually rotating the locking member 2012 in the direction of the arrow "A" (FIG. 76) to shift the lock member 2012 to the locked position. Each locking member 2012 also includes a downwardly-extending flange 2063 that provides a flat surface to push against to rotate locking member 2012 to the unlocked position.

Each locking member 2012 includes a flexible extension 2013 (FIG. 86) having a curved outer edge 2064. The flexible extension 2013 is formed by cutting or separating the sheet metal along a line 2067 to hole 2065, thereby forming a base portion 2066 of the flexible extension 2013. Flexible extension 2013 is thereby cantilevered to the body portion 2061 of the locking member 2012, such that flexible extension 2013 is progressively flexed downwardly as extension 2013 engages the lock-engaging surface 2016 of post 2006 during rotation of lock member 2012 (see also FIG. 78). The elastic deformation of flexible extension 2013 generates a force that pulls the hooks 2058 downwardly into engagement with the slots 2041, thereby securely locking each end of the beam 2011 to the posts 2006 and preventing upward movement and disengagement of hooks 2058.

Each beam 2011 may be made from an upper U-shaped piece 2068 and a lower U-shaped piece 2069 which are welded together along overlapping flange portion 2030. Alternatively, beam 2011 may have a one-piece tubular construction fabricated from sheet metal using a roll-forming process. Each beam 2011 may include rectangular windows 2072 and circular windows 2073 through the beam 2011 for vertical routing of data or power lines 2023, 2024 through the beams 2011 within the panel frame 2002. The area between hooks 2058 is cut out at 2076. To remove a beam 2011 from between a pair of posts 2006, lock member 2012 is shifted to the disengaged position, and beam 2011 is shifted upwardly to disengage slots 2059 from the bottom edge 2060 of slots 2041. A small pry bar or other suitable tool is then inserted into the opening between the posts 2006 and the beam 2011 created by the cutout 2076, and the posts 2006 and beam 2011 are pried apart, such that adjacent panel frames 2002 are shifted slightly and hooks 2058 disengage from the beam connection ports 2010.

Beams 2011 are installed by ensuring that locking members 2012 are rotated to the disengaged, unlocked position. Hooks 2058 at a first end of beam 2011 are then inserted into slots 2041 of a post 2006 to position beam 2011 at a desired vertical location. The first end of beam 2011 is then shifted downwardly to engage slots 2059 with bottom edges 2060 of slots 2041. Locking member 2012 is then rotated to the locked position such that flexible extension 2013 engages lock-engaging surface 2016 to securely and rigidly interconnect beam 2011 and post 2006. A second end of beam 2011 is then connected to another post 2006 in the manner just described.

Beam 2011 (as well as data and power troughs 2030, 2031) can be installed and removed from between a pair of posts 2006 along a mid point of an assembled partition without disassembly of adjacent panel frames. To install a beam 2011 between assembled panel frames, beam 2011 is angled upwardly (or horizontally outwardly), and hooks 2058 at a first end of beam 2011 are inserted into slots 2041 of a post 2006. A second end of beam 2011 is rotated downwardly (or horizontally inwardly), and hooks 2058 at the second end of beam 2011 are inserted into slots 2041 of another post 2006. If required, posts 2006 are shifted apart slightly to provide clearance during installation of beam 2011. Both ends of beam 2011 are shifted downwardly to engage hooks 2058 with slots 2041, and lock members 2012 are shifted to the locked position, as described above.

Figure 90:
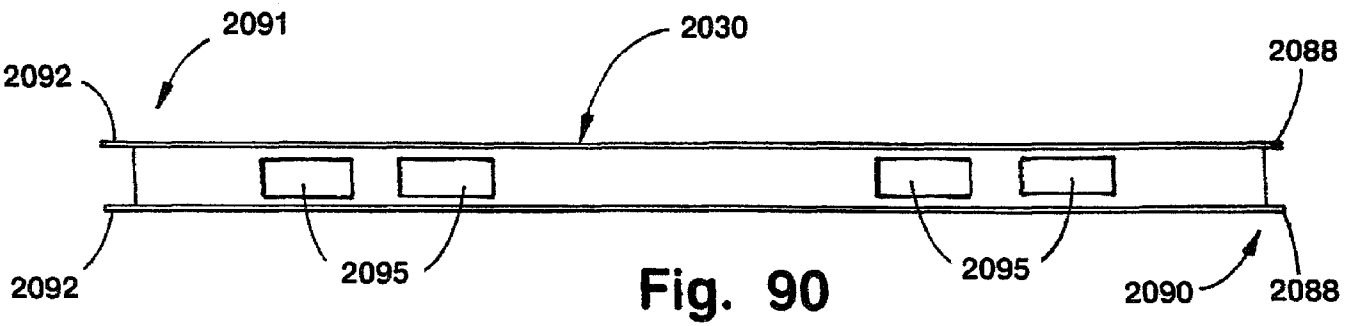
FIG. 90 is a top plan view of the data trough.
Figure 89:
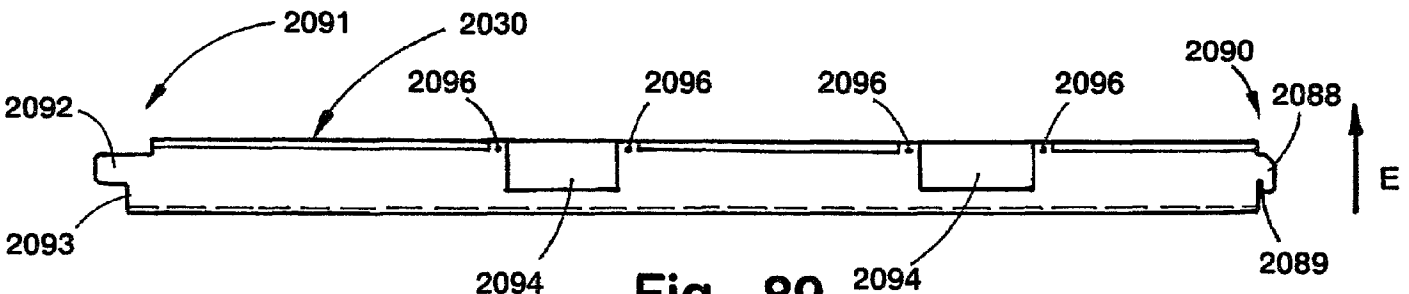
FIG. 89 is a front elevational view of the data trough.
Figure 91:
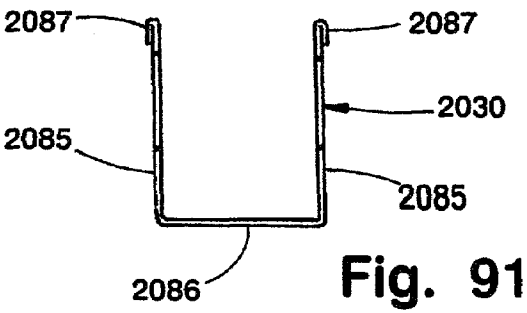
FIG. 91 is a side elevational view of the data trough.
Figure 93:
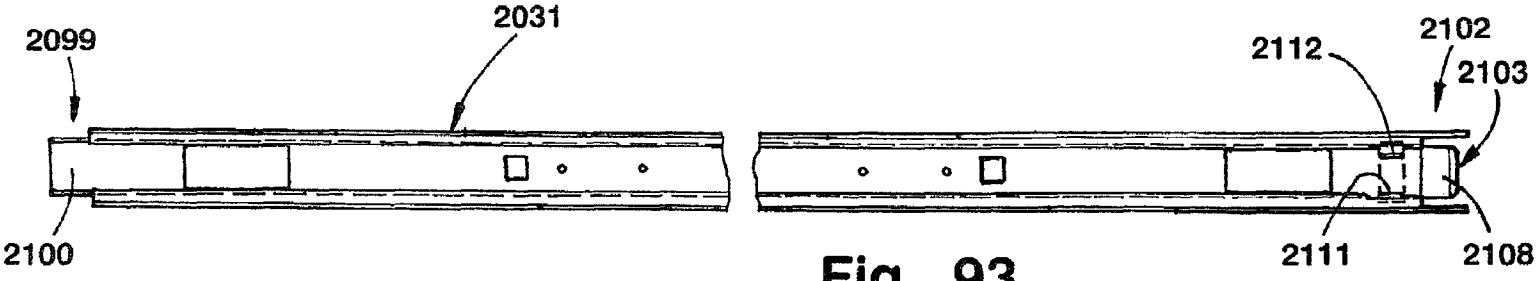
FIG. 93 is a fragmentary, top plan view of the power trough.
Figure 92:
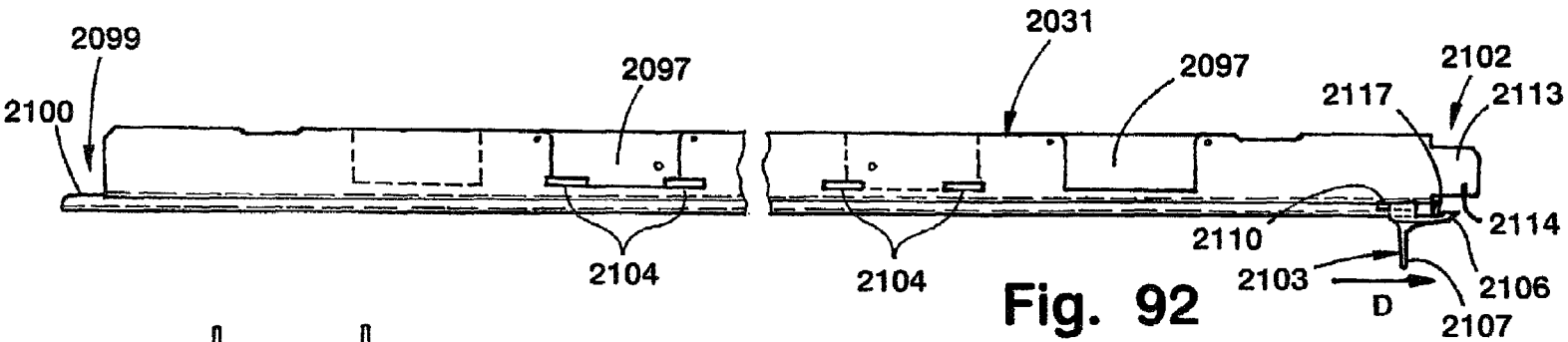
FIG. 92 is a fragmentary, front elevational view of the power trough.
Figure 94:
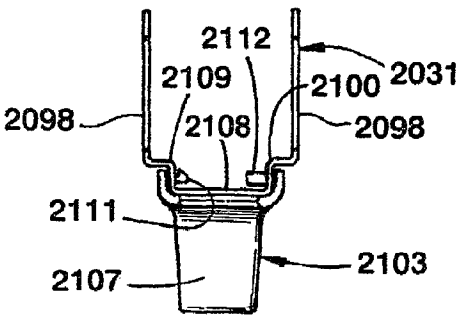
FIG. 94 is a side elevational view of the power trough.

Two types of utility troughs may be utilized for routing of data and power lines 2027, 2028. A data trough 2030 is illustrated in FIGS. 89-91, and a power trough 2031 is illustrated in FIGS. 92-94. Either trough may be used for routing of data or power lines 2027, 2028 within the trough. However, as discussed below, power trough 2031 includes a lock such as sliding wedge 2103 that rigidly connects the ends of the power trough 2076 to the posts 2006. Side forces are generated when a user plugs in or disconnects electrical lines from power boxes 2040. The locking arrangement of power trough 2076 permits mounting of power boxes 2040 and power lines 2028 below the power trough 2031.

With reference to FIG. 91, each data trough 2030 has a U-shaped cross-sectional shape with a bottom wall 2086 and upwardly-extending side walls 2085 that include a folded-over top edge 2087 for strength. Each data trough 2030 includes rectangular cutout portions 2094 and clearance holes 2096 in side walls 2085 for mounting data receptacles 2039, and rectangular apertures 2095 through bottom wall 2086 for vertical routing of data and power lines 2027, 2028 within the panel frame 2002. Each data trough 2030 also includes a pair of tabs 2088 (FIG. 89) and a slot 2089 forming a downwardly extending hook at a first end 2090. At a second end 2091, the data trough 2030 has a pair of tabs 2092 with a cut-back portion 2093. Cut-back portion 2093 provides clearance when the first end 2090 of the data trough is tipped upward in the direction of the arrow "E" (FIG. 89) during removal and installation of the data trough 2030 between a pair of posts 2006 when the panel frame 2002 is assembled (FIG. 75).

With reference to FIGS. 92-94, each power trough 2031 has a generally U-shaped cross-sectional shape, and includes cutout portions 2097 along the side walls 2098 for mounting data receptacles 2039 (FIG. 75). Each side wall 2098 of the power trough 2031 includes openings 2104 that receive barbed extensions 2105 of a power box 2040 (FIG. 75), for removably mounting power box 2040 below the power trough 2031. A first end 2099 of power trough 2031 includes an upwardly-opening U-shaped tab 2100 which is received in a U-shaped slot 2101 (FIG. 80) of a utility trough port 2025. A second end 2102 end of power trough 2031 includes a movable lock member such as sliding wedge 2103. Wedge 2103 is moved in the direction of the arrow "D" of FIG. 92 after tabs 2113 are positioned in slots 2115 of utility trough port 2025, thereby providing a secure connection that prevents movement of the power trough 2031 when an electrical line is plugged into the power receptacle 2040. Extension 2106 of wedge 2103 is closely received within the U-shaped slot 2101, and a downwardly-extending grip or handle portion 2107 that enables a user to slide the wedge 2103 as required during installation or removal of the power trough 2031. Power trough 2031 includes a bottom wall 2108 (FIG. 94), and a pair of smaller, offset lower side walls 2109. Each lower side wall 2109 includes a slot 2110 adjacent the second end 2102 of the power trough 2031. Sliding wedge 2103 includes support tabs 2111 and 2112 that are received within the slots 2110 to slidably mount the wedge 2103. When the sliding wedge 2103 is inserted into the U-shaped slot 2101, the upper surface 2117 of the sliding wedge 2103 contacts the upper edge 2116 of the U-shaped slot 2101, thereby generating a downward force on the second end 2102 of the power trough 2031. The downward force generated by the sliding wedge 2103 insures that the slots 2114 securely and rigidly engage the lower edge 2118 of the tapered slots 2115. Slots 2114 of tabs 2113 as well as slots 2115 could be tapered to ensure that power trough 2031 is rigidly interconnected with posts 2006 when assembled. In this configuration, slots 2114 have a wider opening than base portion, and slots 2115 are wider at upper edge 2121 than lower edge 2118 (see also FIG. 80).

As best seen in FIG. 75, the data trough 2030 may be installed by inserting tabs 2092 at the second end 2091 into the slots 2115 of utility trough port 2025 of a post 2006. The first end 2090 of the data trough 2030 is then rotated downwardly until the tabs 2088 are aligned with the slots 2115 of a corresponding utility trough port 2025 on the other post 2006. The data trough 2030 is then shifted in the direction of the first end 2090 (up and left in FIG. 75) to insert the tabs 2088 into the slots 2115. First end 2090 is then shifted downwardly to engage slots 2089 onto lower edges 2118 of slots 2115. Slots 2089 could also be tapered with a wider opening portion than base portion to ensure a secure, rigid interconnection between data trough 2030 and post 2006. Alternatively, data trough 2030 may also be installed by inserting tabs 2092 into slots 2115 with the data trough angled outwardly. Data trough 2030 is then rotated horizontally inward until tabs 2088 are aligned with the slots 2115 of a corresponding utility trough port 2025 on the other post 2006. Data trough 2030 is then shifted in the direction of the first end 2090 to insert tabs 2088 into slots 2115.

Figure 98:
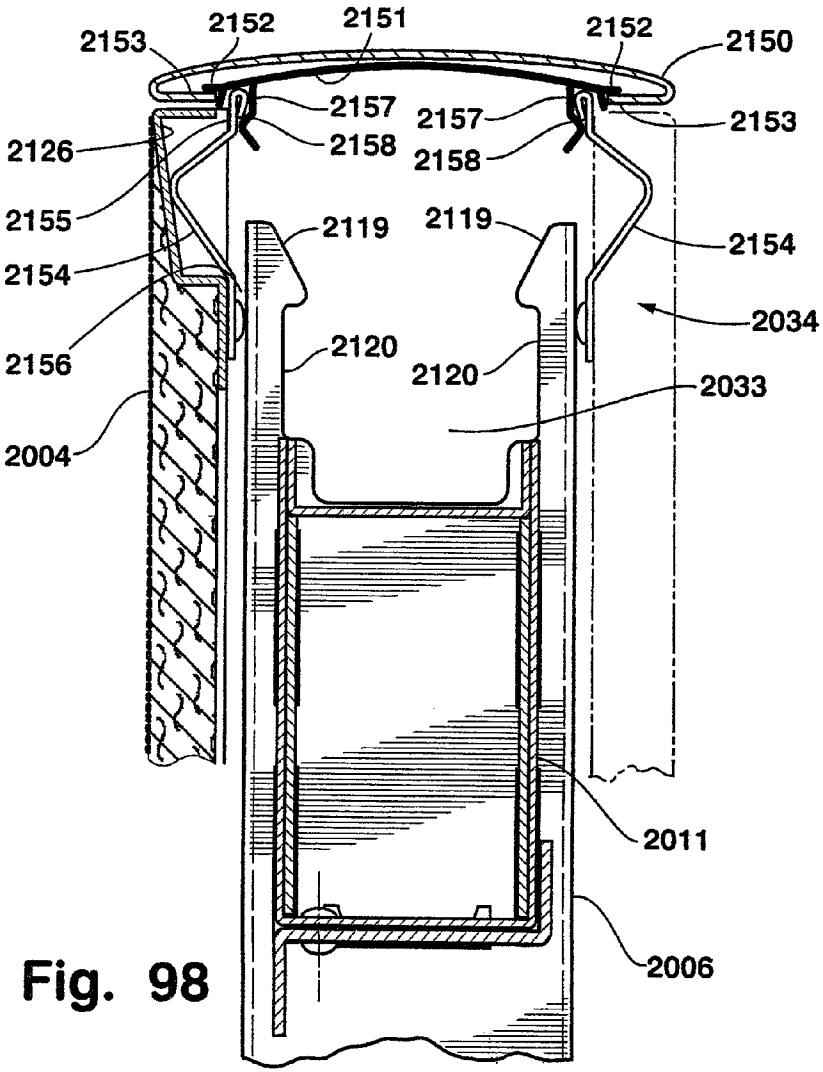
FIG. 98 is a fragmentary, side elevational view of the top portion of the assembled knock-down portable partition showing the top cap installed on the light seal of the cover panels.

With reference to FIG. 98, each of the upper utility ports 2033 include tapered upper edges 2119 and notched portions 2120. During installation of the upper data troughs 2030, the tabs 2088 and 2092 are pushed downward along the tapered edges 2119 and snap into the notched portions 2120.

Power troughs 2031 are installed in a similar manner as a data trough 2030. The tab 2100 at the first end 2099 of a power trough 2031 is inserted into a U-shaped slot 2101 of a utility trough port 2025 (FIG. 80). The second end 2102 of the power trough 2031 is then rotated downwardly until the tabs 2113 are aligned with the slots 2115 of a utility trough port 2025. The power trough 2031 is then shifted in the direction of the second end 2102 such that tabs 2113 are received in slots 2115. Power trough 2031 is then shifted downwardly to engage slots 2114 on the lower edge 2118 of the slots 2115. The sliding wedge 2103 is then shifted in the direction of the arrow D (FIG. 92) until the extension 2106 is received within the U-shaped slot 2101 of the utility trough port 2025. Power trough 2031 may also be installed by inserting tab 2100 and rotating second end 2102 horizontally inwardly. Power trough 2031 is then shifted in the direction of second end 2102 to insert tabs 2113 into slots 2115. Second end 2102 of power trough 2031 is then shifted downwardly to engage slots 2114 on lower edge 2118 of slots 2115.

Figure 96:
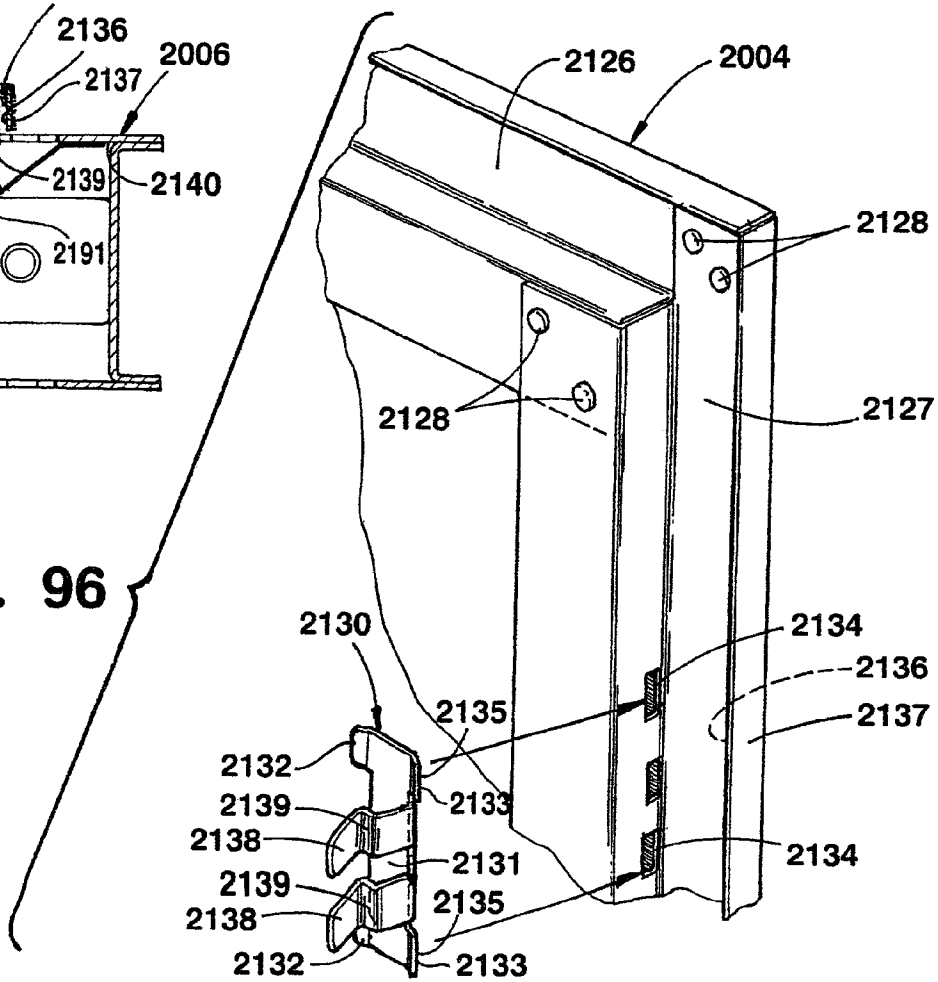
FIG. 96 is a fragmentary, perspective view of the cover panel showing the mounting of the cover retaining clips.
Figure 95:
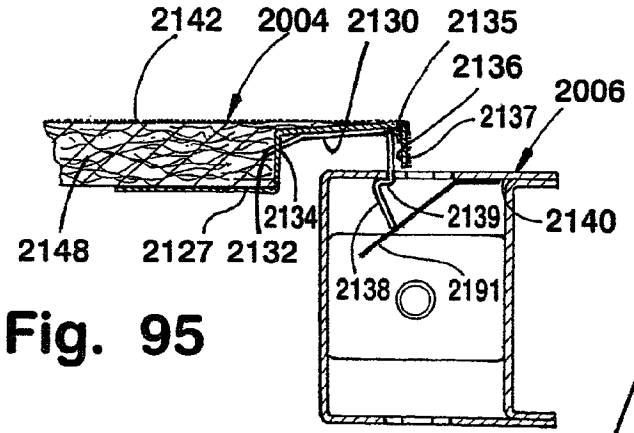
FIG. 95 is a fragmentary, top plan view of a vertical post showing the cover panel mounting clip engaging cover mounting apertures.

With reference to FIGS. 95 and 96, each cover panel 2004 includes a perimeter frame 2125 with horizontal numbers 2126 and vertical numbers 2127 that are "toggle locked" together at 2128. Clips 2130 are formed from spring steel, and have a generally flat body portion 2131 with angled inner tabs 2132 and outer tabs 2133. Clips 2130 are installed on cover panel 2004 by inserting tabs 2132 into openings 2134 in the vertical member 2127. The clip is then pushed inwardly such that outer edges 2135 of outer tabs 2133 abut the inner surface 2136 of the outer flange 2137 of the vertical member 2127. During installation the cover panel 2004, the flexible arms 2138 are inserted into the openings 2045 of posts 2006 (see also FIG. 80), such that transverse portion 2139 of each flexible arm 2138 abuts an inner surface 2140 (FIG. 95) of the post 2006. Openings 2045 include notched sides 2141 (see also FIG. 80) that receive flexible arms 2138 of clip 2130, such that the center portion of the opening 2045 provides a vertical slot 2017 for mounting hang-on accessory units. As best seen in FIG. 83, openings 2045 are located at evenly-spaced vertical increments, such that a plurality of segmented cover panels can be installed in a vertically juxtaposed relationship to one another (see FIG. 73). Each cover 2004 includes an outer decorative fabric layer 2142 (FIG. 95) and an acoustic layer 2143 which may be made from a fiberglass mat or other suitable material.

Figure 97:
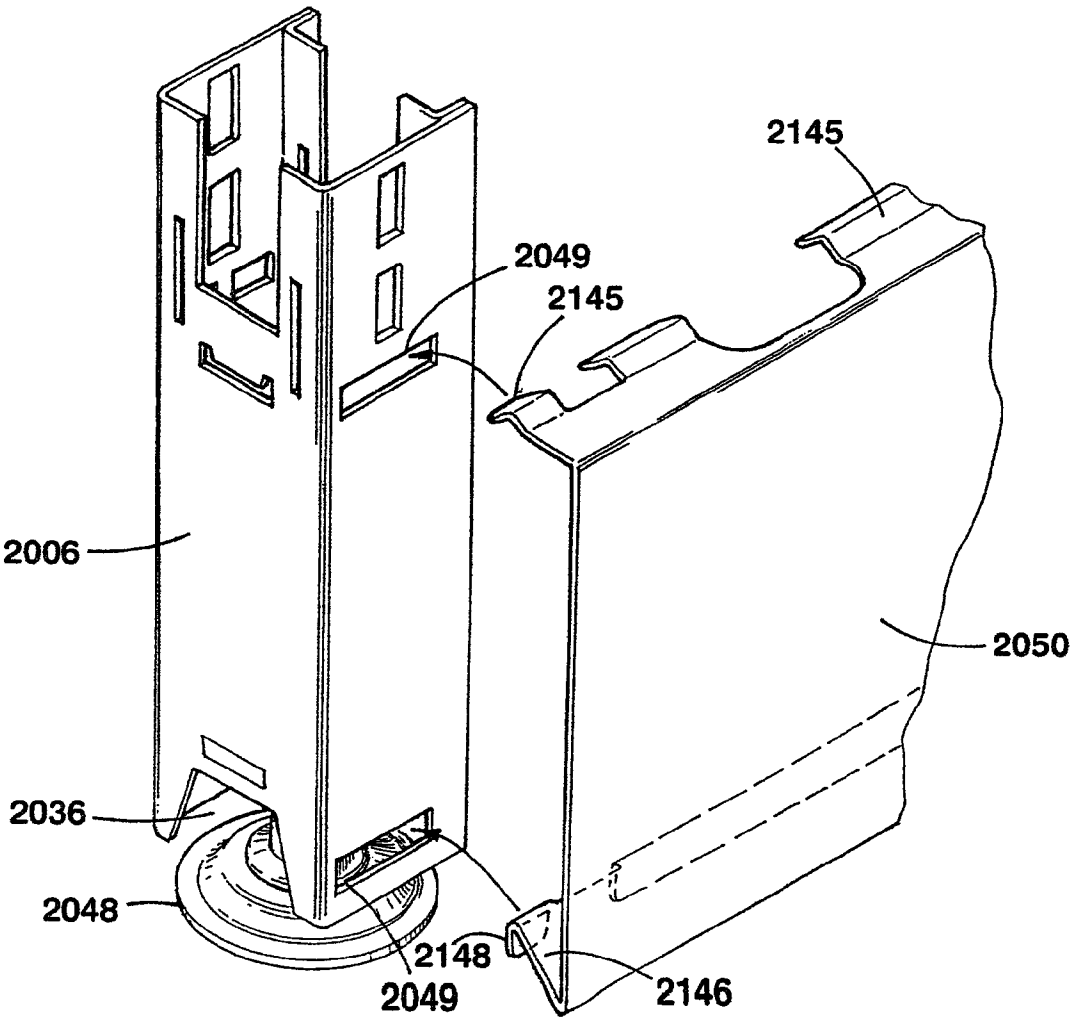
FIG. 97 is a fragmentary, perspective view showing the base cover and mounting tabs.
Figure 101:
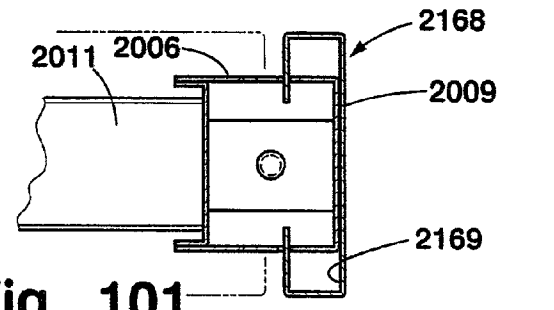
FIG. 101 is a fragmentary, top plan view of an end-of-run post with an end cover installed.

With reference to FIG. 97, base cover 2050 is roll-formed from sheet metal and includes an upper flange 2145 and a lower flange 2146. An upper tab 2147 at each end of the upper flange 2145 engages an opening 2049 in post 2006, and a lower tab 2148 engages an opening 2049 to retain the base cover 2050 to the post 2006. A cutout 2149 in upper flange 2145 provides clearance for vertical routing of data or power lines 2027, 2028.

With reference to FIG. 98, a light block 2154 extends along the upper edge of each cover panel 2004. The light block 2154 is secured to the upper horizontal flange member 2126 by fasteners 2156, and includes an upwardly-extending upper flange portion 2155 with a bent-back edge 2157. Top cap retaining clip 2151 includes outer arms 2152 that engage inner edges 2153 of top cap 2150. Top cap 2150 is retained to the light blocks 2154 by a pair of flexible, downwardly-extending arms 2158 of clip 2151. During installation, the upwardly-extending flange 2155 of light block 2154 is inserted behind the lower edge of the cover panel directly above the cover panel being installed, thereby preventing light from passing through the horizontal joint 2159 (FIG. 73) between the cover panels 2004.

Figure 99:
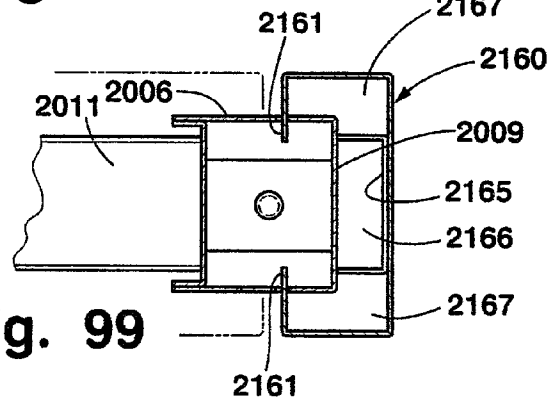
FIG. 99 is a fragmentary, top plan view of an end-of-run post with a change-of-height end cover installed.

With reference to FIG. 99, a change-of-height end cover 2160 includes slotted tabs 2161 which engage the cutouts 2162 at the top of a vertical row of slots 2017 to cover the post 2006. After the slotted tabs 2161 are engaged, the lower end 2163 of the end cover 2160 is pushed over the lower end 2008 of the post 2006 to frictionally engage tab portions 2125 against the front face 2032 of post 2006. The end cover 2160 includes at least one U-shaped brace 2165 that offsets the end cover 2160 to provide vertical passages 2166, 2167 (FIG. 99) for data and power lines 2027 and 2028. An end-of-run cover 2168 (FIG. 101) is similar to the change-of-height end cover 2160, except that inner surface 2169 of end-of-run cover 2168 abuts the side face 2009 of post 2006.

Figure 102:
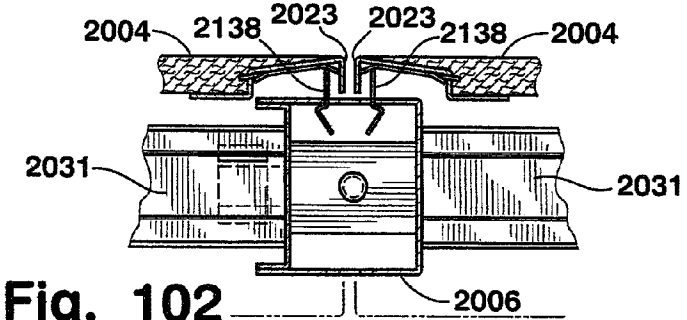
FIG. 102 is an intermediate post with cover panels installed on a front face, and power troughs installed on the opposite side faces.
Figure 105:
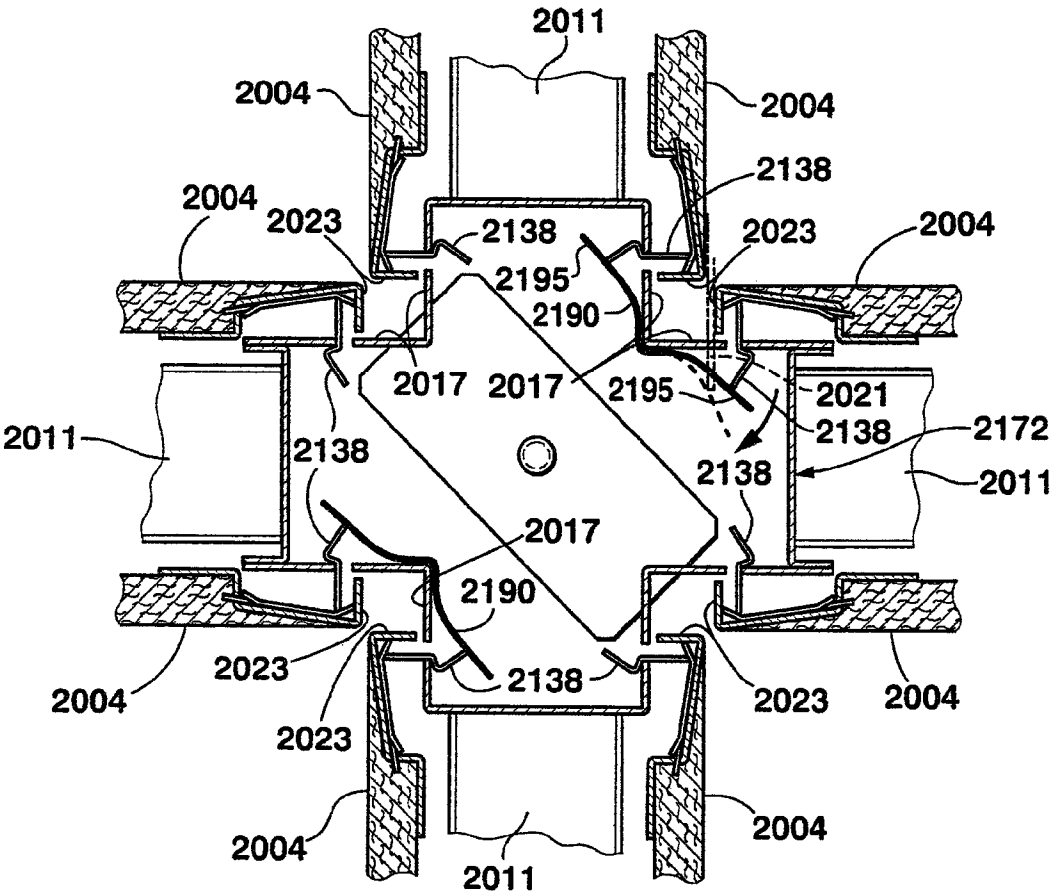
FIG. 105 is a fragmentary, top plan view of a X-post.
Figure 108:
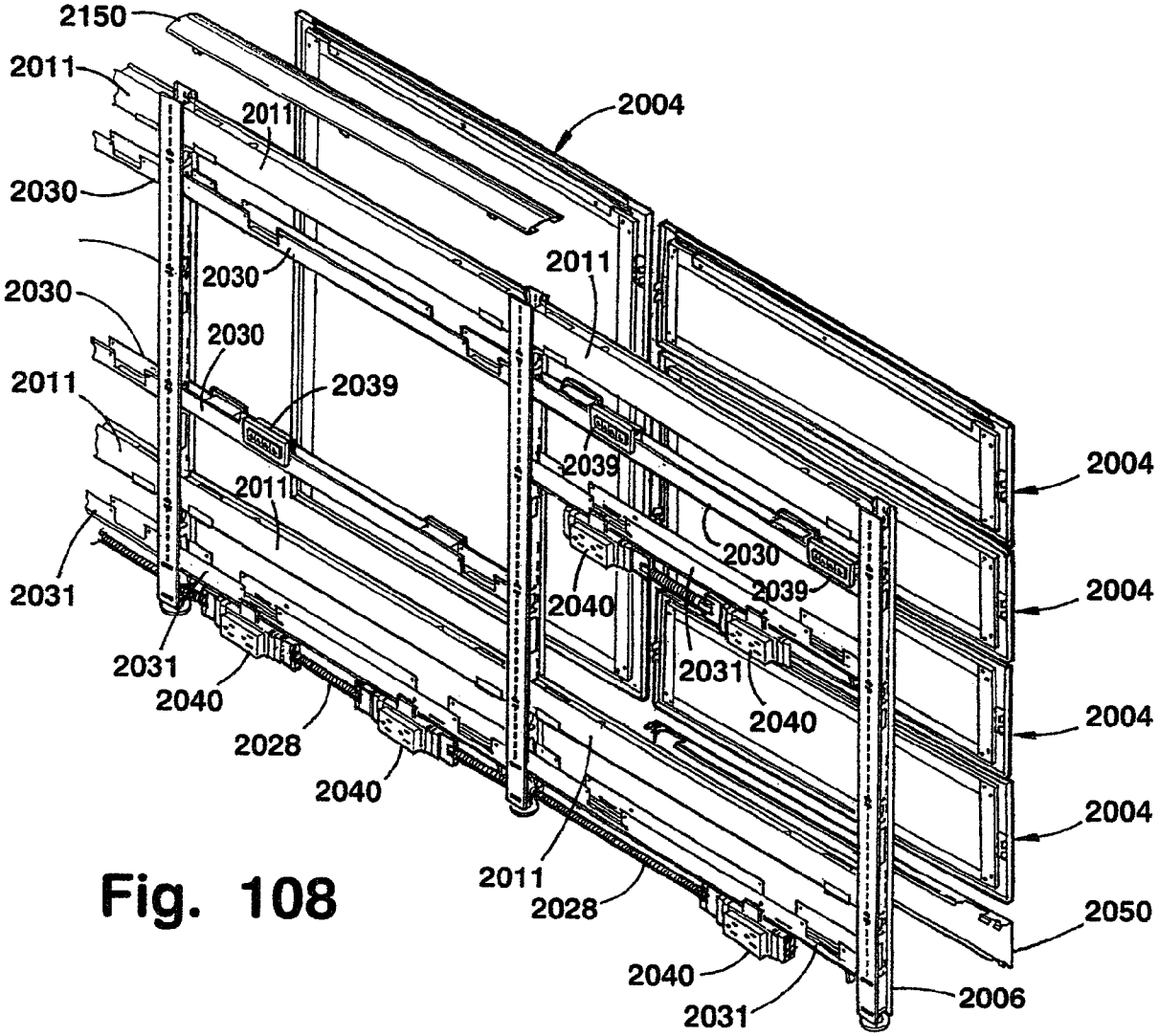
FIG. 108 is a fragmentary, exploded perspective view of the partition system showing the data and power lines and receptacles.

Partition system 2001 may include an in-line/end-of-run post 2006 (FIG. 102), an L-post 2170 (FIG. 103), a T-post 2171 (FIG. 104), and an X-post 2172 (FIG. 105). The in-line/end-of-run post 2006 may be used at either an end-of-run location with an end cover 2160, or at an intermediate, in-line location as illustrated in FIG. 102. All of the post configurations have a single foot 2046, and also have side faces with a plurality of beam connection ports 2010 and utility trough ports 2025 with substantially the same configuration as the in-line post 2006. In addition, each of the posts include vertical rows of slots 2017 for supporting hang-on accessory units. As described in more detail below, a flexible light seal 2190 or 2191 is adhesively secured inside each post to cover slots 2017.

Figures 100, 106, 107:
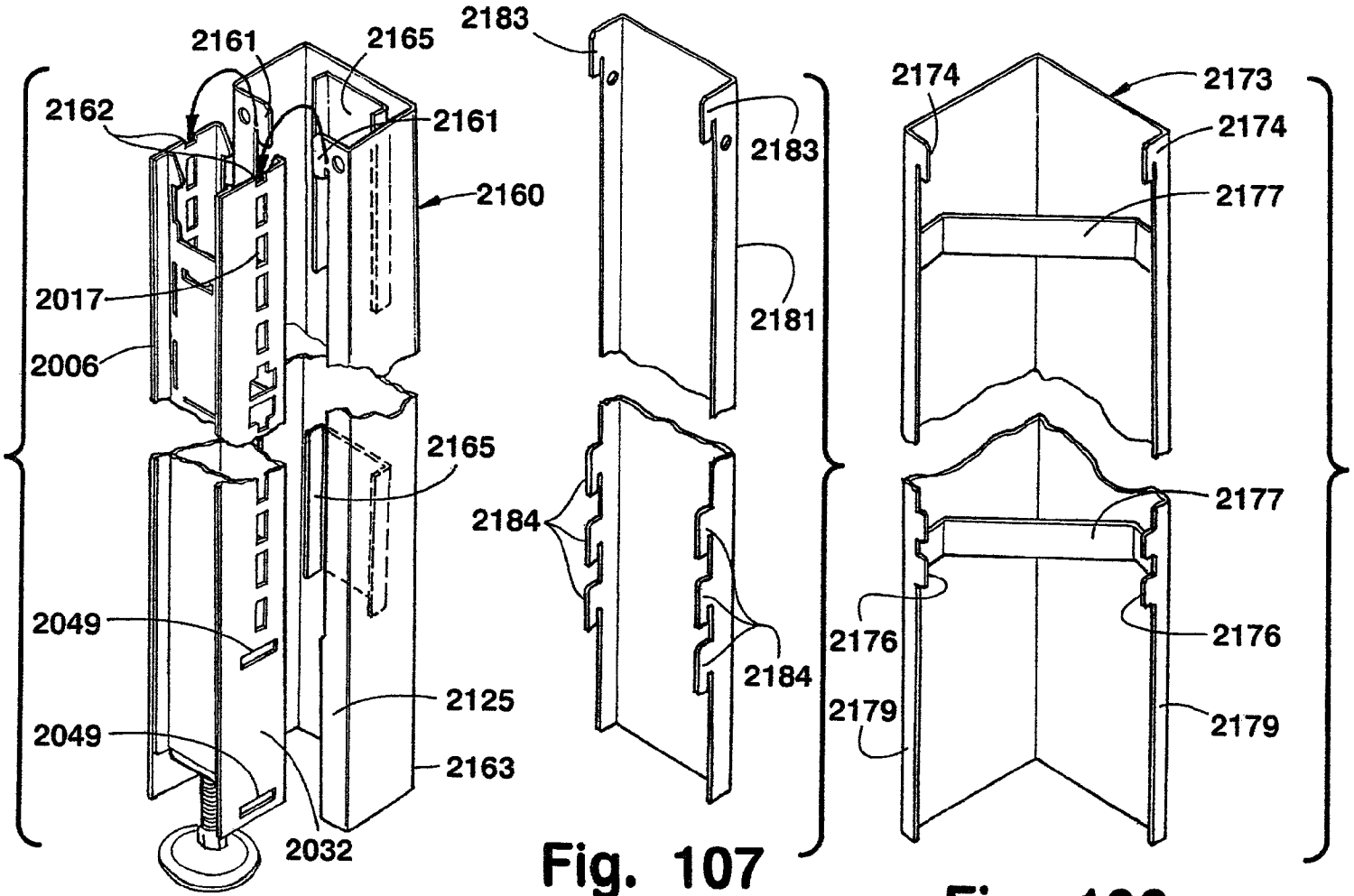
FIG. 100 is a fragmentary, perspective view showing an end cover and vertical, end-of-run post.
FIG. 106 is a fragmentary, perspective view of an L-cover.
FIG. 107 is a fragmentary, perspective view of a T-cover.
Figure 104:
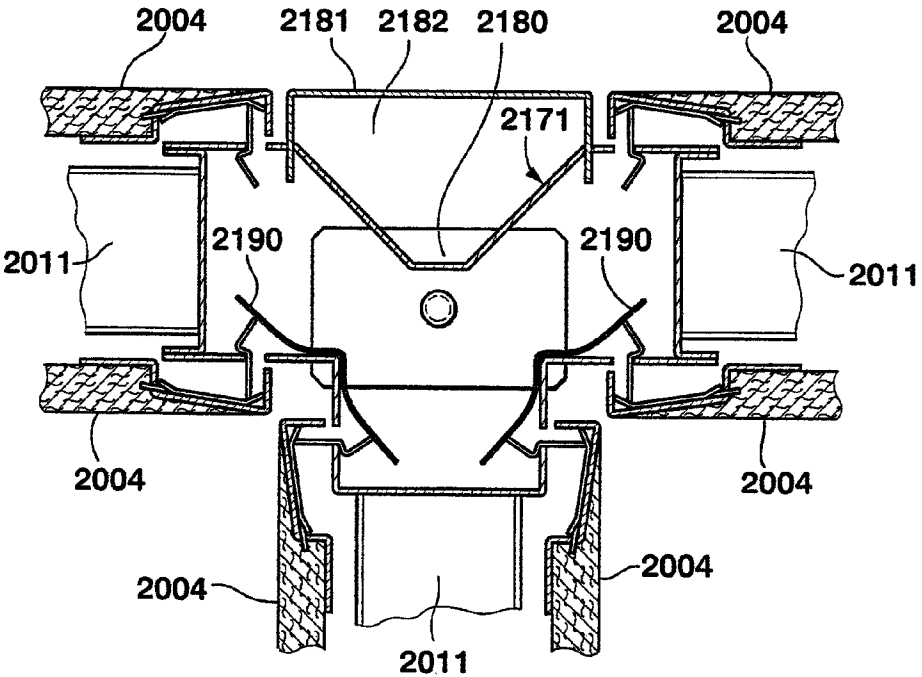
FIG. 104 is a fragmentary, top plan view of a T-post and cover.
Figure 103:
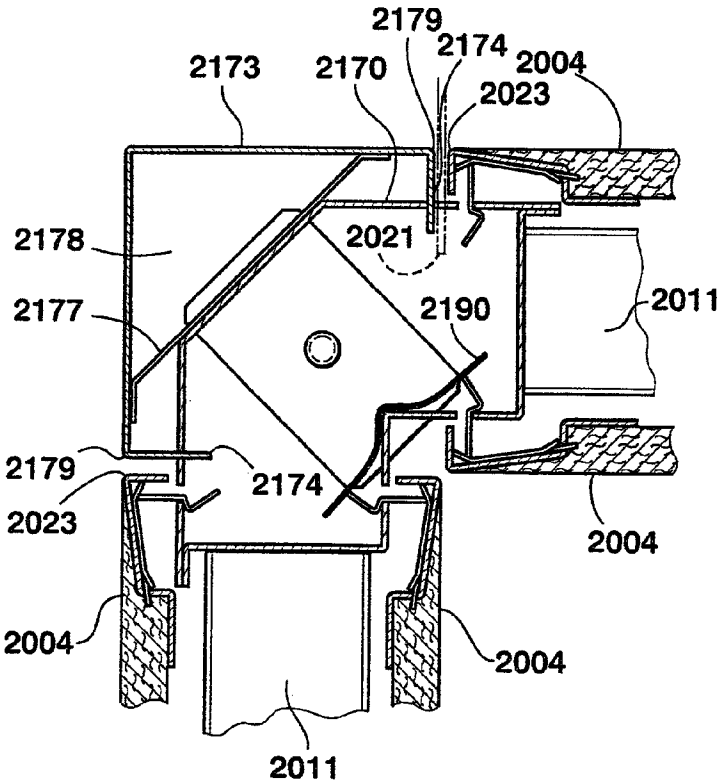
FIG. 103 is a fragmentary, top plan view of an L-post and cover.

Each L-post 2170 (FIG. 103) may be covered by an L-cover 2173 (FIG. 106). L-cover 2173 includes hooks 2174 for engaging slots 2175 at the upper end of L-post 2170. Each L-cover 2134 also includes tabs 2176 that engage the vertical row of slots 2017 to retain the lower end of L-cover 2173. Braces 2177 provide rigidity at the upper and lower ends of the L-cover 2173. The L-cover 2173 provides a vertical passage 2178 that may be utilized for vertical routing of data and power lines 2027, 2028. Side edges 2023 of covers 2004 are spaced-apart from side edges 2179 such that hang-on binder bins or other accessories may be hung from the vertical row of slots 2017.

T-post 2171 (FIG. 104) includes a recessed portion 2180, which, in combination with the T-cover 2181 (FIG. 107), provides a vertical passage 2182 for vertical wiring of power or communications cabling. T-cover 2181 includes upper and lower hooks 2183, 2184 that engage slots 2017.

With reference to FIG. 105, an X-post 2172 has a generally X-shaped plan configuration for joining four panel frames 2002 in an X formation. Side edges 2023 of cover panels 2004 are spaced-apart to provide clearance to mount hang-on accessory units from slots 2017.

Figure 109:
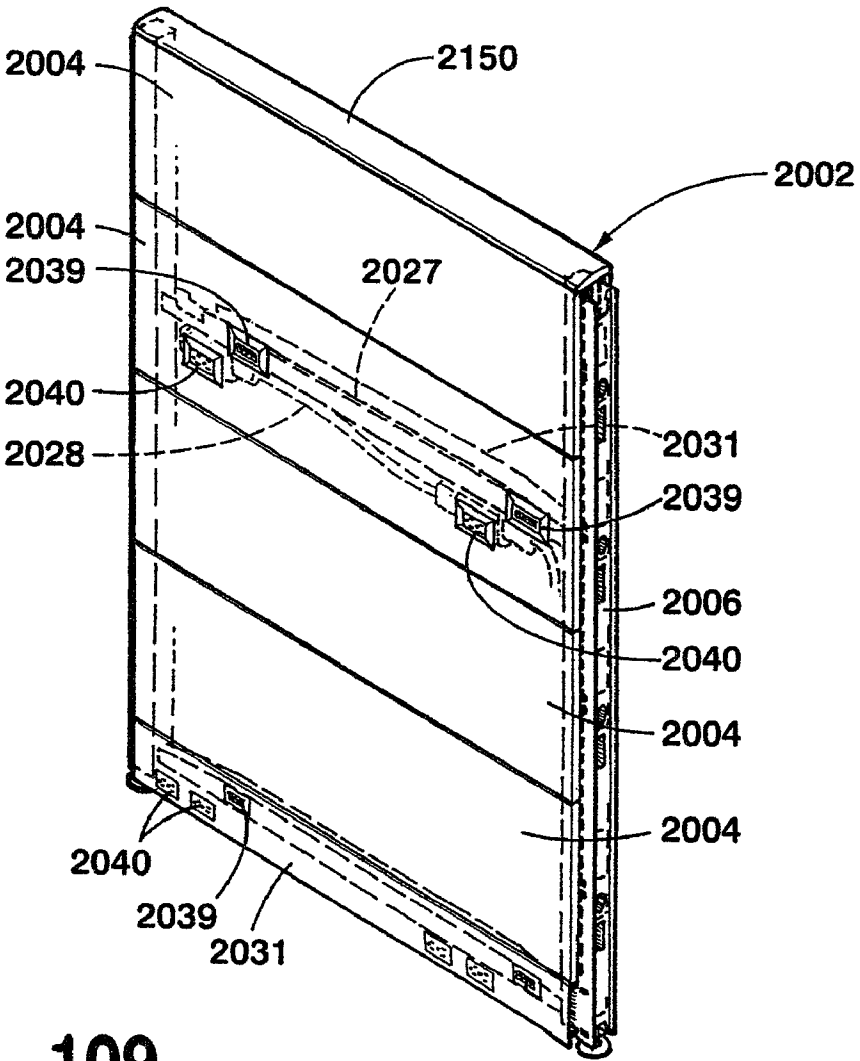
FIG. 109 is a perspective view of an individual panel section showing the data and power receptacles at the base and beltway heights.

With reference to FIG. 106, the data and power troughs 2030 and 2031 provide a flexible, easily installed system for support of data and power lines 2027 and 2028, and data and power receptacles 2039, 2040. Data and power lines 2027, 2028 may be routed vertically through the apertures in the utility troughs and beams. As illustrated in FIG. 109, a single power trough 2031 mounted at a beltway level may provide for both data receptacles 2039 and power receptacles 2040. Data lines 2027 are routed within power trough 2031, and power conduits 2028 are routed below power trough 2031. The base covers 2050 are also cut out for mounting data and power receptacles 2039 and 2040 at the base of the panel.

Flexible light seal 2190 (FIG. 110) is made from a non-translucent thin polymer sheet such as LEXAN polycarbonate, available from General Electric Co., Schenectady, N.Y. The polycarbonate sheet is scored on line 2192. Adhesive 2193 is disposed on inner surface 2195 of base portion 2196 on each side of the scored line 2192. Adhesive 2193 secures the light seal 2190 to an inner corner of L-post 2170, T-post 2171 or X-post 2172. Light seal 2190 flexes along score line 2192 to conform to the inner surface of the post. Base portion 2196 of the light seal 2190 is secured to the inner surface of the post, and flaps 2195 extend over the adjacent vertical row of slots 2017, such that upon insertion of the hooks 2021 of a hang-on accessory unit, or flexible arm 2138 of cover panel clips 2130, the flap 2195 deflects inwardly (FIG. 105). Light seal 2190 prevents passage of light between adjacent work areas through the partition system 2001.

Another type of flexible light seal 2191 (FIG. 111) is used to cover vertical rows of slots 2017 of an end-of-run post 2006. Adhesive 2193 is applied to the base portion 2196, and flap 2195 extends over the adjacent rows of slots 2017. Light seal 2191 may be scored at 2192 such that flap 2195 flexes along score line 2192 upon insertion of hooks 2021 or arm 2138 of clips 2130. After the adhesive 2193 is applied to the inner surface 2194 of a light seal 2190 or 2191, the light seal is inserted into the post with the adhesive facing upwardly. The light seal 2190 or 2191 is then turned over, and positioned with the flap or flaps 2195 over the vertical rows of slots 2017. Force is then applied to the light seal 2190 or 2191 to securely bond the light seal to the inner surface of the post.

Figure 112:
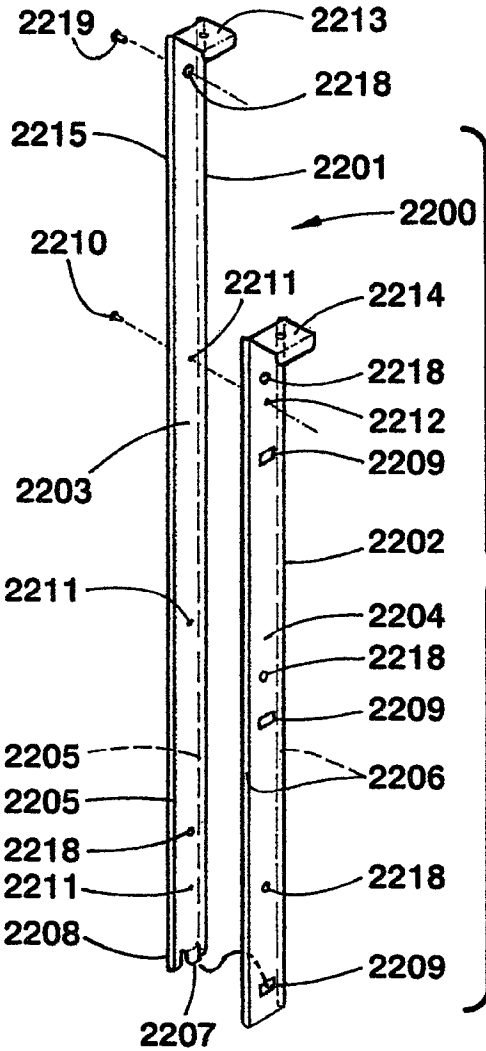
FIG. 112 is an exploded perspective view of an longitudinally extensible cover panel brace.
Figure 111:
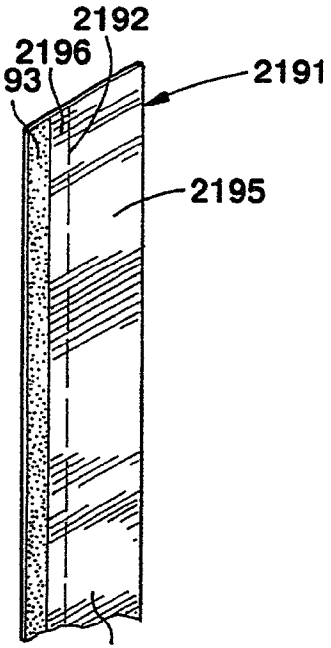
FIG. 111 is a fragmentary, perspective view of a light seal used with end-of-run posts.
Figure 110:
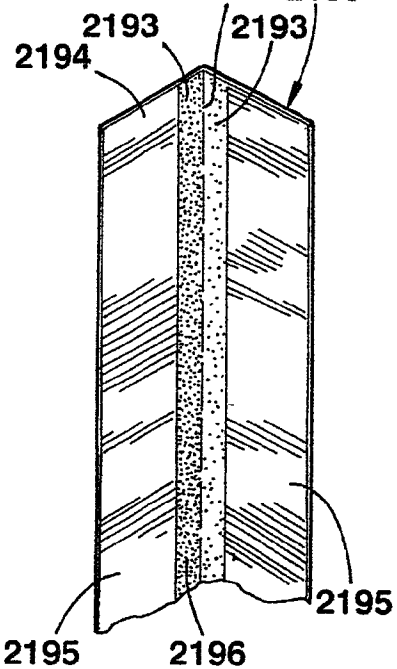
FIG. 110 is a fragmentary, perspective view of a light seal for X, L, and T-posts.
Figure 113:
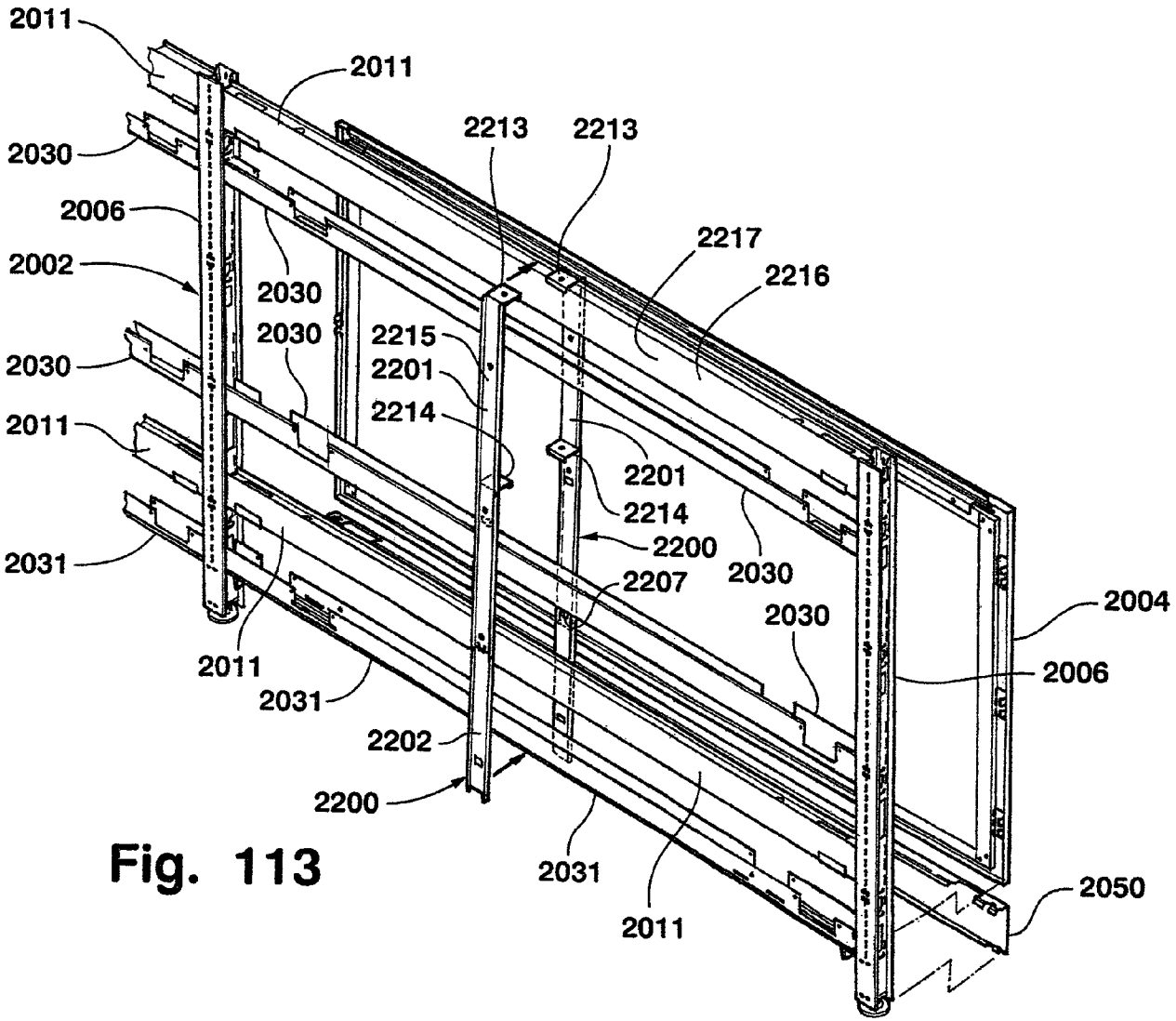
FIG. 113 is a fragmentary, exploded perspective view of the partition system showing the installation of the cover panel brace.

With reference to FIGS. 112 and 113, a longitudinally extensible cover panel brace 2200 includes an upper member 2201 and a lower member 2202. Upper and lower members 2201, 2202 include vertically elongated main sections 2203 and 2204 having a U-shaped cross section with side flanges 2205 and 2206. Elongated section 2203 of upper member 2201 fits within the elongated section 2204 of the lower member 2202, and a tab 2207 adjacent the lower end 2208 of upper member 2201 is received within a selected opening 2209 in lower member 2202. A screw or other fastener 2210 fits through a selected clearance hole 2211 in upper member 2201, and is received within threaded opening 2212 in lower member 2202. Upper member 2201 includes a downwardly-opening hook-shaped extension 2213 that fits over a beam 2011 when the cover panel brace 2200 is installed on the panel frame 2002. Lower hook-shaped extension 2214 permits lower member 2202 to hang from a beam 2011 for the lowest height panel frame 2002.

Posts 2006 may have different heights, such that the height of panel frame 2002 varies. To accommodate variations in panel height, the cover panel brace 2200 can be adjusted by inserting the tab 2207 into the selected opening 2209 to change the vertical length of cover panel brace 2200 to correspond to the height of the panel frame 2002. After the cover panel brace 2200 is adjusted to the correct length, hook-shaped extension 2213 is placed over a beam 2011, such that the cover panel brace 2200 hangs from the beam 2011. The cover panels 2004 are then installed over the cover brace 2200, with the rear surface 2215 of the cover panel brace 2200 abutting the inner surface 2217 of the cover panel 2004. Brace 2200 is installed between a pair of posts to prevent excessive flexing of a center portion 2216 of a cover panel 2004 if a force is applied to the outer surface of the cover panel 2004. Cover panel brace 2200 is useful for relatively narrow, elongated, or "segmented" cover panels 2004 (FIG. 74), particularly when the posts 2006 are spaced-apart for wider panels, such as 2072 inch wide panels. Cover panel brace 2200 maintains the alignment between cover panels 2004 along the horizontal joint 2159 between adjacent cover panels. Although light block 2154 (FIG. 98) will prevent a gap at horizontal joint 2159 if a force is applied to the upper cover panel, if a cover panel brace 2200 is not used, a force applied to the lower cover panel will cause the lower cover panel to flex inwardly, creating a gap at joint 2159. Cover panel brace 2200 prevents this misalignment and resulting gap at horizontal joint 2159. A data or power trough 2030, 2031 is located at a mid-panel height to provide additional stiffness. Cover panel brace 2200 abuts the mid-height data or power trough, thereby preventing inward flexing of cover panel brace 2200.

If cover panels 2004 have a construction requiring a thinner brace 2200, elongated sections 2203 and 2204 can be constructed to have a flat cross-sectional shape. Hook-shaped extensions 2213 and 2214 are eliminated in this embodiment, and fasteners 2219 are received in clearance holes 2218 to secure cover panel brace 2200 to the sides of beams 2011.

The knock-down portable partition system 2001 of the present invention provides a flexible, easily shipped and assembled system having capability for handling a wide range of power and communications cabling needs. Panel frame 2002 is simple and quickly assembled, yet provides sufficient structural strength for support of hang-on accessories such as binder bins 2019, work surfaces 2020, and lower file storage units 2022. Each post utilizes a single foot for support, thereby simplifying the vertical adjustment of the panel frame 2002. The beams 2011 and the data and power troughs 2030, 2031 may be removed from between a pair of vertical posts while the adjacent panel frames 2002 are in an assembled condition. Cover panels 2004 are easily removed and installed and provide an acoustic, sound-absorbing layer.

It will become apparent to those skilled in the art that various modifications to the preferred embodiment of the invention as described herein can be made without departing from the spirit or scope of the invention as defined by the appended claims.

The invention claimed is:

1. A freestanding partition construction, comprising:

a pair of spaced-apart upright frame members and a pair of horizontal frame members extending between and rigidly interconnecting the upright frame members to define an enlarged quadrilateral central frame opening, the upright frame members defining utility trough support surfaces;

at least one cover panel removably mounted to the panel frame and extending across at least a substantial portion of the central frame opening; and at least one utility trough disposed in the enlarged central frame opening and having a central portion having a U-shaped cross-sectional shape, and first and second connectors at first and second opposite ends, respectively, of the utility trough engaging the upright frame members and supporting the utility trough, wherein the first connectors comprise a pair of extensions having downwardly-opening slots, and the second connectors comprise a pair of extensions having substantially continuous lower surfaces supporting the second end of the utility trough and permitting horizontal sliding of the second end of the utility trough on the utility trough support surfaces.

2. The freestanding partition of claim 1, wherein:

the upright frame members include side faces defining vertical sides of the enlarged central frame opening; and wherein:

the utility trough support surfaces are formed on the side faces.

3. The freestanding partition of claim 2, wherein:

the utility trough support surfaces comprise edges of openings in the side faces of the upright frame members.

4. The freestanding partition of claim 1, wherein:

the upright frame members have openings therethrough adjacent the first and second opposite ends of the utility trough to permit routing of utility lines along the utility trough and through the upright frame members.

5. The freestanding partition of claim 1, wherein:

the utility trough includes upright side webs and a horizontal base web extending between the side webs; and wherein:

the extensions of the first and second connectors comprise integral end portions of the side webs.

6. The freestanding partition of claim 5, wherein:

the base web includes at least one aperture therethrough to permit vertical routing of utility lines through the utility trough.

7. The freestanding partition of claim 1, wherein:

the upright frame members and the horizontal frame members have a tubular construction having a rectangular cross-sectional shape.

8. The freestanding partition of claim 1, wherein:

the horizontal frame members include movable lock members mounted on opposite ends that releasably engage the upright frame members to permit disassembly of the panel frame.

9. The freestanding partition of claim 1, wherein:

the upright frame members include a plurality of utility trough connection ports, each including utility trough support surfaces to permit the utility trough to be connected to the frame at a plurality of different heights.

10. A freestanding partition construction, comprising:

at least two generally upright frame members that are horizontally spaced apart, each upright frame member having at least one utility trough port therethrough for passing utility conduits through the upright frame members;

at least two generally horizontal frame members extending between the upright frame members with opposite end portions of the horizontal frame members rigidly connected to the upright frame members to define a rigid panel frame having a substantially open interior;

at least one cover panel removably mounted to the panel frame to provide access to the open interior thereof;

at least one utility trough shaped to receive and retain utility conduits therein, and having threadless connectors at opposite ends thereof detachably connecting the utility trough to the upright frame members adjacent the utility trough ports, wherein the connectors are fixed to the utility trough and connect and disconnect the utility trough to the upright frame members upon movement of the utility trough relative to the upright frame members; and wherein:

the upright frame members define sidewalls, and the utility trough ports each include at least one opening through the sidewalls defining an edge comprising;

an upwardly facing lower edge of the opening; and wherein:

the utility trough includes at least one hook-shaped connector at a first end of the utility trough, wherein at least a portion of the hook-shaped connector is received in the opening and engages the edge and the one hook-shaped connector opens downwardly.

11. A freestanding partition construction, comprising:

at least two generally upright frame members that are horizontally spaced apart, each upright frame member having at least one utility trough port therethrough for passing utility conduits through the upright frame members, wherein the upright frame members define sidewalls, and the utility trough ports each include at least one opening through the sidewalls defining an edge;

at least two generally horizontal frame members extending between the upright frame members with opposite end portions of the horizontal frame members rigidly connected to the upright frame members to define a rigid panel frame having a substantially open interior;

at least one cover panel removably mounted to the panel frame to provide access to the open interior thereof;

at least one utility trough shaped to receive and retain utility conduits therein, and having threadless connectors at opposite ends thereof detachably connecting the utility trough to the upright frame members adjacent the utility trough ports, wherein the connectors are fixed to the utility trough and connect and disconnect the utility trough to the upright frame members upon movement of the utility trough relative to the upright frame members, wherein the utility trough includes at least one hook-shaped connector at a first end of the utility trough, wherein at least a portion of the hook-shaped connector is received in the opening and engages the edge; and wherein:

the utility trough includes a pair of projections at a second end of the utility trough, the projections having a generally smooth horizontal lower edge surface to permit the utility trough to slide horizontally while the second end is supported on the lower edge surface.

12. A freestanding partition construction, comprising:

at least two generally upright frame members that are horizontally spaced apart, each upright frame member having at least one utility trough port therethrough for passing utility conduits through the upright frame members;

at least two generally horizontal frame members extending between the upright frame members with opposite end portions of the horizontal frame members rigidly connected to the upright frame members to define a rigid panel frame having a substantially open interior;

at least one cover panel removably mounted to the panel frame to provide access to the open interior thereof;

at least one utility trough shaped to receive and retain utility conduits therein, and having threadless connectors at opposite ends thereof detachably connecting the utility trough to the upright frame members adjacent the utility trough ports, wherein the connectors are fixed to the utility trough and connect and disconnect the utility trough to the upright frame members upon movement of the utility trough relative to the upright frame members; and wherein:

the utility trough defines first and second opposite ends, and the utility trough is configured to permit mounting of the utility trough between the upright frame members by positioning the second end of the trough in engagement with a utility trough port, followed by downward rotation of the first end of the utility trough until the first end is aligned with a utility trough port, followed by horizontal shifting of the utility trough to engage the first end with the utility trough port.

13. The freestanding partition construction of claim 12, wherein:

the fast end of the utility trough includes a pair of hook-shaped connectors, and the second end of the utility trough includes a pair of extensions having straight lower surfaces.

14. The freestanding partition construction of claim 13, wherein:

the utility trough ports include enlarged central openings configured to receive utility conduits to route utility lines through the upright frame members, and vertically elongated slots on opposite sides of the central openings; and wherein:

the hook-shaped connectors and the extensions are received in the vertically elongated slots.

15. A freestanding partition construction, comprising:

at least two generally upright frame members that are horizontally spaced apart, each upright frame member having at least one utility trough port therethrough for passing utility conduits through the upright frame members;

at least two generally horizontal frame members extending between the upright frame members with opposite end portions of the horizontal frame members rigidly connected to the upright frame members to define a rigid panel frame having a substantially open interior;

at least one cover panel removably mounted to the panel frame to provide access to the open interior thereof;

at least one utility trough shaped to receive and retain utility conduits therein, and having threadless connectors at opposite ends thereof detachably connecting the utility trough to the upright frame members adjacent the utility trough ports, wherein the connectors are fixed to the utility trough and connect and disconnect the utility trough to the upright frame members upon movement of the utility trough relative to the upright frame members; and wherein the upright frame members each have a hollow tubular construction defining a cavity with the utility trough ports including windows extending through opposite faces thereof and opening to the cavity.

16. A freestanding partition construction, comprising:

at least two generally upright frame members that are horizontally spaced apart, each upright frame member having at least one utility trough port therethrough for passing utility conduits through the upright frame members, wherein the utility trough ports define openings having an edge;

at least two generally horizontal frame members extending between the upright frame members with opposite end portions of the horizontal frame members rigidly connected to the upright frame members to define a rigid panel frame having a substantially open interior;

at least one cover panel removably mounted to the panel frame to provide access to the open interior thereof;

at least one utility trough shaped to receive and retain utility conduits therein, and having threadless connectors at opposite ends thereof detachably connecting the utility trough to the upright frame members adjacent the utility trough ports, wherein the connectors are fixed to the utility trough and connect and disconnect the utility trough to the upright frame members upon movement of the utility trough relative to the upright frame members; and wherein:

the utility trough includes vertically oriented notches which engage an adjacent edge of the associated port opening to longitudinally lock the utility trough in the panel frame.

17. A freestanding partition construction, comprising:

a pair of upright frame members each having opposite side faces;

upper and lower frame members extending between the upright frame members, wherein opposite end portions of the upper and lower members are interconnected with the upright frame members to define a panel frame;

at least one utility trough extending between said upright frame members for routing of utility lines, said utility trough having integrally-formed threadless connectors on opposite ends thereof removably supporting said utility trough on said panel frame; and wherein:

upright frame members each include a utility trough port; and the integrally-formed threadless connectors on the utility troughs are configured to permit horizontal shifting of the utility trough to engage and disengage the connectors with the utility trough ports.

18. A freestanding partition construction, comprising:

a pair of upright frame members comprising tubular posts, each having opposite side faces with openings through the opposite side faces;

upper and lower frame members comprising tubular beams extending between the upright frame members, wherein end portions of the tubular beams are received in the openings through the side faces of the posts; wherein opposite end portions of the upper and lower members are interconnected with the upright frame members to define a panel frame;

at least one utility trough extending between said upright frame members for routing of utility lines, said utility trough having integrally-formed threadless connectors on opposite ends thereof removably supporting said utility trough on said panel frame; and wherein:

the openings are rectangular, with an upwardly-facing lower edge;

the beams have a rectangular cross-sectional shape, each beam including slots across a bottom side of the beam adjacent the opposite ends thereof and connector-receiving openings through the beams adjacent the opposite ends; and wherein lower edges of the openings are received in the slots;

each post further defining front and rear faces having vertical rows of openings configured to support hang-on accessory units, and pairs of connector-receiving openings adjacent the vertical rows of openings, each pair of connector-receiving openings including a first opening on a left side of the vertical rows of openings, and a second opening on a right side of the vertical rows of openings; and including:

lock key members extending through the connector-receiving openings in the posts and the beams to thereby interconnect the posts and beams; and cover panels having connectors received in the connector-receiving openings to retain the cover panels to the posts.

19. A freestanding partition construction, comprising:

a pair of upright frame members comprising tubular posts, each having opposite side faces with openings through the opposite side faces;

upper and lower frame members comprising tubular beams extending between the upright frame members, wherein end portions of the tubular beams are received in the openings through the side faces of the posts; wherein opposite end portions of the upper and lower members are interconnected with the upright frame members to define a panel frame;

at least one utility trough extending between said upright frame members for routing of utility lines, said utility trough having integrally-formed threadless connectors on opposite ends thereof removably supporting said utility trough on said panel frame; and wherein:

each post includes a plurality of beam connection ports, each beam connection port including at least four slots;

each beam including at least four hooks on opposite ends of the beams received in the slots; and lock members movably mounted to opposite ends of the beams, each lock member movable from a disengaged position to an engaged position wherein the lock member and the hooks rigidly interconnect the posts and beams.

20. A freestanding partition construction, comprising:

a pair of upright frame members comprising tubular posts, each having opposite side faces with openings through the opposite side faces;

upper and lower frame members comprising tubular beams extending between the upright frame members, wherein end portions of the tubular beams are received in the openings through the side faces of the posts; wherein opposite end portions of the upper and lower members are interconnected with the upright frame members to define a panel frame;

at least one utility trough extending between said upright frame members for routing of utility lines, said utility trough having integrally-formed threadless connectors on opposite ends thereof removably supporting said utility trough on said panel frame; and wherein:

one of the beams comprises an upper beam that is connected to the posts adjacent upper ends thereof;

one of the beams comprises a lower beam that is connected to the posts adjacent lower ends thereof;

each post includes an upwardly opening cut out at the upper end thereof;

the utility trough is positioned above the upper beam with opposite ends of the utility trough aligned with the cut outs at the upper end of the posts along an upper edge of the panel frame; and wherein:

utility lines extending along the utility trough and through the cut outs at the upper ends of the posts.

21. A method of assembling a utility trough to a freestanding partition system of the type having a plurality of interconnected panel frames including a first frame having first and second spaced-apart generally upright frame members, the method comprising:

providing a utility trough adapted to be connected to the upright frame members to provide for routing of utility lines through the first frame;

attaching the utility trough to the first frame by positioning the utility trough between the first and second upright frame members;

shifting the utility trough to slidably engage a first end of the utility trough with the first upright frame member;

rotating the utility trough about the first end thereof;

shifting the utility trough away from the first upright frame member; and engaging the second end of the utility trough with the second upright frame member to thereby position the utility trough in a generally horizontal orientation wherein the utility trough extends between the first and second upright frame members with the first and second ends of the utility trough supported by the first and second upright frame members, respectively.

22. The method of claim 21, wherein:

the utility trough includes a sliding wedge configured to selectively engage a selected one of the upright frame members to retain the utility trough, the method including:

shifting the sliding wedge into engagement to rigidly connect the utility trough to the first frame.

23. The method of claim 21, including:

providing data lines extending along the utility trough.

24. The method of claim 21, wherein:

rotating the utility trough includes moving the second end of the utility trough downwardly.

25. The method of claim 21, wherein:

the first upright frame member has an opening in a side face thereof; and a portion of the first end of the utility trough is received in the opening.

26. The method of claim 21, wherein:

the first upright frame member includes a pair of openings;

the first end of the utility trough includes a pair of extensions that are slidably received in the openings.

27. The method of clam 26, wherein:

the second upright frame member includes a pair of openings;

the second end of the utility trough includes a pair of hooks that are received in the openings of the second upright frame member as the utility trough is shifted away from the first upright frame member.

28. The method of claim 26, wherein:

the openings in the second upright frame member have lower edges;

engaging the second end of the utility trough with the second upright frame member includes shifting the second end of the utility trough downwardly to engage the hooks with the edges of the openings in the second upright frame members.

29. The method of claim 26, wherein:

the first and second upright frame members include openings through the first and second upright frame members;

attaching the utility trough to the first frame includes aligning opposite ends of the utility trough with the openings through the first and second upright frame members; and wherein:

routing utility lines along the utility trough and though the openings though the first and second upright frame members.

30. The method of claim 21, including:

providing upper and lower beams; and releasably interconnecting the upper and lower beams to the first and second upright frame members to provide a knock-down construction.

31. The freestanding partition construction of claim 10, including:

movable lock members interconnecting the opposite end portions of the horizontal frame members to the upright frame members to provide a knock-down construction of the panel frame.

32. The freestanding partition construction of claim 11, including:

movable lock members interconnecting the opposite end portions of the horizontal frame members to the upright frame members to provide a knock-down construction of the panel frame.

33. The freestanding partition construction of claim 12, including:

movable lock members interconnecting the opposite end portions of the horizontal frame members to the upright frame members to provide a knock-down construction of the panel frame.

34. The freestanding partition construction of claim 15, including:

movable lock members interconnecting the opposite end portions of the horizontal frame members to the upright frame members to provide a knock-down construction of the panel frame.

35. The freestanding partition construction of claim 16, including:

movable lock members interconnecting the opposite end portions of the horizontal frame members to the upright frame members to provide a knock-down construction of the panel frame.

36. The freestanding partition construction of claim 17, including:

movable lock members interconnecting the opposite end portions of the horizontal frame members to the upright frame members to provide a knock-down construction of the panel frame.

* * * * *